US010551755B2

(12) United States Patent
Ota et al.

(10) Patent No.: US 10,551,755 B2
(45) Date of Patent: Feb. 4, 2020

(54) ELECTROSTATIC CHARGE IMAGE DEVELOPING TONER

(71) Applicant: Mitsubishi Chemical Corporation, Tokyo (JP)

(72) Inventors: Masaya Ota, Mie (JP); Tomoko Nakagawa, Niigata (JP); Yuki Narukawa, Niigata (JP); Masaaki Okamoto, Niigata (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 16/018,630

(22) Filed: Jun. 26, 2018

(65) Prior Publication Data

US 2018/0299800 A1 Oct. 18, 2018

Related U.S. Application Data

(63) Continuation of application No. PCT/JP2016/088585, filed on Dec. 22, 2016.

(30) Foreign Application Priority Data

Dec. 28, 2015 (JP) ..... 2015-256204
Dec. 28, 2015 (JP) ..... 2015-256205
Dec. 28, 2015 (JP) ..... 2015-256206
Dec. 28, 2015 (JP) ..... 2015-256207

(51) Int. Cl.
*G03G 9/093* (2006.01)
*G03G 9/087* (2006.01)
*G03G 9/08* (2006.01)
*G03G 9/09* (2006.01)

(52) U.S. Cl.
CPC ..... *G03G 9/08797* (2013.01); *G03G 9/0804* (2013.01); *G03G 9/0819* (2013.01); *G03G 9/0821* (2013.01); *G03G 9/08795* (2013.01); *G03G 9/09321* (2013.01); *G03G 9/09328* (2013.01); *G03G 9/0904* (2013.01); *G03G 2215/2045* (2013.01)

(58) Field of Classification Search
CPC ..... G03G 9/09321; G03G 9/09364; G03G 9/09392; G03G 9/0821; G03G 9/08797; G03G 9/08795; G03G 9/0827; G03G 9/09328
See application file for complete search history.

(56) References Cited

U.S. PATENT DOCUMENTS

| | | | |
|---|---|---|---|
| 2008/0025754 | A1 | 1/2008 | Ishiyama et al. |
| 2016/0011534 | A1 | 1/2016 | Sano |
| 2016/0097985 | A1 | 4/2016 | Ota |
| 2016/0179025 | A1 | 6/2016 | Nakagawa et al. |

FOREIGN PATENT DOCUMENTS

| | | | | |
|---|---|---|---|---|
| JP | 2007-264573 | A | | 10/2007 |
| JP | 2008-033057 | A | | 2/2008 |
| JP | 2010-139696 | A | | 6/2010 |
| JP | 2012-022331 | A | | 2/2012 |
| JP | 2014-182348 | A | | 9/2014 |
| JP | 2014-209188 | A | * | 11/2014 |
| JP | 2014-209215 | A | | 11/2014 |
| JP | 2015-064573 | A | | 4/2015 |
| JP | 2017120424 | A | * | 7/2017 |
| JP | 2017120425 | A | * | 7/2017 |
| WO | 2014/148509 | A1 | | 9/2014 |

OTHER PUBLICATIONS

ESPACENET machine-assisted English-language translation of JP 2017-120424 (pub Jul. 2017) (Year: 2017).*
ESPACENET machine-assisted English-language translation of JP 2017-120425 (pub Jul. 2017) (Year: 2017).*
ESPACENET machine-assisted English-language translation of JP 2014-209188 (pub Nov. 2014) (Year: 2014).*
Search Report (with translation) and Written Opinion dated Mar. 28, 2017, issued in corresponding International Application No. PCT/JP2016/088585.

* cited by examiner

*Primary Examiner* — Janis L Dote
(74) *Attorney, Agent, or Firm* — Morgan, Lewis & Bockius LLP

(57) ABSTRACT

The present invention relates to an electrostatic charge image developing toner having a ratio of TP2/TP1 of 1.47 to 2.35, wherein a first measurement value of a tan δ maximal value measured in 40° C. to 80° C. by a rheometer is set as the TP1, and a second measurement value of a tan δ maximal value measured in 40° C. to 80° C. by the rheometer is set as the TP2.

18 Claims, 5 Drawing Sheets

ELECTROSTATIC CHARGE IMAGE DEVELOPING TONER

TECHNICAL FIELD

The present invention relates to an electrostatic charge image developing toner which is capable of realizing both of a fixability at a low temperature and a high glossiness while maintaining a blocking resistance, and obtaining a high quality image even at the time of fixing at a low temperature.

BACKGROUND ART

The electrostatic charge image developing toner is used for image formation in which an electrostatic charge image is visualized in a printer, a copying machine, a facsimile, or the like. Taking the image formation by the electrophotographic method as an example, the image formation is performed by in such a manner that, first, an electrostatic latent image is formed on a photosensitive drum, which is then developed with a toner, transferred to transfer paper or the like, and fixed by heat or the like.

As the electrostatic charge image developing toner, for example, a toner in which a solid fine particle such as silica is attached to the surface as an external additive is generally used for the purpose that a charge control agent, a release agent, a magnetic material, and the like are dry-mixed in a binder resin and a colorant, as necessary, and then various performances such as fluidity are imparted to toner particles obtained by melt kneading with an extruder or the like, followed by pulverization and classification, a so-called melt-kneading pulverization method.

Further, according to the recent demands for high definition, production methods such as a suspension polymerization method, an emulsion aggregation method, a dissolution suspension method and the like, which are easy to control the particle diameter and particle size distribution of the toner, have been proposed.

In recent years, efforts to apply images obtained by electrophotographic method such as copying machines and printers to the professional field are actively conducted, and it has been necessary to beautifully output images such as photographs and graphics from the purpose of printing characters so far. For this reason, it is strongly desired that the output image has higher glossiness than ever.

On the other hand, since the electrophotographic apparatus is expected to simultaneously achieve low energy consumption and high-speed printing, the toner is strongly desired to be melted with low heat energy (time×temperature), fixed on a medium, and thus to have image quality with high glossiness, and the fixability at a low temperature and high glossiness are in an antinomic relation with the blocking resistance, and these three points are desired to be achieved. Various investigations have been performed so as to realize both of the fixability at a low temperature and the blocking resistance.

PTL 1 discloses a toner containing a crystalline polyester resin and a release agent, in which a structure in which the crystalline polyester resin is in contact with the releasing agent is present on a cross section of the toner dyed with ruthenium, and when a cross-sectional area for the structure is set as A, a cross-sectional area only for the release agent is set as B, and a cross-sectional area only for the crystalline polyester resin is set as C, relationships represented by $40 \leq 100 \times A/(A+B+C) \leq 70$, $10 \leq 100 \times B/(A+B+C) \leq 30$, and $20 \leq 100 \times C/(A+B+C) \leq 30$ are satisfied.

PTL 2 proposes an electrostatic charge image developing toner containing a crystalline organic compound having a melting point of 50° C. to 150° C. as a fixing assistant for the purpose of heat resistant storage and low temperature fixing, in which in order to compatibilize a resin and the fixing assistant at the time of heating, in DSC measurement of toner, the amount of heat absorption at the melting maximum value derived from the fixing assistant at second temperature rise becomes smaller than that at first temperature rise, a glass transition temperature of the toner is more decreased than that the glass transition temperature of the resin, and the glass transition temperature at the second temperature rise becomes lower than that at the first temperature rise.

PTL 3 discloses an electrostatic charge image developing toner which is a core shell structure including a toner base particle and a shell layer, in which the toner base particle includes a resin coating layer formed of a water soluble resin on a surface of the toner base particle, and a shell layer on the resin coating layer.

CITATION LIST

Patent Literature

[PTL 1] JP-A-2008-33057
[PTL 2] JP-A-2012-22331
[PTL 3] JP-A-2015-64573

SUMMARY OF INVENTION

Technical Problem

However, although studies are performed in terms of the blocking resistance and the fixability at a low temperature in all of the above-described PTLs, but it cannot be said that both of the blocking resistance and the fixability are sufficiently realized, and are not sufficient particularly in terms of the high glossiness even at the time of fixing at low temperature in which thermal energy is not much applied to the toner or at the time of printing at high speed, while maintaining the blocking resistance.

An object of the present invention is to provide an electrostatic charge image developing toner which is capable of realizing both of the fixability at a low temperature and the high glossiness, even at the time of fixing at low temperature or at the time of printing at high speed, while maintaining the blocking resistance.

Solution to Problem

The present inventors have found that it is effective that a ratio of a first measurement value (TP1) to a second measurement value (TP2) of a tan δ maximum value measured by a rheometer is adjusted so as to be in a specific range, as an aspect that both of the fixability at a low temperature and the high glossiness can be realized, even at the time of fixing at low temperature or at the time of printing at high speed, while maintaining the blocking resistance.

In addition, the present inventors have found that when the fine unevenness value on the toner surface is adjusted to be in a specific range, it is possible to obtain more remarkable effect of the present invention, and when a glass transition temperature (Tg) of the toner is adjusted to be in a specific range, still more remarkable effect of the present invention can be obtained, and thereby the present invention have completed.

The present invention is based on the above findings, and aspects of the present invention are as follows.

(1) An electrostatic charge image developing toner having a ratio of TP2/TP1 of 1.47 to 2.35, wherein a first measurement value of a tan δ maximal value measured in 40° C. to 80° C. by a rheometer is set as the TP1, and a second measurement value of a tan δ maximal value measured in 40° C. to 80° C. by the rheometer is set as the TP2.

(2) The electrostatic charge image developing toner according to the (1) above, comprising: a toner base particle containing at least a binder resin and a colorant; and an external additive.

(3) The electrostatic charge image developing toner according to the (2) above, wherein the toner base particle includes: a core component containing at least the binder resin and the colorant; and a high heat-resistant resin fine particle component that exists surrounding the core component, and wherein there is no shading difference between the core component and the high heat-resistant resin fine particle component when measurement is performed by a scanning electron microscope.

(4) The electrostatic charge image developing toner according to any one of the (1) to (3) above, which has an average circularity of 0.95 to 0.99.

(5) The electrostatic charge image developing toner according to any one of the (1) to (4) above, which has a volume average particle diameter of 5 to 8 μm.

(6) The electrostatic charge image developing toner according to any one of the (1) to (5) above, which further comprises wax.

(7) The electrostatic charge image developing toner according to any one of the (1) to (6) above, wherein the TP2/TP1 is 1.63 to 2.35.

(8) The electrostatic charge image developing toner according to any one of the (1) to (6) above, wherein the TP2/TP1 is 1.63 to 2.22.

(9) The electrostatic charge image developing toner according to any one of the (1) to (6) above, wherein the TP2/TP1 is 1.79 to 2.22.

(10) The electrostatic charge image developing toner according to any one of the (1) to (6) above, wherein the TP2/TP1 is 1.79 to 2.09.

(11) The electrostatic charge image developing toner according to any one of the (1) to (10) above, wherein when a BET specific surface area after the electrostatic charge image developing toner is subjected to an external additive releasing treatment is set as BETN, and a specific surface area measured by a flow-type particle analyzer after the electrostatic charge image developing toner is subjected to an external additive releasing treatment is set as BETF, the BETN-BETF which is a difference therebetween is 0.54 $m^2/g$ to 1.56 $m^2/g$.

(12) The electrostatic charge image developing toner according to the (11) above, wherein the BETN-BETF is 0.77 $m^2/g$ to 1.56 $m^2/g$.

(13) The electrostatic charge image developing toner according to the (11) above, wherein the BETN-BETF is 0.99 $m^2/g$ to 1.45 $m^2/g$.

(14) The electrostatic charge image developing toner according to any one of the (1) to (13) above, which has a glass transition temperature (Tg) measured by a differential scanning calorimeter (DSC) of 37.9° C. to 45.4° C.

(15) The electrostatic charge image developing toner according to any one of the (1) to (6) above, wherein when a temperature in 40° C. to 80° C. at which the tan δ becomes maximum in a first temperature rise measurement by the rheometer is set as $[T_{1st}]$, and a temperature in 40° C. to 80° C. at which the tan δ becomes maximum in a second temperature rise measurement by the rheometer is set as $[T_{2nd}]$, the $[T_{2nd}]-[T_{1st}]$ which is a difference therebetween is 1.0° C. to 4.5° C., the TP1 is 1.15 to 1.80, and the TP2/TP1 is 1.50 to 2.20.

(16) The electrostatic charge image developing toner according to any one of the (1) to (10) above, wherein the glass transition temperature (Tg) of the electrostatic charge image developing toner measured by the differential scanning calorimeter (DSC) is 38.5° C. to 45.5° C., and wherein when a BET specific surface area after the electrostatic charge image developing toner is subjected to an external additive releasing treatment is set as BETN, and a specific surface area measured by a flow-type particle analyzer after the electrostatic charge image developing toner is subjected to an external additive releasing treatment is set as BETF, BETN-BETF which is a difference therebetween is 0.60 $m^2/g$ to 1.60 $m^2/g$.

(17) The electrostatic charge image developing toner according to the (16) above, wherein a storage modulus (G') at a tan δ maximum value temperature ($[T_{1st}]$) in a first measurement measured in 40° C. to 80° C. by the rheometer is $1.10\times10^7$ Pa to $2.95\times10^7$ Pa.

(18) The electrostatic charge image developing toner according to any one of the (1) to (6) above, wherein when a first measurement value of a storage modulus (G') measured by the rheometer is set as $[G'_{1st}]$, and a second measurement value thereof is set as $[G'_{2nd}]$, a maximum value $[G'_{1st}]/[G'_{2nd}]$ MAX of $[G'_{1st}]/[G'_{2nd}]$ in 63.0° C. to 80.0° C. is 1.40 to 10.0.

(19) The electrostatic charge image developing toner according to the (18) above, wherein when a maximum exothermic peak temperature measured by a differential scanning calorimeter (DSC), at the time of temperature drop is set as [maximum exothermic peak temperature Td], the [maximum exothermic peak temperature Td] is 50° C. to 75° C.

Advantageous Effects of Invention

According to the present invention, even at the time of fixing at low temperature or at the time of printing at high speed, while maintaining the blocking resistance, it is possible to provide an electrostatic charge image developing toner which is capable of realizing both of the excellent fixability and the high glossiness.

DESCRIPTION OF EMBODIMENTS

1. Measurement Method and Definition

Figure 1:
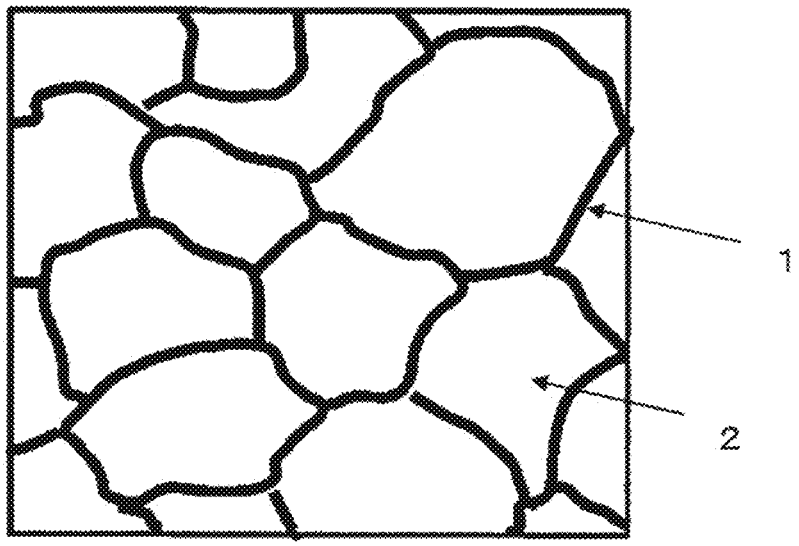
FIG. 1 is a conceptual diagram of a cross section of a formed body at the time of measuring an electrostatic charge image developing toner of the present invention by a reflectometer for the first time by a rheometer.

In the present invention, a material before the addition of the external additive is referred to as external additive "toner base particle". A material having the external additive on the surface of the toner base particle is referred to as "toner" or "electrostatic charge image developing toner".

The measurement of the rheometer of the toner was performed by the method described in examples, a temperature, a storage modulus (G'), a loss modulus (G"), tan δ (=G"/G'), a tan δ maximum value, "TP1 which is a first measurement value of a tan δ maximum value measured in a temperature range of 40° C. 80° C.", "TP2 which is a second measurement value of the tan δ maximum value in a temperature range of 40° C. to 80° C.", and the like are defined to be measured by the measuring method described in examples.

The "first temperature rise" (and "second temperature rise") in the present invention is also defined as the temperature rise in the measurement method described in examples.

The measuring method and definition of BETN, BETF, and "BETN-BETF" are also defined by the method described in the examples and measured by the measurement methods described in the examples.

The electrostatic charge image developing toner of the present invention is a toner (indicating) having such a numerical value (parameter) when measured by the measuring method (apparatus, setting, or the like) described in examples and the like.

That is, even in a case where a numerical value (parameter) is measured by another apparatus or other setting, when the toner itself is measured by the measuring method described in examples and the like of the present specification, as long as the toner has (indicates) the numerical value (parameter), the toner is included in the present invention.

Although, details will be described later, the toner of the present invention preferably contains "a central portion (core) component containing at least a binder resin and a colorant" and a high heat-resistant resin fine particle component present in the vicinity thereof, and an external additive.

That is, the toner of the present invention is particularly preferable to be a toner which contains a toner base particle containing a core component containing at least a binder resin and a colorant and a high heat-resistant resin fine particle component present in the vicinity thereof, and an external additive.

In any method of preparing toner base particles as described below, the high heat-resistant resin fine particle component refers to a material localized on a surface of the toner base particle. The shape of the high heat-resistant resin fine particle component when being a toner may be a fine particle or a thin film, and further may continuously cover the core component or discontinuously cover the core component, and a state in which the high heat-resistant resin fine particle is thinned into a flat shape and the coverage is relatively increased for the additive amount of the high heat-resistant resin fine particles is preferable, a state in which the thin film and the background of the core component by the high heat-resistant resin fine particle have a bicontinuous structure is more preferable, and a state in which this thin film is more selectively attached to the convex portion as compared to the concave portion on the toner surface (that is, portions where the background of the core component is visible are fewer in the convex portion than in the concave portion) is still more preferable.

Figure 3:
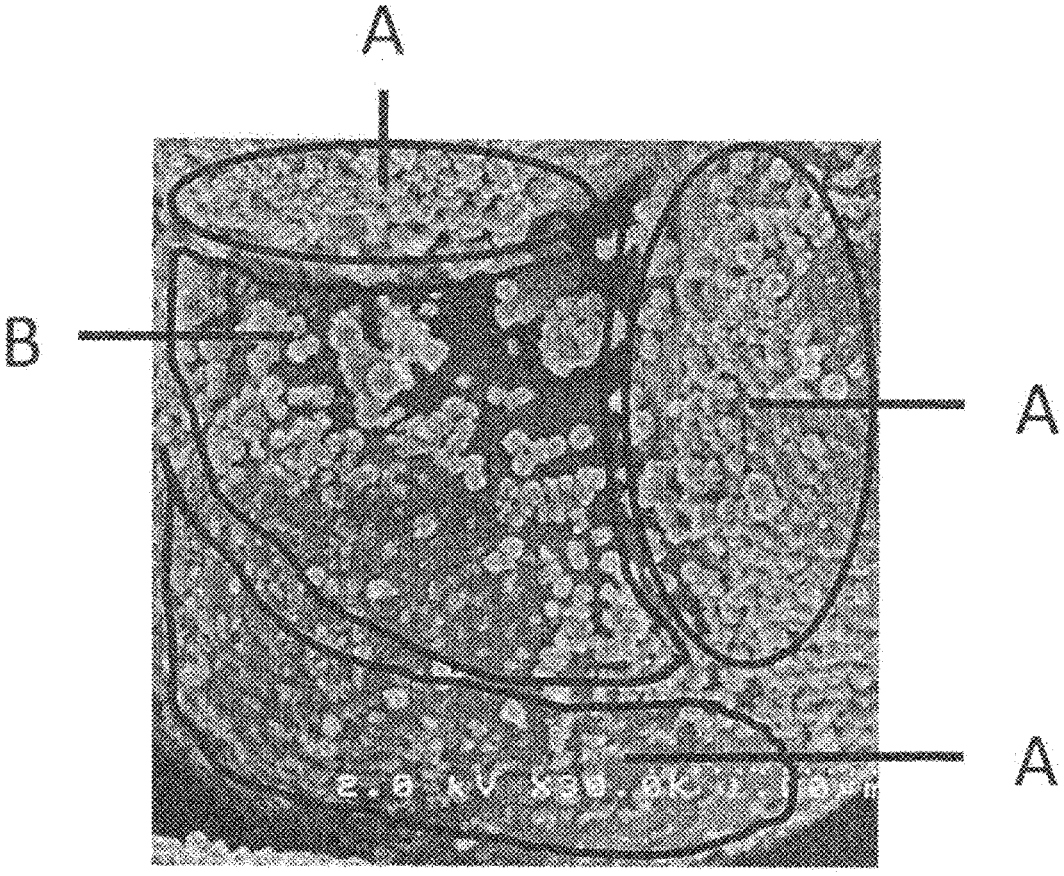
FIG. 3 is a SEM image of an enlarged portion of one electrostatic charge image developing toner prepared in Example 7, and a diagram (picture) illustrating a state where high heat-resistant resin fine particle components that are thinned are present in a concave portion of the toner surface, and many of these components are present on a convex portion.

For example, FIG. 3 is an enlarged photograph of a part of one toner, and a number of concave portions B on the toner surface where the amount of epidermis (the background of the core component) that appears black is small in the concave portion on the surface of the toner base particle, that is, the amount of thinned high heat-resistant resin fine particle components is small are observed, and a number of convex portions A on the toner surface where the amount of thinned epidermis without eaves (high heat-resistant resin fine particle component), that is, the amount of the thinned high heat-resistant resin fine particle components is large in the convex portion on the surface of the toner base particle are observed.

The core shell structure of the toner base particle of the toner in the related art is a structure in which the shell entirely covers the core or the shell partially covers the core regardless of the unevenness of the surface of the toner base particle, and the shell covers the surface of the core as an epidermis independent of the core.

In a case of preparing the toner base particle in a wet medium (an aqueous and/or organic solvent is set as a continuous phase), a method of thermodynamically disposing (controlling the polarity) the high heat-resistant fine particle on an interface between the core component and the wet medium by adding the high heat-resistant fine particle and the core component at the same time, a method of physically disposing the high heat-resistant fine particle on the surface of the core component by adding the high heat-resistant fine particle after adding the core component, and a combination of thermodynamically disposing (controlling the polarity) method and the physically disposing (adding order) method can be used.

In addition, in the case of adding the high heat-resistant fine particle is added after adding the core component, an additional adding method after the composition and/or shape of the central portion (core) component has been determined (the shape, physical properties, compatibilization, and the like of the central portion (core) may be changed by heating, aging, stirring, and the like thereafter) can be exemplified.

Hereinafter, the material where the high heat-resistant resin fine particle component surrounds the core is abbreviated as "shell" in some cases.

In the toner in which the external additive is externally added to toner base particle, "the structure formed of the high heat-resistant resin fine particle component and the external additive" is important in the present invention as a matter and concept for the above "core" in measurement with a rheometer. Hereinafter, "the structure formed of the high heat-resistant resin fine particle component and the external additive" may be abbreviated simply as "the structure" in some cases.

2. Definition of Electrostatic Charge Image Developing Toner 2.1. TP2, TP1, and TP2/TP1

In the electrostatic charge image developing toner of the present invention, TP2 and TP1 measured by the rheometer do not have the same values. This is considered to indicate that a change in the structure of the toner is caused by heating at the first measurement, and the reason for this is presumed as follows.

In the first measurement, as described in examples, the toner is not heated as much as possible and is molded into a pellet with no gap between the toners, and thus it is presumed that a sample having a "structure 1 formed of the high heat-resistant resin fine particle component unevenly distributed on the surface of the toner base particle as illustrated in FIG. 1 and the external additive" is measured.

Since the high heat-resistant resin fine particle component, which is a shell component having a higher molecular entanglement density than that of the central portion (core) component 2 of the toner base particle, forms a structure, in the first measurement, it is presumed that G' tends to be larger than G" when the toner behaves more resiliently, and thus tan δ (TP1) tends to be small.

On the other hand, in the second measurement, a state in which the core component, the high heat-resistant resin fine particle component, and the external additive are melted and mixed by heating and shearing at the first measurement so as to form a mixture, and the composition is averaged as compared with that in the first measurement is measured.

Therefore, the core component has a larger volume (mass) than the high heat-resistant resin fine particle component, and the properties of the core component having a lower molecular entanglement density than that of the high heat-resistant resin fine particle (component) is emphasized so that G" tends to be larger than G', and thereby the tan δ (TP2) has a value larger than the value of the first measurement.

In other words, the rheological behavior thereof relatively measures the rheology of the structure for the first time, and the rheology of the mixture for the second time.

Accordingly, in a case where TP2/TP1 is large, the proportion in which a phase of the high heat-resistant resin fine particle (component) and the external additive forms a continuous phase at the first measurement is relatively high, and the rheological behavior of the structure appears so that G' is relatively large compared to G" (TP1 is relatively small).

On the other hand, in a case where TP2/TP1 is small, the proportion in which the high heat-resistant resin fine particle and the external additive forms a continuous phase at the first measurement is relatively low, and the rheological behavior of the structure is less likely to appear so that G" is relatively large compared to G' (TP1 is relatively large).

In the first measurement with the rheometer, the "heating and shearing" is performed under static conditions, and the change in a small part of toner particle unit (for example, refer to the above description and FIG. 1) has occurred.

Even at the time of fixing at low temperature or at the time of printing at high speed while maintaining the blocking resistance, in order to take balance between both of the fixability at a low temperature and the high glossiness can be achieved, TP2/TP1 is necessary to be in an appropriate range, and the range is 1.47 to 2.35.

It is presumed that in the toner having this range, the high heat-resistant resin fine particle component exists thinly in a state of covering the surface of the toner base particle, and the external additive is externally added to the outside thereof, and the high heat-resistant resin fine particle component and the core component are more compatible with each other to some extent at the second measurement than at the first measurement, that is, the high heat-resistant resin fine particle component and the core component are formed at an exquisite balance in a state of being neither too close to nor too distant.

For example, if the core component and the high heat-resistant resin fine particle component are completely different chemical components or the high heat-resistant resin fine particle component is a component having extremely high Tg such as salt, the structural change (for example, an incompatible state) does not occur before and after the first measurement with the rheometer, and thus TP2/TP1 approaches 1.

Since the above-described structure is formed of the high heat-resistant resin fine particle component and the external additive, it is important to measure the toner instead of measuring the toner base particles in this measurement.

The TP2/TP1 measured by the rheometer is equal to or greater than 1.47, is preferable equal to or greater than 1.63, and more preferable equal to or greater than 1.79. Further TP2/TP1 is equal to or smaller than 2.35, is preferably equal to or smaller than 2.22, and is more preferably equal to or smaller than 2.09.

When TP2/TP1 is excessively small, the blocking resistance tends to be insufficient, and when TP2/TP1 is excessively large, the fixability and the gloss tend to be insufficient.

As a preferably specific range of TP2/TP1, it is preferably a range of 1.63 to 2.35, is more preferably a range of 1.63 to 2.22, is still more preferably a range of 1.79 to 2.22, and is particularly preferably a range of 1.79 to 2.09.

As control means of TP2/TP1, the following can be exemplified.

In order to make the value of TP2/TP1 large, it is possible to exemplify some methods of making a difference in polarity between the core component and the high heat-resistant resin fine particle component large (in a case where the high heat-resistant resin fine particle and the core component are attached to each other in water, the polarity of the high heat-resistant resin fine particle is designed to be larger than that of the core component, and an aqueous phase is preferable), making a molecular weight of the high heat-resistant resin fine particle large, making a crosslink density of the high heat-resistant resin fine particle large, making the additional amount of the high heat-resistant resin fine particle large, and making the coverage of the core component in the high heat-resistant resin fine particle (component) large (even with the same addition amount, the difference in polarity between the core component and the high heat-resistant resin fine particle component that is made into a thin film or not to penetrate into the core component).

In order to make TP2/TP1 small, an opposite design thereof may be performed.

Further, TP1 indicating the formation state of the structure is preferably equal to or greater than 0.98, is more preferably equal to or greater than 1.07, and is still more preferably equal to or greater than 1.16. In addition, TP1 is preferably equal to or smaller than 1.64, is more preferably equal to or smaller than 1.52, and is still more preferably equal to or smaller than 1.39.

When TP1 is small, the blocking resistance tends to be enhanced, and when TP1 is large, the fixability and the high glossiness tend to be enhanced.

2.2. BETN, BETF, "BETN-BETF"

The "BETN-BETF" is obtained by measuring the specific surface area after the externally added external additives are removed and the surface of the toner base particle is exposed.

The BET specific surface area represented by BETN is a numerical value that captures the particle diameter of the toner base particle, the circularity, and the fine unevenness of the surface. On the other hand, the specific surface area measured by the flow type particle analyzer represented by BETF is calculated by calculating the particle diameter and the circularity of the toner base particle by image analysis photographed at coarse resolution, and calculating the surface area from the calculated value, and thus is the surface area obtained by dividing the fine unevenness value.

Therefore, it is presumed that the difference between BETN and BETF represents the fine unevenness on the surface of the toner base particle, the larger the "BETN-BETF" is, the larger the fine unevenness is.

A case where the BETN-BETF is small means that the surface of the toner base particle is nearly smooth, and in this case, the fixability at a low temperature is not impaired by a heat insulation action of the air intervening the fine unevenness, and the high heat-resistant resin fine particle is not unnecessarily projected to the outside of the toner, and thus there is no absorption of thermal energy necessary to melt that portion, so that the fixability at a low temperature and the high glossiness are enhanced.

On the other hand, a case where the BETN-BETF is large means that the fine unevenness are formed on the surface of the toner base particle, the high heat-resistant resin fine particle (component) does not become excessively thin, and heat resistance can be maintained, or the high heat-resistant resin fine particle (component) does not excessively penetrate into the central portion of the toner, which affects the blocking resistance.

Therefore, in order to take a balance between the high glossiness and the fixability at a low temperature in an advanced region, the "BETN-BETF" needs to be in an appropriate range.

The BET specific surface area and the specific surface area measured by the flow type particle analyzer are not the toner base particle before external addition, but are measured using the toner base particle obtained by performing the external additive releasing treatment on the toner after the external addition so as to control the difference. In the present invention, it is found that this point is important.

As will be described later, since the shape of the high heat-resistant resin fine particle changes by external addition, the toner to be supplied to the printer and the copying machine is an external additive product, so that a surface structure of the toner base particle after external addition is presumed to be related to the toner performance.

The value of BETN-BETF is preferably equal to or greater than 0.54 $m^2/g$, is more preferably equal to or greater than 0.77 $m^2/g$, and is particularly preferably equal to or greater than 0.99 $m^2/g$. In addition, the value of BETN-BETF is preferably equal to or smaller than 1.56 $m^2/g$, is more preferably equal to or smaller than 1.51 $m^2/g$, and is particularly preferably equal to or smaller than 1.45 $m^2/g$.

When the value of BETN-BETF is small, the fixability at a low temperature and the high glossiness tend to be enhanced. When the value of BETN-BETF is large, the blocking resistance tends to be enhanced.

As a preferably specific range of the value of BETN-BETF, it is preferably a range of 0.54 $m^2/g$ to 1.56 $m^2/g$, is more preferably a range of 0.77 $m^2/g$ to 1.56 $m^2/g$, and is particularly preferably a range of 0.99 $m^2/g$ to 1.45 $m^2/g$.

As control means of the value of BETN-BETF, the following can be exemplified.

In order to make the value of BETN-BETF, it is necessary to make the micro surface roughness large, for example, in order to prevent the high heat-resistant resin fine particle from being embedded, it is possible to exemplify some methods of making the particle diameter of the high heat-resistant resin fine particle large, making the difference in polarity between the core component and the high heat-resistant resin fine particle component large (in a case where the high heat-resistant resin fine particle and the core component are attached to each other in water, the polarity of the high heat-resistant resin fine particle is designed to be larger than that of the core component, and an aqueous phase is preferable), and making the high heat-resistant resin fine particle heated not to be equal to or higher than Tg.

Further, when performing the external addition on the toner base particle, embedding and excessive elongation of the high heat-resistant resin fine particle in the core component are prevented by lowering the temperature, shortening the time, lowering the rotation speed, and the like are also effective. In addition, it is possible to make the BETN-BETF large by increasing the additional amount of the high heat-resistant resin fine particles.

On the other hand, in order to make the BETN-BETF small, an opposite design thereof may be performed.

2.3. Glass Transition Temperature (Tg)

Further, from the viewpoint of realizing both of the fixability at a low temperature and the high glossiness, the Tg measured by the differential scanning calorimeter (DSC) of the toner is also important even at the time of fixing at low temperature or at the time of printing at high speed while maintaining the blocking resistance, and the range of the glass transition temperature (Tg) of the toner is preferably equal to or lower than 45.4° C., is more preferably equal to or lower than 43.8° C., and is still more preferably equal to or lower than 42.1° C. In addition, the range of Tg is preferably equal to higher than 37.9° C., is more preferably equal to higher than 38.7° C., and is still more preferably equal to higher than 39.5° C.

When the Tg is adjusted to this range, it is possible to obtain more the fixability at a low temperature and the high glossiness while maintaining the blocking resistance within the range where the core component and the high heat-resistant resin fine particle are adjusted to the above-described suitable range.

The reason for this is that it is possible to compensate for the blocking resistance by raising the Tg of the toner to lower the Tg of the toner so that the fixability at a low temperature and the gloss can be adjusted to be in a more preferable range.

In order to raise the Tg of the toner, it is preferable to increase the copolymerization ratio of the monomer component having a high Tg, to reduce the molecular weight (Mc) component which is not more than twice the intertwining point molecular weight (to decrease the molecular weight modifier and the like, or increase the amount of a crosslinking agent), and to increase the plasticizer (for example, wax, and crystalline resin) having a melting point of equal to or lower than 100° C. to plasticize the binder resin.

On the other hand, in order to make the Tg of the toner low, an opposite design thereof may be performed.

<More Preferable Toner Parameters>

2.4. $[T_{2nd}]$, $[T_{1st}]$, and $[T_{2nd}]-[T_{1st}]$

It is more preferable that the toner of the present invention further satisfies the following requirements.

That is, when a temperature in 40° C. to 80° C. at which the tan δ becomes maximum in a first temperature rise measurement by the rheometer is set as $[T_{1st}]$, and a temperature in 40° C. to 80° C. at which the tan δ becomes maximum in a second temperature rise measurement is set as $[T_{2nd}]$ and $[T_{2nd}]-[T_{1st}]$ is in 1.0° C. to 4.5° C., the toner in which the TP1 is 1.15 to 1.80, and the TP2/TP1 is 1.50 to 2.20 is more preferable.

Regarding the rheometer measurement, the measurement was performed according to the method described in examples, and when the toner itself was measured by the measurement method described in the examples, as long as the toner has (indicates) the numerical values (parameters) range of $[T_{2nd}]$, $[T_{1st}]$, and $[T_{2nd}]-[T_{1st}]$, it is included in the present invention.

$[T_{2nd}]-[T_{1st}]$ is obtained as follows.

The tan δ (=G"/G') is obtained from the storage modulus (G') and the loss modulus (G") obtained in the first temperature rise measurement.

Figure 2:
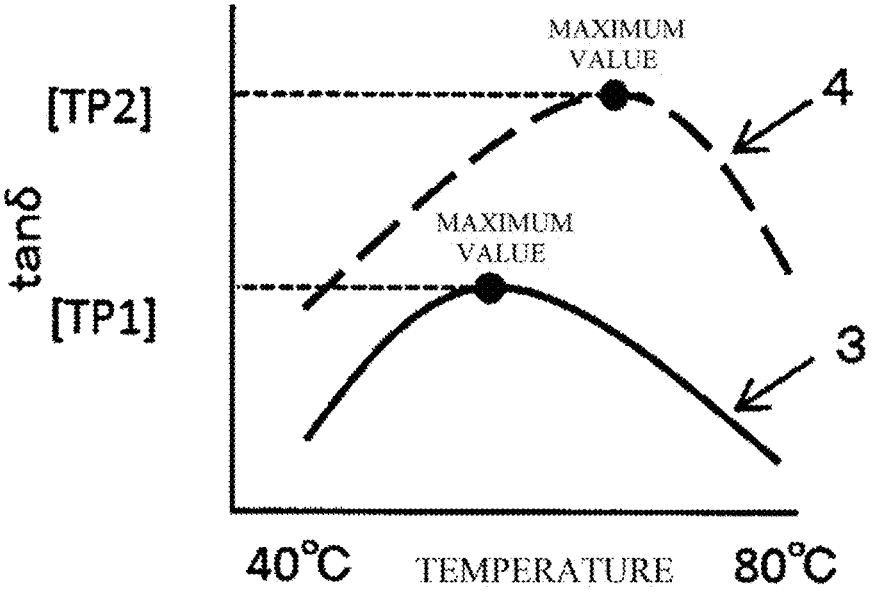
FIG. 2 is a conceptual diagram at the time of measuring TP1 and TP2 of the electrostatic charge image developing toner of the present invention.

As illustrated in FIG. 2, a tan δ curve 4 in the first measurement is obtained by rheometer measurement, and a temperature $[T_{1st}]$ at which tan δ in the first temperature rise measurement obtains a maximum value is obtained. Similarly, a tan δ curve 3 in the second measurement is obtained, and a temperature $[T_{2nd}]$ at which tan δ in the second temperature rise measurement obtains a maximum value is obtained. The $[T_{2nd}]-[T_{1st}]$ is obtained by using the above description.

In the electrostatic charge image developing toner of the present invention, $[T_{1st}]$ and $[T_{2nd}]$ are not the same value. This is considered to indicate that a change in the structure of the toner is caused by heating at the first measurement, and the reason for this is presumed as follows. This is considered to indicate that a change in the structure of the toner is caused by heating at the first measurement, and the reason for this is presumed as follows.

Although, details will be described later, the toner of the present invention contains "a central portion (core) component containing at least a binder resin and a colorant" and a high heat-resistant resin fine particle present in the vicinity thereof, and an external additive.

Since the measurement sample is molded into a pellet without heating the toner as much as possible, the central portion (core) component and the "high heat-resistant resin fine particle and external additives" are maintained in a state of being separated after molding.

The $[T_{1st}]$ obtained by measuring this molded product is a value reflecting the properties of the central portion (core) component present as a large domain.

On the other hand, the central portion (core) component, the high heat-resistant resin fine particle component, and the external additive are melted and mixed by heating at the first measurement, and thus the $[T_{2nd}]$ is a value reflecting the average composition of the entire toner.

A case where $[T_{2nd}]-[T_{1st}]$ is large indicates a large difference between thermal properties of the central portion (core) component and the high heat-resistant resin fine particle component, or a state of a high contribution ratio or mass ratio on thermal properties of the "high heat-resistant resin fine particle component and the external additive" with respect to the central portion (core) component.

A case where $[T_{2nd}]-[T_{1st}]$ is small indicates a small difference between thermal properties of the central portion (core) component and the high heat-resistant resin fine particle component, or a state of a low contribution ratio or mass ratio on thermal properties of the "high heat-resistant resin fine particle component and the external additive" with respect to the central portion (core) component.

$[T_{2nd}]-[T_{1st}]$ is equal to or higher than 1.0° C., is preferably equal to or higher than 1.1° C., is more preferably equal to or higher than 1.8° C., and is particularly preferably equal to or higher than 2.5° C.

Further, $[T_{2nd}]-[T_{1st}]$ is equal to or lower than 4.5° C., is preferably equal to or lower than 4.3° C., and is particularly preferably equal to or lower than 4.0° C.

When being within the above range, the toner having a good balance between the blocking resistance and the fixability at a low temperature is realized.

In a case where TP2/TP1 is large, the high heat-resistant resin fine particle and the external additive are large but the melting and mixing by heating at the time of the first measurement tend to progress, and in a case where TP2/TP1 is small, the high heat-resistant resin fine particle and the external additive are small.

In order to take a balance between the blocking resistance and the fixability at a low temperature, TP2/TP1 is necessary to be in an appropriate range, and the range is 1.50 to 2.20. It is presumed that the toner which is within this scope is in a state in which the high heat-resistant resin fine particle component is slightly present in the vicinity of the surface of the toner base particle, and the external additive is externally added to the outside thereof.

Since the above-described structure is formed of the high heat-resistant resin fine particle component and the external additive, it is important to measure the toner instead of measuring the toner base particles in this measurement.

In the toner having $[T_{2nd}]-[T_{1st}]$ in 1.0° C. to 4.5° C., TP1 is preferably equal to or greater than 1.15, is more preferably equal to or greater than 1.20, and is particularly preferably equal to or greater than 1.30. In addition, TP1 is preferably equal to or smaller than 1.80, is more preferably equal to or smaller than 1.60, and is still more preferably equal to or smaller than 1.40.

In the toner having $[T_{2nd}]-[T_{1st}]$ in 1.0° C. to 4.5° C., TP2/TP1 is preferably equal to or greater than 1.50, and is preferably equal to or lower than 2.20. A more preferable range, particularly preferable range, and the like are the same as the above-described ranges.

When being within the above range, the toner having a good balance between the blocking resistance and the fixability at a low temperature is realized. When $[T_{2nd}]-[T_{1st}]$ is large, the blocking resistance tends to be enhanced, when $[T_{2nd}]-[T_{1st}]$ is small, the fixability at a low temperature tends to be enhanced.

In order for $[T_{2nd}]-[T_{1st}]$ to be in 1.0° C. to 4.5° C., "a central portion (core) component containing at least the binder resin and the colorant" and the high heat-resistant resin fine particle are in a state of not being completely melted and mixed, and thus it is necessary that a balance between the particle diameter and the content of the high heat-resistant resin fine particle is adjusted, and the content of each component such as the wax and the colorant is adjusted.

The particle diameter of the high heat-resistant resin fine particle is preferably equal to or larger than 50 nm, and is more preferably equal to or larger than 70 nm, and is preferably equal to or smaller than 300 nm, and is more preferably equal to or smaller than 250 nm. As the particle diameter of the high heat-resistant resin fine particle is increased, it is preferable to reduce the additional amount of the high heat-resistant resin fine particle so as to take a balance.

The additional amount of the high heat-resistant resin fine particle can be determined based on the coverage. The coverage can be calculated from the ratio of a surface area obtained from the target particle diameter when toner base particles are assumed to be spherical to a projected area obtained from the average particle diameter when the high heat-resistant resin fine particle is assumed to be spherical.

When the particle diameter of the high heat-resistant resin fine particle is 100 nm to 150 nm, the coverage is preferably 40% to 90%. When the particle diameter of the high heat-resistant resin fine particle is equal to or larger than 150 nm, the coverage is preferably 20% to 80%. When the particle diameter of the high heat-resistant resin fine particle is smaller than 100 nm, the coverage is preferably equal to or greater than 60%.

When setting such an "additional amount of the high heat-resistant resin fine particle" or "coverage", it is possible to make the values of $[T_{2nd}]-[T_{1st}]$, TP1, and TP2/TP1 within the range of the present invention.

In order for the $[T_{2nd}]-[T_{1st}]$ is adjusted to be 1.0° C. to 4.5° C., and the TP2/TP1 is adjusted to be 1.50 to 2.20, it is desirable to combine the compositions so that the binder resin and the high heat-resistant resin fine particle have appropriate affinity.

In the first measurement, the measurement is started in a state in which the binder resin and the high heat-resistant resin fine particle are in contact with each other without being melted and mixed. When the first measurement is completed, the binder resin and the high heat-resistant resin fine particle are melted and mixed with each other by heating therebetween. In the second measurement, the measurement is started in a state of being melted and mixed with each other. This difference appears in $[T_{2nd}]-[T_{1st}]$ and TP2 /TP1.

Therefore, it is desirable to adjust the affinity by selecting the kind of the resin contained in the high heat-resistant resin fine particle in accordance with the kind of the binder resin. The following specific numeric value is not limited, for example, it is possible to exemplify a method of making the composition different in such a manner that if the binder resin is a styrene acrylic resin, the resin contained in the high heat-resistant resin fine particle also becomes the styrene acrylic resin, in a case where the ratio of the styrene monomer to the acrylic monomer in the binder resin is, for example, 70:30, the ratio of the styrene monomer to the acrylic monomer in the resin contained in the high heat-resistant resin fine particle is set to 95:5; in terms of the number of hydrophilic monomers per 100 parts by mass of the other monomers, the resin contained in the high heat-resistant resin fine particle when the binder resin is 1 part is set 1.5 times; and a hybrid resin of the styrene acrylic resin and the polyester is used for any of the binder resin and the high heat-resistant resin fine particle.

It is possible to exemplify a method in such a manner that if the binder resin is the polyester, the resin contained in the high heat-resistant resin fine particle also becomes polyester, if the acid value of the binder resin is equal to or less than 3 mgKOH/g, the acid value of the resin contained in the high heat-resistant resin fine particle is 4 mgKOH/g to 20 mgKOH/g; and the binder resin does not have a hydroxyl group, and the resin contained in the high heat-resistant resin fine particle has a hydroxyl group.

There is no difference between $[T_{1st}]$ and $[T_{2nd}]$ when the resin contained in the binder resin and the high heat-resistant resin fine particle are the same or approximate, or the resin properties are the same or approximate. In addition, as the melting of the binder resin and the high heat-resistant resin fine particle progresses when the toner base particle is prepared, TP1 and TP2 are almost the same value.

The high heat-resistant resin fine particle contains a resin, and preferably contains wax. When the central portion (core) component also contains wax, the wax contained in the central (core) component and the wax contained in the high heat-resistant resin fine particle may be the same type, and is preferable to use different type. In addition, other charge control agents and the like may be contained.

By performing the setting to "difference in the kinds and properties between 'binder resin' and the 'resin contained in the high heat-resistant resin fine particle'" as described above, the values of $[T_{2nd}]-[T_{1st}]$, TP1, and TP2/TP1 can be set to be in the range of the present invention. The toner having the physical properties described in the section "2.4." imparts a toner excellent in the balance between the blocking resistance and the fixability at a low temperature by exerting the above various effects, and the toner having the physical properties described in items of the above "2.1." to "2.3.", and the toner having the physical properties described in an item of "2.4." are preferable from the aspect that the above effect is further achieved.

<More Preferable Toner Parameters>

2.5. Storage Modulus (G') in $[T_{1st}]$, and Combination of Tg and "BETN-BETF"

It is more preferable that the toner of the present invention further satisfies the following requirements.

That is, it is more preferable to employ a toner in which the glass transition temperature (Tg) measured by the differential scanning calorimeter (DSC) of the electrostatic charge image developing toner is 38.5° C. to 45.5° C., and when the BET specific surface area after the electrostatic charge image developing toner is subjected to the external additive releasing treatment is set as BETN, and the specific surface area measured by the flow-type particle image analyzer after the electrostatic charge image developing toner is subjected to the external additive releasing treatment is set as BETF, the BETN-BETF is 0.60 $m^2/g$ to 1.60 $m^2/g$.

In the case of the above toner, a storage modulus (G') at a tan δ maximum value temperature (that is, $[T_{1st}]$) in a first measurement measured in 40° C. to 80° C. by the rheometer is more preferably $1.10\times10^7$ Pa to $2.95\times10^7$ Pa, and TP2/TP1 is particularly preferably 1.30 to 2.36.

The Tg of the toner is preferably 38.5° C. to 45.5° C., is more preferably 39.0° C. to 45.0° C., and is particularly preferably 39.5° C. to 44.5° C. When the Tg is low, the fixability at a low temperature tends to be enhanced, and when the Tg is high, the blocking resistance tends to be enhanced.

The toner of the present invention contains "a central portion (core) component containing at least a binder resin and a colorant" and a high heat-resistant resin fine particle present in the vicinity thereof, and an external additive.

The shape of the high heat-resistant resin fine particle changes by the external addition or external addition operation. Accordingly, the surface structure of toner base particles after externally added is related to toner performance.

The BETN-BETF is preferably 0.60 $m^2/g$ to 1.60 $m^2/g$. A more preferable range, particularly preferable range, and the like are the same as the above-described ranges.

Figure 4:
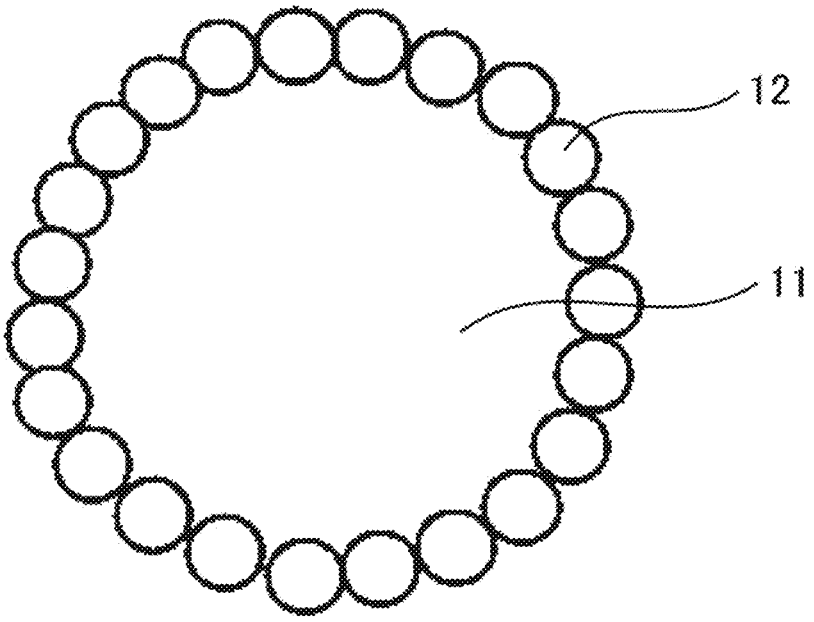
FIG. 4 is a schematic sectional view illustrating an example of a toner in a state where the amount of high heat-resistant resin fine particles present on the surface of the base particle is excessively large.

For example, in a case where the BETN-BETF is larger than 1.60 $m^2/g$, as illustrated in FIG. 4, it is presumed that the toner is in a state in which a high heat-resistant resin fine particle 12 cover the surrounding of the core component 11.

Figure 5:
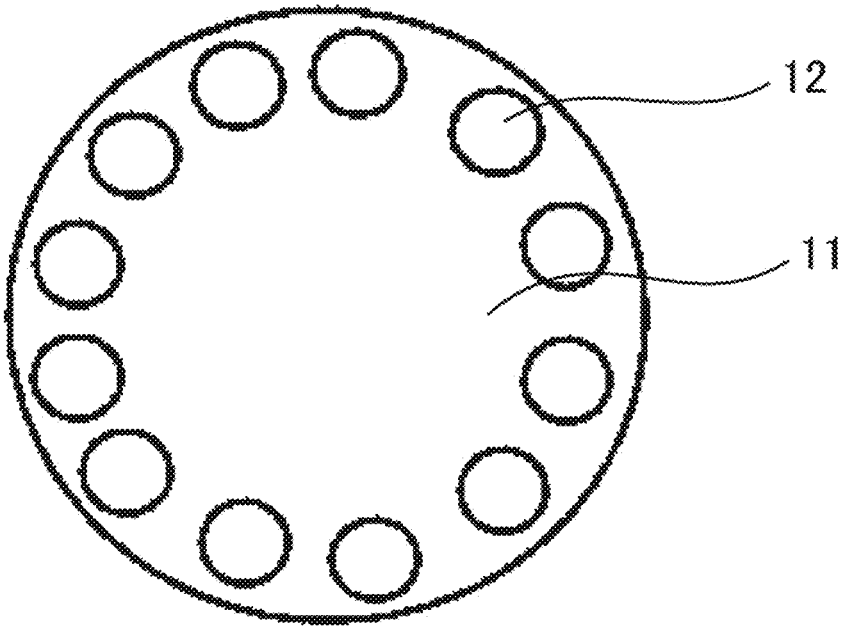
FIG. 5 is a schematic sectional view illustrating an example of a toner in a state where the amount of high heat-resistant resin fine particles present on the surface of the base particle is excessively small.
Figure 6:
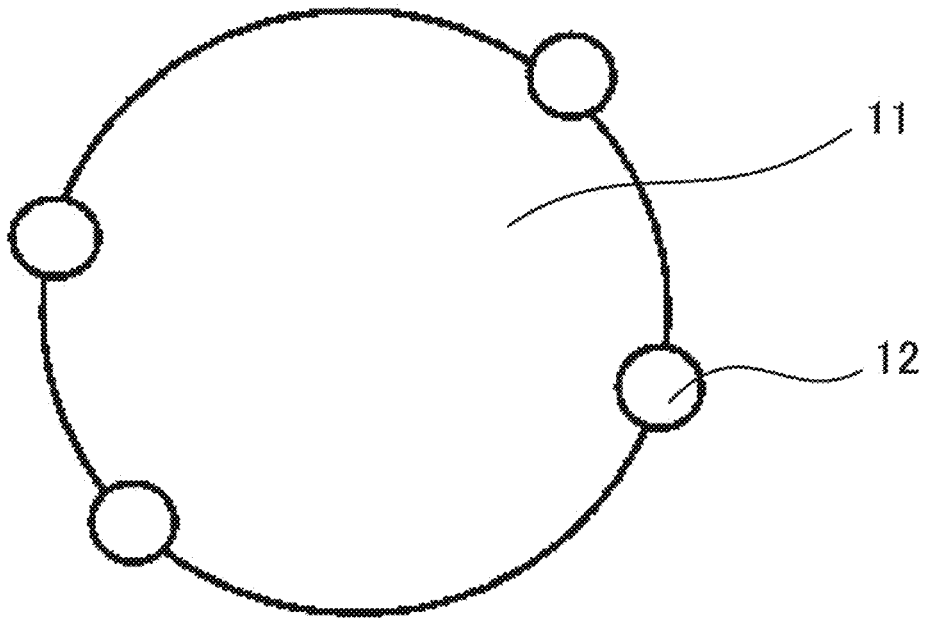
FIG. 6 is a schematic sectional view illustrating an example of a toner in another state where the amount of high heat-resistant resin fine particles present on the surface of the base particle is excessively small.

Further, for example, in a case where the value of BETN-BETF is less than 0.60 $m^2/g$, as illustrated in FIG. 5 and FIG. 6, it is presumed that the amount of the high heat-resistant resin particles 12 present on the surface of the core component 11 is small.

Accordingly, when the BETN-BETF is small, the fixability at a low temperature is enhanced, and when the BETN-BETF is large, the blocking resistance is enhanced.

G' at a tan δ maximum value temperature (that is, $[T_{1st}]$) in a first measurement measured in 40° C. to 80° C. by the rheometer represents the ratio of the convex portion formed from the high heat-resistant resin fine particle after external addition, and in a case where this numerical value is $1.10\times10^7$ Pa to $2.95\times10^7$ Pa, it is presumed to represent that the ratio of "the convex portion formed from the high heat-resistant resin fine particle" after external addition is appropriate.

That is, in a case where the numerical value is larger than $2.95\times10^7$ Pa, the ratio of "the convex portion formed from the high heat-resistant resin fine particle" after external addition is in a state of being excessively large, and when it is less than $1.10\times10^7$ Pa, the ratio of "the convex portion formed from the high heat-resistant resin fine particle" after external addition is in a state of being excessively small.

The lower limit of the G' at a tan δ maximum value temperature (that is, $[T_{1st}]$) in a first measurement measured in 40° C. to 80° C. by the rheometer is preferably equal to or greater than $1.10\times10^7$ Pa, is more preferably equal to or greater than $1.20\times10^7$ Pa, and is particularly preferably equal to or greater than $1.30\times10^7$ Pa.

Further, the upper limit is preferably equal to or lower than $2.95\times10^7$ Pa, is more preferably equal to or lower than $2.85\times10^7$ Pa, and is particularly preferably $2.75\times10^7$ Pa.

In the electrostatic charge image developing toner of the present invention, TP1 and TP2 are not the same value. This is considered to indicate that a change in the structure of the toner is caused by heating at the first measurement, and the reason for this is presumed as follows. This is considered to indicate that a change in the structure of the toner is caused by heating at the first measurement, and the reason for this is as described above, in other words, the reason for this is presumed as follows.

Since the measurement sample is prepared by molding the toner into a pellet without heating as much as possible, the difference in the composition between the inside and the surface of the toner is maintained as it is even after molding, and as a result, as illustrated in FIG. 1, the structure 1 formed of the high heat-resistant resin fine particle component and the external additive is formed as a whole. In the first measurement, a sample having this structure is measured.

In the second measurement, a sample in a state in which the inside, the high heat-resistant resin fine particle component, and the external additive are melted and mixed by heating at the first measurement, and the composition is averaged is measured.

In a case where TP2/TP1 is large, the high heat-resistant resin fine particle and the external additive are present, and in a case where TP2/TP1 is small, the ratio at which the high heat-resistant resin fine particle and the external additive form a structure, and as a result, the structure as illustrated in FIG. 1 is not formed.

In order to take a balance between the blocking resistance and the fixability at a low temperature, the value of TP2/TP1 is required to be an appropriate value, and is preferably in the above range. The toner which is within the scope is in a state in which the high heat-resistant resin fine particle component is slightly present in the vicinity of the surface of the toner base particle, and the external additive is externally added to the outside thereof, and thereby the above-described effect of the present invention is likely to be exhibited. The toner having the physical properties described in the section "2.5." imparts a toner excellent in the balance between the blocking resistance and the fixability at a low temperature by exerting the above various effects, and the toner having the physical properties described in items of the above "2.1." to "2.3.", and the toner having the physical properties described in an item of "2.5." are preferable from the aspect that the above effect is further achieved.

<More Preferable Toner Parameters>

2.6. $[G'_{1st}]$, $[G'_{2nd}]$, $[G'_{1st}]/[G'_{2nd}]$ MAX, and [Maximum Exothermic Peak Temperature Td]

It is more preferable that the toner of the present invention further satisfies the following requirements.

That is, it is more preferable to employ the toner in which the electrostatic charge image developing toner, in which a first measurement value if the storage modulus (G') measured by the rheometer is set as $[G'_{1st}]$, and a second measurement value is set as $[G'_{2nd}]$, a maximum value $[G'_{1st}]/[G'_{2nd}]$ MAX of $[G'_{1st}]/[G'_{2nd}]$ in 63.0° C. to 80.0° C. is in 1.40 to 10.0.

In the case of the toner, the toner having the TP2/TP1 of 1.45 to 2.36 is more preferable, and the toner having the [maximum exothermic peak temperature Td] of 50° C. to 75° C. when a maximum exothermic peak temperature at the time of temperature drop, measured by a differential scanning calorimeter (DSC), is set as [maximum exothermic peak temperature Td] is particularly preferable.

Regarding the rheometer measurement, the measurement was performed according to the method described in examples, and when the toner itself was measured by the measurement method described in the examples, as long as the toner has (indicates) the numerical values (parameters) range of the $[G'_{1st}]/[G'_{2nd}]$ MAX, it is included in the present invention.

Figure 7:
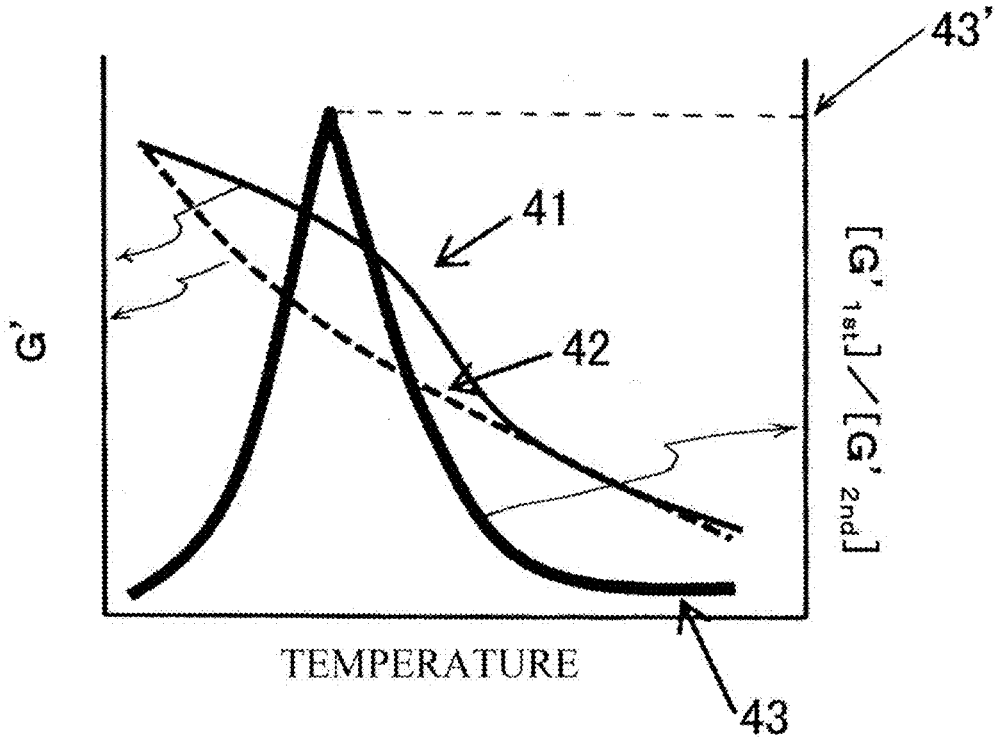
FIG. 7 is a schematic view illustrating a relationship of $[G'_{1st}]/[G'_{2nd}]$ between a first measurement value $[G'_{1st}]$ and a second measurement value $[G'_{2nd}]$ of storage modulus (G') measured by a rheometer.

In the present invention, $[G'_{1st}]/[G'_{2nd}]$ MAX is obtained as follows. Based on the G' raw data obtained by the first temperature rise measurement, G' in increments of 1° C. is calculated. In the second temperature rise measurement, G' is calculated in the same manner as described above. As illustrated in FIG. 7, on the basis of a graph 41 of $[G'_{1st}]$ and a graph 42 of $[G'_{2nd}]$, a graph 43 of $[G'_{1st}]/[G'_{2nd}]$ is obtained by dividing G' in increments of 1° C. in the first measurement by G' increments of 1° C. in the second measurement, the maximum value $[G'_{1st}]/[G'_{2nd}]$ MAX in a range of 63.0° C. to 80.0° C. is obtained from the graph 43 of $[G'_{1st}]/[G'_{2nd}]$ as indicated by reference numeral 43' of FIG. 7.

In the electrostatic charge image developing toner of the present invention, as illustrated in FIG. 7, $[G'_{1st}]$ and $[G'_{2nd}]$ are not the same value, and thus $[G'_{1st}]/[G'_{2nd}]$ MAX 43' is present. This is considered to indicate that a change in the structure of the toner is caused by heating at the first measurement, and the reason for this is presumed as follows.

Although, details will be described later, the toner of the present invention contains "a central portion (core) component containing at least a binder resin and a colorant" and a high heat-resistant resin fine particle present in the vicinity thereof, and an external additive. Since the measurement sample is prepared by molding the toner into a pellet without heating as much as possible, the difference in the composition between the inside and the surface of the toner is maintained as it is even after molding, and as a result, as illustrated in FIG. 1, the structure formed of the high heat-resistant resin fine particle component and the external additive is formed as a whole.

In the first measurement, a sample having this structure is measured. In the second measurement, a sample in a state in which the central portion (core) component, the high heat-resistant resin fine particle component, and the external additive are melted and mixed by heating at the first measurement, and the composition is averaged is measured.

It is presumed that the $[G'_{1st}]/[G'_{2nd}]$ MAX represents that a difference in the melting state between the inside of the core component and the high heat-resistant resin fine particle is the largest, and represents the affinity between the inside of the core component and the high heat-resistant resin fine particle.

In a case where the $[G'_{1st}]/[G'_{2nd}]$ MAX is larger than 10.0, the "structure formed of the high heat-resistant resin fine particle and the external additive" is clearly formed, that is, the affinity between the central portion (core) component and the high heat-resistant resin fine particle is low, and the amount of the high heat-resistant resin fine particle is excessively large, and thus the high heat-resistant resin fine particle is excessively present on the surface of the toner base particle.

On the other hand, in a case where the $[G'_{1st}]/[G'_{2nd}]$ MAX is less than 1.40, the structure is not formed, that is, the affinity between the inside of the core and the high heat-resistant resin fine particle is excellent, and thus the high heat-resistant resin fine particle is embedded into the inside of the core.

In order to take a balance between the blocking resistance and the fixability at a low temperature, the value of the $[G'_{1st}]/[G'_{2nd}]$ MAX is required to be an appropriate value, and is in the range of the present invention. The range is 1.40 to 10.0. It is presumed that the toner which is within the scope of the present invention in which the high heat-resistant resin fine particle is appropriately present in the vicinity of the toner base particle surface.

In the electrostatic charge image developing toner of the present invention, TP1 and TP2 are not the same value. This is considered to indicate that a change in the structure of the toner is caused by heating at the first measurement, and the reason for this is presumed as follows. This is considered to indicate that a change in the structure of the toner is caused by heating at the first measurement, and the reason for this is presumed as follows.

Since the measurement sample is prepared by molding the toner into a pellet without heating as much as possible, the difference in the composition between the inside and the surface of the toner is maintained as it is even after molding, and as a result, as illustrated in FIG. 1, the structure formed of the high heat-resistant resin fine particle component and the external additive is formed.

In the first measurement, a sample having this structure is measured. In the second measurement, a state in which the inside of the core component, the high heat-resistant resin fine particle component, and the external additive are melted and mixed by heating at the first measurement, and the composition is averaged is measured.

In a case where TP2/TP1 is large, the high heat-resistant resin fine particle and the external additive are large, and in a case where TP2/TP and as a result, it is presumed that the structure is not formed sufficiently.

In order to take a balance between the blocking resistance and the fixability at a low temperature, the value of TP2/TP1 is required to be an appropriate value, and is preferably in a range of 1.45 to 2.36. It is presumed that the toner which is within the scope of the present invention is in a state in which the high heat-resistant resin fine particle component is slightly present in the vicinity of the surface of the toner base particle, and the external additive is externally added to the outside thereof.

In the above-described toner, TP2/TP1 is preferably equal to or greater than 1.45, and is particularly preferably equal to or greater than 1.50. Further, it is preferably equal to or greater than 2.36.

The measurement of [maximum exothermic peak temperature Td] at the time of temperature drop is measured as follows.

The measurement of the [maximum exothermic peak temperature Td] at the time of temperature drop by a differential scanning calorimeter (DSC) is performed as follows by using Q20 manufactured by TA Instruments.

3±1 mg of toner is put into an aluminum pan and precisely weighed to a 0.1 mg digit, an aluminum pan filled with 3 mg of aluminum oxide is used as a reference, and the temperature is raised from 0° C. to 120° C. at a rate of 10° C./min in a nitrogen stream. After holding at 120° C. for 10 minutes, the temperature is cooled to 0° C. at 10° C./min, kept for five minutes, and then again raised to 120° C. at 10° C./min.

Figure 8:
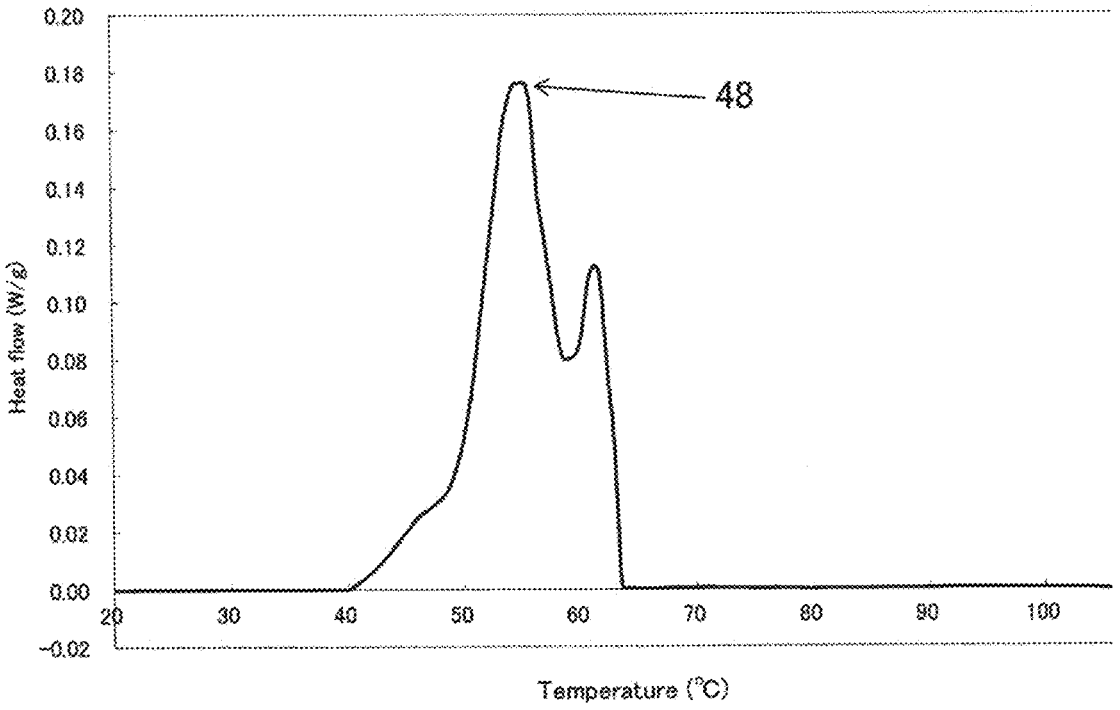
FIG. 8 is a schematic view illustrating [maximum exothermic peak temperature Td] at the time of temperature drop measured by a differential scanning calorimeter (DSC).

When a horizontal axis set as a temperature (° C.), and a vertical axis is set as heat flow (W/g), as illustrated in FIG. 8, the peak temperature having the highest height from the base line toward the heat generation side is defined as [maximum exothermic peak temperature Td] 48 at the time of the temperature drop.

In the above-described electrostatic charge image developing toner of the present invention, the [maximum exothermic peak temperature Td] measured by DSC is preferably 50° C. to 75° C.

This exothermic peak is expressed, for example, by wax in the toner, but in this case, the wax does not inhibit the fixability at a low temperature and is necessary to be promptly solidified after fixing. When the [maximum exothermic peak temperature Td] is large, for example, when the wax is present at equal to or higher than 50° C., the wax tends to be solidified after fixing, and thus problems such as adhesion between sheets after fixing do not easily occur. Conversely, when the [maximum exothermic peak temperature Td] is low, for example, when the wax is present at equal to or lower than 75° C., the wax is easy to dissolve during the fixing, and thus it contributes as a releasing agent and does not impair the fixability at a low temperature. In order to prevent deterioration of the fixability at a low temperature, for example, when Tg of the binder resin is increased, the blocking resistance is enhanced, and thus it is possible to realize both of the fixability at a low temperature and the blocking resistance.

From the viewpoint of adhesion between sheets after fixing and the fixability at a low temperature, the [maximum exothermic peak temperature Td] is preferably equal to or higher than 50° C., and is more preferably equal to or higher than 53° C., and is preferably equal to or lower than 75° C., and is more preferably equal to or lower than 72° C.

Further, when the peak temperature having the highest height from the baseline toward the endothermic side at the time of the second temperature rise by DSC measurement is set as [endothermic maximum peak $_{2nd}$], [endothermic maximum peak $_{2nd}$] is preferably 62° C. to 75° C. This endothermic peak is expressed by the wax in the toner, for example; however, in this case, the binder resin, the high heat-resistant resin fine particle, and the wax are necessary to have appropriate affinity. When the [endothermic maximum peak $_{2nd}$] is high, for example, in a case where the wax is present at equal to or higher than 62° C., it has low affinity, and in this case, the high heat-resistant resin fine particle is difficult to be embedded, so that the blocking resistance is enhanced. In order to prevent deterioration of the blocking resistance, for example, when Tg of the binder resin is decreased, the fixability at a low temperature is enhanced, and thus it is possible to realize both of the fixability at a low temperature and the blocking resistance. On the other hand, when the [endothermic maximum peak $_{2nd}$] is low, for example, in a case where the wax is present at equal to or lower than 75° C., it has high affinity, and in this case, the fixability at a low temperature is enhanced.

The toner having the physical properties described in the section "2.6." imparts a toner excellent in the balance between the blocking resistance and the fixability at a low temperature by exerting the above various effects, and the toner having the physical properties described in items of the above "2.1." to "2.3.", and the toner having the physical properties described in an item of "2.6." are preferable from the aspect that the above effect is further achieved.

2.7. Composition of Toner Base Particle 2.7.1. Core (Center Potion) Component

The toner base particle obtained by covering "a core component containing at least binder resin (for example, formed of a primary polymer particle) and a colorant" by the high heat-resistant resin fine particle.

The high heat-resistant resin fine particle may also contain a charge control agent and the like if necessary, and it is preferable that the wax is contained from the viewpoint of prevention of offset on a high temperature side, and furthermore, when this wax is contained in a state of being substantially enclosed by the high heat-resistant resin component, it is possible to solve the problem caused by wax release such as filming, which is more preferable.

In order to make the wax substantially enclosed by the high heat-resistant resin component, a method of polymerizing, precipitating, or aggregating the binder resin on the surface of the wax by the presence of wax particles in water and/or an organic solvent can be exemplified.

As the binder resin, any binder resin may be used as long as it is generally used as a binder resin in the preparing of the toner, and is not particularly limited, but examples thereof include a thermoplastic resin such as a polystyrene resin, a poly (meth) acrylic resin, a polyolefin resin, an epoxy resin, a polyester resin, and a mixture of these resins. Note that, "(meth)acryl" means "acrylic and/or methacrylic".

As a monomer component used for preparing the binder resin, the monomers used for generally preparing the binder resin of the toner can be appropriately used.

For example, it is also possible to use any polymerizable monomer among a polymerizable monomer having an acidic group (hereinafter, may be simply referred to as an acidic monomer), a polymerizable monomer having a basic group (hereinafter, may be simply referred to as a basic monomer), and a polymerizable monomer having neither an acidic group nor a basic group (hereinafter, may be simply referred to as other monomers).

In a case where a polystyrene copolymer resin and a poly (meth)acrylic resin are used as the binder resin, the following monomers are exemplified as examples. Herein after, a "styrene or (meth)acrylic monomer" is abbreviated simply as "monomer composition" in some cases.

Examples of the acidic monomer include a polymerizable monomer having a carboxyl group such as acrylic acid, methacrylic acid, maleic acid, fumaric acid, and cinnamic acid; a polymerizable monomer having sulfonic acid groups such as sulfonated styrene; and a polymerizable monomer a sulfonamide group such as vinyl benzene sulfonamide.

Examples of the basic monomer include an aromatic vinyl compound having an amino group such as aminostyrene; a polymerizable monomer having a nitrogen-containing heterocyclic ring such as vinyl pyridine and vinyl pyrrolidone; and (meth)acrylic ester having an amino group such as dimethyl aminoethyl acrylate and diethyl aminoethyl methacrylate.

These acidic monomer and basic monomer contribute to dispersion stabilization of the toner base particle. These may be used alone or a plurality kinds thereof may be used in combination, and it may be present as a salt with a counter ion.

Further, although it may be contained in one or both of the central portion (core) component and the high heat-resistant resin fine particle of the toner base particle, "a resin component formed of a binder resin and an acidic or basic monomer" constituting the core component and "a resin component formed of a binder resin and an acidic or basic monomer" constituting the high heat-resistant resin fine particle are preferably different from each other.

The high heat-resistant resin fine particle component and the core component are more compatible with each other to some extent at the second measurement than at the first measurement of tan δ, that is, the high heat-resistant resin fine particle component and the core component need to be formed at an exquisite balance in a state of being neither too close to nor too distant, and thus it is particularly important in the present invention from the aspect that the appropriate affinity therebetween is adjusted.

In addition, in a case of manufacturing the acid number (base number) depending on the additional amount of the acidic (or basic) monomer by attaching the high heat-resistant resin fine particle in water, it is preferable to increase the acid value (base number) of the high heat-resistant resin fine particle than the core (center) component of the toner base particle, and specifically, it is preferable to adjust the acid value (base number) of the high heat-resistant resin fine particle to be 1.1 times to 2.8 times the acid value (base number) of the core component. When the above multiple is excessively small, the high heat-resistant resin fine particle is buried in the core component, satisfactory blocking resistance cannot be obtained, and when the above multiple is excessively large, the high heat-resistant resin fine particle is excessively stable in water as compared to the core component, and thus is not attached in some cases.

Examples of other monomers include styrenes such as styrene, methyl styrene, chlorostyrene, dichlorostyrene, p-t-butyl styrene, p-n-butyl styrene, and p-n-nonylstyrene; acrylic acid esters such as methyl acrylate, ethyl acrylate, propyl acrylate, n-butyl acrylate, isobutyl acrylate, hydroxyethyl acrylate, and 2-ethyl hexyl acrylate; methacrylic esters such as methyl methacrylate, ethyl methacrylate, propyl methacrylate, n-butyl methacrylate, isobutyl methacrylate, hydroxyethyl methacrylate, and 2-ethyl hexyl methacrylate; and acrylamides such as acrylamide, N-propyl acrylamide, N,N-dimethyl acrylamide, N,N-dipropyl acrylamide, and N,N-dibutyl acrylamide. The "other monomes" may be used alone or a plurality of kinds thereof may be used in combination.

In a case where the binder resin is a crosslinkable resin, a polyfunctional monomer is used together with the above-described polymerizable monomers, and examples thereof include divinyl benzene, hexanediol diacrylate, ethylene glycol dimethacrylate, diethylene glycol dimethacrylate, triethylene glycol dimethacrylate, tetraethylene glycol dimethacrylate, hexaethylene glycol dimethacrylate, nonaethylene glycol dimethacrylate, diethylene glycol diacrylate, triethylene glycol diacrylate, neopentyl glycol dimethacrylate, neopentyl glycol diacrylate, and diallyl phthalate.

Among them, bifunctional polymerizable monomers are preferable, and divinyl benzene, hexanediol diacrylate and the like are particularly preferable. These multifunctional polymerizable monomers may be used alone or two or more kinds thereof may be used in combination.

It is also possible to use polymerizable monomers having a reactive group in a pendant group, such as glycidyl methacrylate, methylol acrylamide, acrolein, and the like.

Known chain transfer agents can be used as necessary. Specific examples of the chain transfer agent include t-dodecyl mercaptan, dodecane thiol, diisopropyl xanthogen, carbon tetrachloride, and trichlorobromomethane. The chain transfer agent may be used alone or two or more kinds thereof may be used in combination, and is preferably of 0% to 5% by mass based on the polymerizable monomer.

In a case where a polystyrene copolymer resin and a poly(meth)acrylic resin are used as a binder resin, the number average molecular weight in gel permeation chromatography (hereinafter, referred to as GPC) is preferably equal to or greater than 5000, is more preferably equal to or greater than 8000, and is still more preferably equal to or greater than 10,000, and is preferably equal to or less than 40,000, and is more preferably equal to or less than 30,000, and is still more preferably equal to or less than 20,000. The weight average molecular weight is preferably equal to or more than 30,000, and is more preferably equal to or more than 50,000, and is preferably equal to or less than 300,000, and is more preferably equal to or less than 250,000.

In a case of using a polyester resin as a binder resin, examples of divalent alcohol include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol; and a bisphenol A alkylene oxide adduct such as bisphenol A, hydrogenated bisphenol A, polyoxyethylenated bisphenol A, and polyoxypropylenated bisphenol A.

Examples of the divalent acid include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and anhydride of these acids, or lower alkyl ester; alkenyl succinic acids or alkyl succinic acids such as n-dodecenyl succinic acid and n-dodecyl succinic acid; and other divalent organic acids.

In a case where the binder resin is used as a crosslinkable resin, multifunctional monomers are used together with the polymerizable monomers described above, and examples of trivalent or more polyhydric alcohol include sorbitol, 1,2,3,6-hexane tetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylolethane, trimethylolpropane, 1,3,5-trihydroxymethyl benzene, and others.

Examples of the trivalent or more acid include 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,4-naphthalene tricarboxylic acid, 1,2,5-hexane tricarboxylic acid, 1,3-dicarboxyl-2-methyl-2-methylene carboxypropane, tetra(methylene carboxyl) methane, 1,2,7,8-octane tetracarboxylic acid, anhydrides of the acids, and others.

In addition, in a case of preparing the acid value of polyester resin by attaching the high heat-resistant resin fine particle in water, it is preferable to increase the acid value of the high heat-resistant resin fine particle than the core (center) component of the toner base particle, and specifically, it is preferable to adjust the acid value of the high heat-resistant resin fine particle to be 1.1 times to 2.8 times the acid value of the core component.

When the above multiple is excessively small, the high heat-resistant resin fine particle is buried in the core component, satisfactory blocking resistance cannot be obtained, and when the above multiple is excessively large, the high heat-resistant resin fine particle is excessively stable in water as compared to the core component, and thus is not attached in some cases.

These polyester resins can be synthesized by a general method. Specifically, conditions such as a reaction temperature (170° C. to 250° C.), a reaction pressure (5 mmHg to atmospheric pressure), and the like are determined according to the reactivity of the monomer, and the reaction may be completed when predetermined physical properties are obtained.

In a case where the number average molecular weight in GPC when the polyester resin is used as a binder resin is preferably 2,000 to 20,000, and is more preferably 3,000 to 12,000.

As an offset preventing agent, and in order to improve the fixability at a low temperature, waxes are preferably used.

As the waxes used in the toner of the present invention, any known wax can be used, and specific examples thereof include olefin wax such as low molecular weight polyethylene, low molecular weight polypropylene, and copolymer polyethylene; paraffin wax; ester wax having a long chain aliphatic group such as behenyl behenate, montanic acid ester, and stearyl stearate; plant wax such as hydrogenated castor oil and carnauba wax; ketone having a long-chain alkyl group such as distearyl ketone; silicone having an alkyl group; higher fatty acid such as stearic acid; a polyhydric alcohol ester of a long-chain fatty acid (pentaerythritol, trimethylolpropane, glycerin, or the like) or a partial ester thereof; and higher fatty acid amide such as oleic acid amide and stearic acid amide.

Preferable examples thereof include hydrocarbon wax such as paraffin wax and Fischer-Tropsch wax; ester wax; and silicone wax. Among them, ester wax is more preferable, monoester wax mainly containing a hydrocarbon having a carbon number of C18 and/or a carbon number of C22 is still more preferable, and wax mainly containing behenyl behenate, stearyl behenate, and behenyl stearate is most preferable. The above-described waxes may be used alone or may be used in combination.

A melting point peak of the wax (endothermic peak top at the second DSC temperature rise of the toner) is preferably equal to or lower than 90° C., is more preferably equal to or lower than 80° C., and is still more preferably equal to or lower than 75° C., and is preferably equal to or greater than 50° C., is more preferably equal to or greater than 60° C., and is still more preferably equal to or greater than 65° C. In a case where the melting peak temperature of the wax is high, the blocking resistance tends to be enhanced, and in a case where the melting peak of the wax is low, the fixability at a low temperature and the high glossiness tend to be enhanced.

In addition, a difference between the melting point peak of the wax and an onset temperature of the wax (an intersection temperature of the baseline before the endothermic peak in the second DSC of the toner, and a tangent at the first inflection point appearing before the endothermic peak) is preferably equal to or lower than 10° C., is more preferably equal to or lower than 8° C., and is still more preferably equal to or lower than 4° C.

Further, the onset temperature of the wax is preferably equal to or lower than 86° C., is more preferably equal to or lower than 76° C., and is still more preferably equal to or lower than 71° C., and is preferably equal to or higher than 46° C., is more preferably equal to or higher than 56° C., and is still more preferably equal to or higher than 61° C. In a case where the onset temperature is low, the fixability at a low temperature and the high glossiness tend to be enhanced, and in a case where the onset temperature is high, the blocking resistance tends to be enhanced.

The amount of the wax is preferably equal to or more than 1 part by mass, is more preferably equal to or more than 2 parts by mass, and is still more preferably equal to or more than 5 parts by mass, with respect to 100 parts by mass of the toner. In addition, the amount of the wax is preferably equal to or less than 35 parts by mass, is more preferably equal to or less than 30 parts by mass, and is still more preferably equal to or less than 25 parts by mass.

As a colorant, any known colorant can be used. Specific examples of the colorant include any known dye pigment such as carbon black, aniline blue, phthalocyanine blue, phthalocyanine green, hansa yellow, rhodamine dye pigment, chrome yellow, quinacridone, benzidine yellow, rose bengal, a triallyl methane dye pigment, a monoazo dye pigment, a disazo dye pigment, and a condensed azo dye pigment may be used alone or in combination.

In a case of full-color toner, a benzidine yellow dye pigment, a monoazo dye pigment, and a condensed azo dye pigment are preferably used as yellow; a quinacridone dye pigment and a monoazo dye pigment are preferably used as magenta; and a phthalocyanine dye pigment is preferably used as cyan.

The colorant is preferably used in an amount of 3 parts by mass to 20 parts by mass, with respect to 100 parts by mass of the toner.

As a charge control agent, any known charge control agent can be used. Specific examples of the charge control agent include a nigrosine dye, an amino group-containing vinyl copolymer, a quaternary ammonium salt compound, and a polyamine resin for positive charging; a metal-containing azo dye containing a metal such as chromium, zinc, iron, cobalt, and aluminum, a salt of salicylic acid or alkyl salicylic acid with the metal described above, and a metal complex for negative charging.

The amount of the charge control agent is preferably 0.1 to 25 parts by mass, and is more preferably 1 to 15 parts by mass, with respect to 100 parts by mass of the toner.

The charge control agent may be mixed into the toner base particle, or may be used in a state of being attached to the surface of the toner base particle.

2.7.2. Components of High Heat-Resistant Resin Fine Particle

The toner base particle is formed of the core component and the high heat-resistant resin fine particle that exists surrounding the core component. As other components if necessary, wax, a charge control agent, and the like may be contained in the core component and/or high heat-resistant resin fine particle.

As a type of the "high heat-resistant resin fine particle component" which is a component of the high heat-resistant resin fine particle, generally, the resin used as a binder resin at the time of preparing the toner can be exemplified.

The type of the resin is not particularly limited, but examples thereof include a thermoplastic resin such as a polystyrene resin, a poly (meth) acrylic resin, a polyolefin resin, an epoxy resin, a polyester resin, and a mixture of these resins.

2.8. Toner Formation

A lower limit of the volume average particle diameter of the toner of the present invention is preferably equal to or greater than 3 μm, and is more preferably equal to or greater than 5 μm. The upper limit is preferably equal to or lower than 8 μm, and is more preferably equal to or lower than 6 μm. A preferable range of the volume average particle diameter of the toner is 5 to 8 μm.

Further, from the viewpoint of image density, the average circularity of the shape measured by using a flow-type particle image analyzer FPIA-3000 is preferably equal to or greater than 0.92, is more preferably equal to greater than 0.95, and is still further preferably equal to or greater than 0.97, and from the viewpoint of the washing, it is preferably equal to or lower than 0.99. A preferable range of the average circularity of the toner is 0.95 to 0.99.

3. Preparing of Electrostatic Charge Image Developing Toner

The toner of the present invention may be prepared by any known method, and is not particularly limited.

3.1. Method of Preparing of Toner Base Particle 3.1.1. Method of Preparing Toner Base Particle by Aggregating Toner Base Particles Smaller than Toner Base Particle It is possible to use a method of obtaining a toner base particle by preparing each raw material as particles smaller than the toner base particle and mixing and aggregating the small particles.

3.1.1.1. Emulsion Polymerization

A method of obtaining a dispersion of the primary polymer particle by preparing the binder resin as a "primary polymer particle" smaller than the toner base particle, will be described below.

In addition, a method similar to this can also be used for preparing the high heat-resistant resin fine particle.

A polymer primary particle containing a styrene or (meth) acrylic monomer (monomer composition) as a constituent can be obtained by polymerizing the above-mentioned monomer composition and, if necessary, a chain transfer agent with an emulsifier, followed by emulsion polymerization.

Known emulsifiers can be used, but one or more emulsifiers selected from cationic surfactants, anionic surfactants, and nonionic surfactants can be used in combination.

Examples of the cationic surfactant include dodecyl ammonium chloride, dodecyl ammonium bromide, dodecyl trimethyl ammonium bromide, dodecyl pyridinium chloride, dodecyl pyridinium bromide, and hexadecyl trimethyl ammonium bromide.

Examples of the anionic surfactant include fatty acid soap such as sodium stearate and sodium dodecanoate, sodium dodecyl sulfate, sodium dodecylbenzene sulfonate, and sodium lauryl sulfate.

Examples of the nonionic surfactant include polyoxyethylene dodecyl ether, polyoxyethylene hexadecyl ether, polyoxyethylene nonyl phenyl ether, polyoxyethylene lauryl ether, polyoxyethylene sorbitan monooleate ether, and monodecanoyl sucrose.

The use amount of the emulsifier is preferably 0.1 parts by mass to 10 parts by mass with respect to 100 parts by mass of the polymerizable monomer. When the use amount of the emulsifier is increased, the particle diameter of the obtained polymer primary particle becomes smaller, and when the use amount of the emulsifier is reduced, the particle diameter of the obtained polymer primary particle becomes larger. In addition, one or two or more kinds of polyvinyl alcohols such as partially or completely saponified polyvinyl alcohol, cellulose derivatives such as hydroxyethyl cellulose, and the like can be used as a protective colloid in combination with these emulsifiers.

If necessary, known polymerization initiators may be used alone or two or more kinds thereof may be used in combination. For example, a redox initiator combining persulfates such as potassium persulfate, sodium persulfate, and ammonium persulfate, and these persulfates as a component with a reducing agent such as acidic sodium sulfite; a soluble polymerization initiator such as hydrogen peroxide, 4,4'-azobiscyanovaleric acid, t-butyl hydroperoxide, cumene hydroperoxide; and a redox initiator combining these water-soluble polymerization initiators as a component with a reducing agent such as a ferrous salt, benzoyl peroxide, and 2,2'-azobis-isobutyronitrile can be used. These polymerization initiators may be added to the polymerization system before, simultaneously with, or after the addition of the polymerizable monomer, and these addition methods may be combined if necessary.

In order to disperse the wax in a suitable dispersed particle diameter in the toner, it is preferable to use so-called seed polymerization in which wax is added as a seed during the emulsion polymerization. By adding as a seed, the wax is finely and uniformly dispersed in the toner, so that deterioration of the chargeability and heat resistance of the toner can be suppressed.

Also, a wax/long chain polymerizable monomer dispersion obtained by dispersing a wax with a long chain polymerizable monomer such as stearyl acrylate in advance in an aqueous dispersion medium is prepared, and the polymerizable monomer can also be polymerized in presence of the wax/long chain polymerizable monomer.

It is also possible to emulsion polymerize using a colorant as a seed, but when a polymerizable monomer is polymerized in the presence of the colorant, the metal in the colorant affects the radical polymerization, the control of the molecular weight and rheology of the resin is difficult, and desired physical properties cannot be obtained, and thereby a method of adding the colorant dispersion in the subsequent step without adding the colorant at the time of emulsion polymerization.

3.1.1.2. Method of Emulsifying Resin

The polymer primary particle is obtained by obtaining a resin by methods such as a bulk polymerization method, a solution polymerization method, a suspension polymerization method, and an emulsion polymerization method, then mixing with an aqueous medium, heating to a temperature higher than either the melting point of the resin or the glass transition temperature to a temperature, and lowering the viscosity of the resin, and applying a shearing force to perform emulsification.

As an emulsifier for giving a shearing force, for example, a homogenizer, a homomixer, a pressure kneader, an extruder, a media disperser and the like can be mentioned.

In the case where the viscosity of the resin at the time of emulsification is high and it is not reduced to a desired particle diameter, having a desired particle diameter can be obtained by raising the temperature using an emulsifying device capable of pressurizing to atmospheric pressure or higher and emulsifying it while lowering the resin viscosity.

As another method, a method of lowering the viscosity of the resin by previously mixing an organic solvent into the resin may be used. The organic solvent to be used is not particularly limited as long as it dissolves the resin, ketone solvents such as tetrahydrofuran (THF), methyl acetate, ethyl acetate, methyl ethyl ketone, and the like, and benzene solvents such as benzene, toluene, xylene, and the like can be used. Further, for the purpose of improving the affinity with an aqueous medium and controlling the particle size distribution, an alcohol solvent such as ethanol or isopropyl alcohol may be added to water or a resin. In a case where an organic solvent is added, it is necessary to remove the organic solvent from the emulsion after completion of emulsification. As a method for removing the organic solvent, there is a method of volatilizing the organic solvent while reducing the pressure at normal temperature or under heating.

For the purpose of controlling the particle size distribution, salts such as sodium chloride and potassium chloride, ammonia, and the like may be added.

For the purpose of controlling the particle size distribution, an emulsifier or a dispersant may be added. Examples thereof include a soluble polymer such as polyvinyl alcohol, methyl cellulose, carboxymethyl cellulose, and sodium polyacrylate; the above-mentioned emulsifier; an inorganic compound such as tricalcium phosphate, aluminum hydroxide, calcium sulfate, calcium carbonate, and barium carbonate. The use amount is preferably 0.01 to 20 parts by mass with respect to 100 parts by mass of the resin.

When a resin containing an acidic group or a basic group is used, it is possible to reduce the amount of the emulsifier or dispersant to be added, but the hygroscopic property of the resin is increased and the chargeability may be deteriorated in some cases.

A phase inversion emulsification method may also be used. In the phase inversion emulsification method, an organic solvent, a neutralizing agent, and a dispersion stabilizer are added to a resin, as necessary, and an aqueous medium is added dropwise under stirring to obtain emulsified particles, and then the organic solvent in the resin dispersion is removed so as to obtain an emulsion. As the organic solvent, the same organic solvents as those described above can be used. As the neutralizing agent, common acids such as nitric acid, hydrochloric acid, sodium hydroxide, ammonia, and alkalis can be used.

3.1.1.3. Formation of Toner Base Particle by Aggregating/Aging

In any of the above preparation methods of emulsion polymerization and resin emulsification, the volume average particle diameter of the obtained polymer primary particle is generally equal to or larger than 0.02 μm, is preferably equal to or larger than 0.05 μm, and is particularly preferably equal to or larger than 0.1 μm, and is generally equal to or smaller than 3 μm, is preferably equal to or smaller than 2 μm, and is particularly preferably equal to or smaller than 1 μm.

When the volume average particle diameter of the polymer primary particle is smaller than the above range, it may be difficult to control the aggregation rate in the aggregation step. On the other hand, when the volume average particle diameter of the polymer primary particle is larger than the above range, the particle diameter of the toner base particle obtained by aggregation tends to be large and it may be difficult to obtain the toner base particle having a target particle diameter in some cases.

In the aggregation step, the above-mentioned polymer primary particle, the colorant particle, and optional components such as a charge control agent and wax are mixed simultaneously or sequentially. A dispersion of each component, that is, a polymer primary particle dispersion, a colorant particle dispersion, if necessary a charge control agent dispersion, and a wax fine particle dispersion are prepared in advance, it is preferable to mix these to obtain a mixed dispersion from the viewpoint of uniformity of composition and uniformity of particle diameter.

The colorant is preferably used in a state of being dispersed in water in the presence of the emulsifier. The volume average particle diameter of the colorant particle is preferably equal to or larger than 0.01 μm, and is particularly preferably equal to or larger than 0.05 μm, and is preferably equal to or smaller than 3 μm, and is particularly preferably equal to or smaller than 1 μm.

In the aggregation step, aggregation is generally performed in a tank provided with a stirring device, but there are a heating method, an electrolyte addition method, and a combination thereof.

In a case of aggregating polymer primary particles under agitation so as to obtain particle agglomerates of a desired size, the particle diameter of the particle agglomerate is controlled from the balance between the cohesive force between the particles and the shear force by stirring, but it is possible to increase the cohesive force by heating or by adding an electrolyte.

As an electrolyte in a case of performing the aggregation by adding an electrolyte, any of acid, alkali and salt may be used, and either organic or inorganic type may be used, and specifically, examples of the acid include hydrochloric acid, nitric acid, sulfuric acid, and citric acid; examples of the alkali include sodium hydroxide, potassium hydroxide, aqueous ammonia; and examples of the salt include NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, and $C_6H_5SO_3Na$.

Among them, an inorganic salt having a polyvalent metal cation having two or more valences is preferable.

The additional amount of the electrolyte varies depending on the kind of the electrolyte, the desired particle diameter, and the like, but is preferably equal to or greater than 0.02 parts by mass, and is more preferably equal to or greater than 0.05 parts by mass with respect to 100 parts by mass of the solid component of the mixed dispersion. In addition, it is preferably equal to or less than 25 parts by mass, is more preferably equal to or less than 15 parts by mass, and is particularly preferably equal to or less than 10 parts by mass.

When the additional amount is excessively small, the progress of aggregation slows down, fine powder of equal to or less than 1 μm remains even after aggregation, and problems in that the average particle diameter of the obtained particle agglomerate does not reach the target particle diameter, and the like may occur. On the other hand, when the additional amount is excessively large, it tends to be rapidly aggregated and it becomes difficult to control the particle diameter, and the obtained aggregated particles may contain coarse or irregular powders in some cases.

The aggregation temperature in the case where aggregation was performed by adding the electrolyte is preferably equal to or high than 20° C., and is particularly preferably equal to or high than 30° C., and is preferably equal to or lower than 70° C., and is particularly preferably equal to or lower than 60° C.

The time required for aggregation is optimized depending on the shape of the apparatus and the processing scale, but in order for the particle diameter of the toner base particle to reach the target particle diameter, it is preferable to hold at least 30 minutes at the above-described predetermined temperature. Temperature rise until reaching a predetermined temperature may be raised at a constant rate or may be increased stepwise.

The high heat-resistant resin fine particle may be added at any timing, may be charged with the raw material of the core component (for example, a primary polymer particle, a pigment, and wax) at the same time, or may be added after a part or all of the raw materials of the core components are aggregated.

In a case where the core component and the high heat-resistant resin fine particle are charged at the same time, if the polarity of the high heat-resistant fine particle is thermodynamically designed so as to have an intermediate polarity between the core component and the medium (for example, water), the high heat-resistant resin fine particle is spontaneously attached to the surroundings of the core component.

In a case of attaching high heat-resistant resin fine particle in water and/or a wet medium such as an organic solvent, after the composition of the raw material of the core component is determined (after part or all of the core components are aggregated in the case of aggregating particles smaller than the toner base particles to prepare a toner base particle), the high heat-resistant resin fine particle is more preferably added from the viewpoint that the high heat-resistant fine particles can be arranged on the surface of the core component.

As the composition and preparation method of the high heat-resistant resin fine particles, those mentioned above can be mentioned. The addition may be performed once or plural times. The first high heat-resistant resin fine particles and the next and subsequent high heat-resistant resin fine particles may be different or in any combination.

In order to increase the stability of the particle agglomerate obtained in the aggregation step, it is preferable to perform fusion within the aggregated particles in the aging step after the aggregation step.

The temperature in the aging step is preferably equal to or higher than Tg of the primary polymer particle, and is more preferably 5° C. higher than Tg of the primary polymer particle, and is preferably lower than Tg of the high heat-resistant resin fine particle, and is more preferably 5° C. lower than Tg of the high heat-resistant resin fine particle.

The time required for the aging step varies depending on the shape of the toner base particle, but is preferably 0.1 to 10 hours and is particularly preferably 0.5 to five hours after reaching Tg of the primary polymer particle after the temperature reaches equal to or greater than Tg of the primary polymer particle.

After the aggregation step, it is preferable that the surfactant is added, pH is adjusted, or both operations are performed together before the aging step or during the aging step.

As the surfactant used here, it is possible to use one or more kinds selected from the emulsifier which can be used in the preparing of the primary polymer particle, and particularly it is preferable to use the same one as the emulsifier used in the preparing of the primary polymer particle.

The additional amount in the case of adding the surfactant is not limited, and is preferably equal to or greater than 0.1 parts by mass, and is more preferably equal to or greater than 0.3 parts by mass, and is preferably equal to or less than 20 parts by mass, is more preferably equal to or less than 15 parts by mass, and is still more preferably equal to or less than 10 parts by mass, with respect to 100 parts by mass of the solid component of the mixed dispersion.

By adding a surfactant or adjusting the pH after the aggregation step or before completion of the aging step, it is possible to suppress the aggregation of the particle agglomerate or the like obtained in the aggregation step, and coarse particle generation after the aging step may be suppressed in some cases.

By controlling the time for the aging step, it is possible to prepare a toner base particle having various shapes depending on the purpose, such as a grape type in which the polymer primary particles are aggregated, a potato type in which fusion has advanced, and a spherical shape in which fusion has further progressed.

3.1.2. Method of Preparing Particle Having Toner Base Particle Size

It is possible to use a method of obtaining the toner base particle by mixing the respective raw materials, finely pulverizing the mixture to the size of the toner base particle, and adding the high heat-resistant resin fine particle before and after finely pulverizing the mixture.

3.1.2.1. Method of Preparing Toner Base Particle by Suspension Polymerization

A colorant, a polymerization initiator, and, if necessary, wax, a polar resin, a charge control agent, a crosslinking agent, and the like are added to the "styrene or (meth)acrylic monomer" (monomer composition) which is the same as the above-described monomer composition so as to prepare a monomer composition which is uniformly dissolved or dispersed.

If necessary, this monomer composition is dispersed in an aqueous medium containing a suspension stabilizer or the like. The particles are granulated by adjusting the stirring speed and time so that droplets of the monomer composition have a desired size of the toner base particle. Thereafter, the stirring is performed to such an extent that the particle state is maintained by the action of the dispersion stabilizer and precipitation of the particles is prevented, and polymerization is performed, and thereby the toner base particle can be obtained.

Specific examples of the suspension stabilizer include calcium phosphate, magnesium phosphate, calcium hydroxide, and magnesium hydroxide. These may be used alone or two or more kinds thereof may be used in combination, and the amount thereof is preferably 1 part by mass to 10 parts by mass with respect to 100 parts by mass of the polymerizable monomer. These suspension stabilizers may be added to the polymerization system before, simultaneously with, or after the addition of the polymerizable monomer, and these addition methods may be combined if necessary.

In a case where the polar resin is contained in the monomer composition, the polar resin tends to be transferred to the vicinity of the droplet surface after forming the droplet by dispersing the monomer composition in the aqueous medium. When the polymerization is performed in this state, the toner base particle having different compositions on the inside and on the surface can be obtained. For example, when a polar resin having Tg higher than Tg after polymerization of the monomer is selected, a structure in which the Tg is low in the inside of the toner base particle and the resin having high Tg is present on the surface at a high ratio can be obtained. In the present invention, the blocking resistance is enhanced by coating the shell particles. Here, when this method is used in combination, excellent blocking resistance is more easily obtained.

The high heat-resistant resin fine particle may be added at any timing, for example, the polarity of the high heat-resistant resin fine particles can be designed by dissolving the high heat-resistant resin fine particle in the monomer composition and thereafter, dispersing the high heat-resistant resin fine particle in the aqueous medium such that the high heat-resistant resin fine particles comes to the interface between the core component and water.

Further, the high heat-resistant resin fine particle may be added after the monomer composition of the core component is dispersed, or the high heat-resistant resin fine particles may be added after the monomer composition of the core component is dispersed and partially or almost all of the polymerizable monomers of the core component are polymerized.

From the viewpoint of disposing the high heat-resistant fine particles on the surface of the core component, it is preferable to add the high heat-resistant resin fine particle after polymerizing a part of the polymerizable monomer, and it is more preferable to add the high heat-resistant resin fine particles after substantially all of the polymerizable monomers are polymerized.

As the composition and preparation method of the high heat-resistant resin fine particles, those mentioned above can be mentioned. The addition may be performed once or plural times. The first high heat-resistant resin fine particles and the next and subsequent high heat-resistant resin fine particles may be different or in any combination.

Besides, a pH adjusting agent, a polymerization degree adjusting agent, a defoaming agent, and the like can be appropriately added to the reaction system.

3.1.2.2. Method of Preparing Toner Base Particles by Dissolution Suspension

An oily dispersion in which at least a binder resin and a colorant, if necessary, wax, a charge control agent, and the like are dissolved or dispersed in an organic solvent is prepared and dispersed in an aqueous medium. Thereafter, the toner base particle can be obtained by removing the organic solvent from the dispersion. The high heat-resistant resin fine particle may be added in advance to the oily dispersion, or may be added after being dispersed in the aqueous medium, or may be added after removing the organic solvent.

As the composition and preparation method of the high heat-resistant resin fine particles, those mentioned above can be mentioned. The addition of the high heat-resistant resin fine particle may be performed once or plural times. The first high heat-resistant resin fine particles and the next and subsequent high heat-resistant resin fine particles may be different or in any combination.

As the aqueous medium, water may be used alone, and a solvent miscible with water can be used in combination.

As necessary, a dispersant can be used. It is preferable to use a dispersant from the aspect that the particle size distribution becomes sharp and dispersion is stabilized. As the dispersant, the same emulsifiers as used in the above-described emulsion polymerization can be used. Further, various types of hydrophilic polymeric substances that form polymeric protective colloids in aqueous medium can be present.

In addition, it is possible to use inorganic fine particles and/or polymer fine particles.

As the inorganic fine particles, various known inorganic compounds which are insoluble or hardly soluble in water are used. Examples of such materials include tricalcium phosphate, calcium carbonate, titanium oxide, colloidal silica, and hydroxyapatite.

Here, the polymer fine particle may be regarded as the high heat-resistant resin fine particle.

In the case of dispersing the oily dispersion in the aqueous medium, a known dispersing machine such as a low speed shearing type, a high speed shearing type, a friction type, a high pressure jet type, and an ultrasonic wave can be applied as a dispersion apparatus.

Instead of the binder resin, a prepolymer having a reactive group may be used so as to prepare the oily dispersion, and the oily dispersion is dispersed in the aqueous medium, followed by reacting the reactive group to elongate the resin. In this method, since the prepolymer has a relatively low molecular weight, the viscosity of the oily dispersion is difficult to be increased and the dispersion is easily dispersed in the aqueous medium.

In order to facilitate uniform dispersion of the colorant in the oily dispersion liquid, the colorant may be prepared as a master batch in which the colorant is complexed with the resin in advance, and this may be dispersed in an organic solvent.

As a method for removing the organic solvent, there is a method of volatilizing the organic solvent while reducing the pressure at normal temperature or under heating.

When a resin having high polarity and a resin having low polarity are used in combination as a binder resin, droplets are formed by dispersing the monomer composition in the aqueous medium, and then the resin having high polarity is formed in the vicinity of the droplet surface, and the resin having low polarity moves to the vicinity of the center of the droplet. When the organic solvent is removed thereafter, the toner base particle having different compositions on the inside and on the surface can be obtained.

In a case of preparing the oily dispersion with the prepolymer capable of reacting with an active hydrogen group-containing compound, after dispersing the oily dispersion in the aqueous medium, the active hydrogen group-containing compound is added, elongating reaction or crosslinking reaction is performed on both of the oily dispersion and the active hydrogen group-containing compound from the droplet surface in the aqueous medium, and thereby an elongated or crosslinked resin is preferentially formed on the droplet surface. When the organic solvent is removed thereafter, the toner base particle having different compositions on the inside and on the surface can be obtained.

By selecting the raw materials in consideration of Tg by these methods, a structure having a higher ratio of the resin having a higher Tg on the surface than the inside of the toner base particle can be obtained.

In addition, when the polymer fine particle using for the dispersant is regarded as the high heat-resistant resin fine particle, and the physical properties of the high heat-resistant resin fine particle are adjusted, a structure in which the high heat-resistant resin fine particle (polymer fine particle) is present on the surface of the toner base particle.

3.1.3. Washing and Drying of Toner Base Particle

The toner base particles prepared in the above-descried "method of preparing toner base particle by aggregating toner base particles smaller than toner base particle", "method of preparing toner base particle by suspension polymerization", and "method of preparing toner base particles by dissolution suspension" are separated from the aqueous solvent, washed, dried, and subjected to an externally addition treatment so as to prepare an electrostatic charge image developing toner.

As the liquid used for washing, water is used, but it can also be washed with an aqueous solution of acid or alkali. Also, the washing can be performed with warm water or hot water, and these methods can be used in combination. Through such a washing step, it is possible to reduce and remove the suspension stabilizer, the emulsifier, the unreacted monomer, and the like.

In the washing step, it is preferable to repeat an operation of dispersing the toner base particle by forming the toner base particle into a rich slurry or a wet cake shape through, for example, filtration and decantation, and adding a liquid for new washing to the rich slurry or wet cake shaped toner base particle. It is preferable to recover the washed toner base particles in a wet cake form in terms of handling in a subsequent drying step.

In the drying step, a fluidized drying method such as a vibration type flow drying method or a circulation type fluidized drying method, an air stream drying method, a vacuum drying method, a freeze drying method, a spray drying method, a flash jet method, or the like is used. Operating conditions such as the temperature, air volume, and degree of pressure reduction in the drying step are optimized as appropriate based on Tg of the colored particles, a shape, a mechanism, and a size, of an apparatus to be used.

3.1.4. Method of Preparing Toner Base Particle by Melt-Kneading Pulverization Method The melt-kneading pulverization method means a method of obtaining the toner base particle by drying and mixing if necessary a charge control agent, a release agent, a magnetic material, and the like in the binder resin and the colorant, then melt-kneading the mixture with an extruder or the like, and pulverizing and classifying the resultant, in which in the external addition step, after obtaining the toner base particle, the high heat-resistant resin fine particle may be added to attached on the surface of the core component.

3.1.5. Addition Timing of High Heat-Resistant Resin Fine Particle

In the case of preparing toner base particle in a wet medium (in water and/or in the organic solvent), as described above, the high heat-resistant resin fine particle may be thermodynamically disposed on the surface of the core component and the wet medium by adding (it may be in any state of dissolution, dispersion, and suspension) the high heat-resistant resin fine particle (or simply a resin) together with the core component, or after determining the composition and/or shape of the core component, the high heat-resistant resin fine particle may be added such that the high heat-resistant resin fine particles are physically cover the surface of the core component in a continuous and/or discontinuous manner.

Further, in the case of preparing the toner base particle in the wet medium (in water and/or the organic solvent), the high heat-resistant resin fine particle may be added before and after the washing step, or the drying step. In addition, the high heat-resistant resin fine particle may be added in the external addition step, and in the case where the high heat-resistant resin fine particle is attached in the external addition step, a method of adding the external additive after adding and fixing the high heat-resistant resin fine particle is preferable.

In the melt-kneading pulverization method in which the toner base particle is prepared by the drying method, it is preferable to attach the high heat-resistant resin fine particle by adding the high heat-resistant resin fine particle before and after the external addition step after pulverizing and classifying.

From the viewpoint of more firmly fixing the core component and the high heat-resistant resin fine particle, it is particularly preferable to add the high heat-resistant resin fine particle in water and/or the organic solvent.

3.2. Preparing of Toner Satisfying Parameters of Present Invention 3.2.1. Regarding "TP2/TP1"

In order to make TP2/TP1 measured by a rheometer satisfy in a range of 1.47 to 2.35, it is necessary that a high heat-resistant resin fine particle component is widely present on the surface of the toner base particle such that the outside is covered with the external additive, thereby adjusting the particle diameter and the amount of the high heat-resistant resin fine particle, and in a case of being attached in water, the polar balance between the core component and the high heat-resistant resin fine particle is adjusted and then the composition ratio of the whole toner base particles is further adjusted.

The volume median diameter of the high heat-resistant resin fine particle ($Dv_{50}$) is preferably equal to or larger than 50 nm, and is more preferably equal to or larger than 70 nm, and is preferably equal to or smaller than 300 nm, and is more preferably equal to or smaller than 250 nm. The "volume median diameter ($Dv_{50}$)" in the present invention is measured by the method described in examples depending on the size thereof, and is defined as measured as such.

When the particle diameter of the high heat-resistant resin fine particle is equal to or larger than 100 nm, it is preferable to widen the high heat-resistant resin fine particle by impact with an external addition operation and thinly spread the high heat-resistant resin fine particle component on the surface of the toner base particle. When the high heat-resistant resin fine particle having a particle diameter of equal to or larger than 100 nm is widened by the impact with the external addition operation, a toner having the BETN-BETF of 0.54 $m^2/g$ to 1.56 $m^2/g$ can be obtained, and thus the BETN-BETF is easy to fall within the scope of the invention.

On the other hand, when the particle diameter of the high heat-resistant resin fine particle is smaller than 100 nm, a change in which the high heat-resistant resin fine particle is widened by the impact with the external addition operation is less likely to occur, and thus it is preferable to set a toner satisfying the parameter of the present invention by widely covering the base surface with increased additional amount.

The additional amount of the high heat-resistant resin fine particle is preferably determined based on the coverage. The aforementioned amount can be calculated from the ratio of a surface area obtained from the target particle diameter when toner base particles are assumed to be spherical to a projected area obtained from the average particle diameter when the high heat-resistant resin fine particle is assumed to be spherical.

When the particle diameter of the high heat-resistant resin fine particle is equal to or larger than 100 nm, the coverage is preferably 25% to 85%, is more preferably 35% to 70%, and is particularly preferably 40% to 60%.

When the particle diameter of the high heat-resistant resin fine particle is smaller than 100 nm, the coverage is preferably 55% to 120%, is more preferably 65% to 105%, and is particularly preferably 70% to 95%.

The high heat-resistant resin fine particle component is desired to be disposed in the vicinity of the surface at the time of the toner formation. The shape thereof may be particulate, spherical, or thin film as long as it does not deviate from the present invention.

In order for TP2/TP1 measured by the rheometer to be adjusted in a range of 1.47 to 2.35, it is desirable to combine the compositions so that the binder resin and the high heat-resistant resin fine particle have appropriate compatibility.

In the first measurement, the measurement is started in a state in which the binder resin and the high heat-resistant resin fine particle are in contact with each other without being melted. When the first measurement is completed, the binder resin and the high heat-resistant resin fine particle are melted with each other by heating therebetween. Therefore, in the second measurement, the measurement is started in a state of being melted with each other. This difference appears in the difference between TP2/TP1.

Therefore, it is desirable to adjust the compatibility by selecting the kind of the resin contained in the high heat-resistant resin fine particle in accordance with the kind of the binder resin. Hereinafter, the adjusting method will be exemplified, but the numerical values given in the examples are not limited.

That is, it is possible to exemplify a method of making the composition different in such a manner that if the binder resin is a styrene acrylic resin, the resin contained in the high heat-resistant resin fine particle also becomes the styrene acrylic resin, in a case where the ratio of the styrene monomer to the acrylic monomer in the binder resin is, for example, 70:30, the ratio of the styrene monomer to the acrylic monomer in the resin contained in the high heat-resistant resin fine particle is set to 95:5; in terms of the number of hydrophilic monomers per 100 parts by mass of the other monomers, the resin contained in the high heat-resistant resin when the binder resin is 1 part is set 1.5 times; and a hybrid resin of the styrene acrylic resin and the polyester is used for any of the binder resin and the high heat-resistant resin fine particle.

From the aspect that appropriate compatibility between the core component and the high heat-resistant resin fine particle component can be obtained, a difference between the solubility parameter (SP value) and a SP value of the high heat-resistant resin fine particle component of the binder resin is preferably of 0.5 to 1.0, and is more preferably of 0.6 to 0.8.

From the viewpoint of increasing the adhesive strength and decreasing member contamination, it is preferable that a shading difference between the core component and the high heat-resistant resin fine particle component as measured using a transmission electron microscope is not clear, and it is more preferable that there is no shading difference. The measurement conditions of the transmission electron microscope are measured as described in examples, and the "shading difference" is taken as a "shading difference" when the picture obtained by such a measurement is viewed with the naked eye. Here, the phrase "there is no shading difference" means that there is no difference between the degree of dyeing (degree of black and white) of the core component and the high heat-resistant resin fine particle component, and an edge of the high heat-resistant resin fine particle component (that is, a boundary between the core component and the high heat-resistant resin fine particle component) cannot be seen.

However, the above phrase "there is no shading difference" does not exclude an embodiment in which the shading difference is not clear and the shading difference is hardly visible.

It is important to have a certain degree of affinity between the high heat-resistant resin fine particle and the core component such that the high heat-resistant resin fine particle is not separated from the core component, and thus at least one of the monomer components of the binder resin constituting the core component and at least one of the monomer components constituting the high heat-resistant resin fine particle are preferably the same monomer component. With such a configuration, the interface between the core component and the high heat-resistant resin fine particle becomes seamless and the adhesive strength is increased, so that, for example, the high heat-resistant resin is attached to the surface of the core component by a wet method, thereafter, when the high heat-resistant resin is stretched in the external addition step, a part of the high heat-resistant resin can be anchored to the core component, a portion protruding from the core component can be stretched, the coverage can be increased, and thereby it is possible to obtain a coating form of preferable high heat-resistant resin fine particle component.

In addition, it is possible to exemplify a method in such a manner that if the binder resin is the polyester, the resin contained in the high heat-resistant resin fine particle also becomes polyester, if the acid value of the binder resin is equal to or less than 3 mgKOH/g, the acid value of the resin contained in the high heat-resistant resin fine particle is 4 mgKOH/g to 20 mgKOH/g; and the binder resin does not have a hydroxyl group, and the resin contained in the high heat-resistant resin fine particle has a hydroxyl group.

When the resin contained in the binder resin and the high heat-resistant resin fine particle are the same as each other, the melting of the binder resin and the high heat-resistant resin fine particle progresses when the toner base particle is prepared, and thus TP1 and TP2 measured by the rheometer are almost the same value.

Also, if both of the binder resin and the high heat-resistant resin fine particle is extremely poor, the binder resin and the high heat-resistant resin fine particle are not melted to each other by heat in the first measurement, and the structure of the toner is maintained, and thereby TP2 and TP1 have substantially the same value.

The high heat-resistant resin fine particle contains a resin, but may contain other components such as wax, and a charge control agent.

The number average molecular weight by GPC of the resin contained in the high heat-resistant resin fine particle is preferably equal to or greater than 8,000, is more preferably equal to or greater than 10,000, and is still more preferably equal to or greater than 13,000, and is preferably equal to or less than 50,000, is more preferably equal to or less than 40,000, and is still more preferably equal to or less than 35,000.

The weight average molecular weight by GPC of the resin contained in the high heat-resistant resin fine particle is preferably equal to or greater than 20,000, and is more preferably equal to or greater than 30,000, and is preferably equal to or less than 300,000, and more preferably equal to or less than 200,000.

The Tg of the high heat-resistant resin fine particle is preferably equal to or higher than 60° C., and is more preferably equal to or higher than 70° C., and is preferably equal to or lower than 100° C., and is more preferably equal to or lower than 90° C. Further, the Tg of the high heat-resistant resin fine particle is necessary to be higher than the Tg of the binder resin, and thus is more preferably equal to higher than 10° C., and is still more preferably equal to higher than 20° C.

In order to adjust TP2/TP1 measured by the rheometer of the toner to fall within the range (1.47 to 2.35) of the present invention, the high heat-resistant resin fine particle is necessary to be disposed in the vicinity of the surface of the toner base particles.

As a composition of the high heat-resistant resin fine particle effective for that purpose, it is possible to exemplify a method in such a manner that in a case where preparing the toner base particle in the wet medium (water and/or the organic solvent), it is recommended to make it a composition that is more familiar to the medium than binder resin, for example, in a case where the medium is water, a ratio of an acidic monomer or a basic monomer is set to be high with respect to the binder resin, and is set to be equal to or greater than 1.0 parts by mass with respect to 100 parts by mass of other monomers; and an ionic polymerization initiator is used.

3.2.2. Regarding "BETN-BETF"

When the BETN-BETF is excessively small (when being smaller than 0.54 $m^2/g$), a smooth state in which the number of the high heat-resistant resin fine particles on the surface of the toner base particle is small; and deformation due to the impact of the external addition operation is large is indicated.

When the BETN-BETF is excessively large (when being larger than 1.56 $m^2/g$), an excessive fine unevenness in which the number of the high heat-resistant resin fine particles is excessively large; deformation due to the impact of the external addition operation is small; the particle diameter of the high heat-resistant resin fine particle is very large is indicated.

In a case where the core component particle before the addition of the high heat-resistant resin fine particle have a shape with unevenness, and the high heat-resistant resin fine particles are attached to each other with the same charge (plus pairs or minus plus pairs) in water, the high heat-resistant resin fine particle tends to be selectively attached to the convex portion of the core component particle, which is a preferable tendency.

In the toner of the related art, even when the high heat-resistant resin fine particle is added, after attachment, the high heat-resistant resin fine particle is embedded deep inside without remaining in the vicinity of the surface of the toner base particle.

In the present invention, the high heat-resistant resin fine particle remains in the vicinity of the surface of the toner base particle. In addition, in the case of being spread by the external addition operation, the high heat-resistant resin fine particle component is present in a state of being thinly spread on the surface of the toner base particle.

Therefore, the high heat-resistant resin fine particles are not uniformly distributed on the entire surface of the toner base particle, and the adhesion rate to the convex portion tends to be higher than the adhesion rate to the concave portion. The blocking resistance is deteriorated when the toners fuse together under heating environment, but probabilistically, the convex portion of the toner predominantly contacts the high heat-resistant resin fine particle. Therefore, the heat resistance of the convex portion is preferably high.

Accordingly, the toner of which the "BETN-BETF" falls within the scope of the present invention exhibits the effect of the present invention (particularly excellent blocking resistance).

4. External Addition 4.1. External Additive

In the present invention, in order to obtain the physical properties of the toner of the present invention, to improve the fluidity of the toner, and to improve the charge controllability, an external additive is added. Since the external additive attached to the entire of the surface of the toner base particle, even a portion where the high heat-resistant resin fine particle is not present is preferably covered with the external additive. As the external additive, it can be appropriately selected from various inorganic or organic fine particles and used. Two or more kinds of external additives may be used in combination.

Examples of the inorganic fine particle include various carbides such as silicon carbide, boron carbide, titanium carbide, zirconium carbide, hafnium carbide, vanadium carbide, tantalum carbide, niobium carbide, tungsten carbide, chromium carbide, molybdenum carbide, and calcium carbide; various nitrides such as boron nitride, titanium nitride, and zirconium nitride; various borides such as zirconium boride; various oxides such as titanium oxide, calcium oxide, magnesium oxide, zinc oxide, copper oxide, aluminum oxide, cerium oxide, silica, and colloidal silica; various titanic acid compounds such as calcium titanate, magnesium titanate, and strontium titanate; a phosphate compound such as calcium phosphate; sulfide such as molybdenum disulfide; fluoride such as magnesium fluoride, and fluorocarbon; various metal soap such as aluminum stearate, calcium stearate, zinc stearate, and magnesium stearate; talc; bentonite; various carbon blacks; conductive carbon black; magnetite; and ferrite.

As the organic fine particles, fine particles of a styrene resin, an acrylic resin, an epoxy resin, a melamine resin or the like can be used. Further, charge stability can be improved by using fluorine atom-containing fine particles.

Among these external additives, particularly, silica, titanium oxide, alumina, zinc oxide, various carbon blacks, conductive carbon black, and the like are suitably used. As the external additive, those in which the surface of the inorganic fine particle or organic fine particle is subjected to a surface treatment such as hydrophobization with a treating agent such as a silane coupling agent such as hexamethyldisilazane (HMDS) or dimethyldichlorosilane (DMDS), a titanate coupling agent, a silicone oil treatment agent such as silicone oil, dimethyl silicone oil, modified silicone oil, and amino modified silicone oil, silicone varnish, a fluorine-based silane coupling agent, fluorine-based silicone oil, and a coupling agent having an amino group or a quaternary ammonium base. Two or more of these treating agents may be used in combination.

The additional amount of the external additive is preferably equal to or greater than 1.0 parts by mass, and is particularly preferably equal to or greater than 1.5 parts by mass, and is preferably equal to or less than 6.5 parts by mass, and is particularly preferably equal to or less than 5.5 parts by mass, with respect to 100 parts by mass of toner base particle.

In the toner of the present invention, from the viewpoint of the charge control, the conductive fine particle may be used as the external additive as well. Examples of the conductive fine particle include metal oxides such as conductive titanium oxide, silica, and magnetite, or those doped with a conductive substance, organic fine particles doped with a conductive substance such as a metal in a polymer having a conjugated double bond such as polyacetylene, polyphenyl acetylene, and poly-p-phenylene, and carbon typified by carbon black and graphite, and the like. Among them, from the viewpoint that conductivity can be imparted without impairing the fluidity of the toner, conductive titanium oxide or one doped with the conductive substance thereof is more preferable.

A lower limit of the content of the conductive fine particle is preferably equal to or greater than 0.05 parts by mass, is more preferably equal to or greater than 0.1 parts by mass, and is particularly preferably equal to or greater than 0.2 parts by mass, with respect to 100 parts by mass of the toner base particle.

On the other hand, an upper limit of the content of the conductive fine particle is preferably equal to or less than 3 parts by mass, is more preferably equal to or less than 2 parts by mass, and is particularly preferably equal to or less than 1 part by mass.

4.2. External Addition Method of External Additive

Examples of the method of adding the external additive include a method using a high-speed stirrer such as a Henschel mixer, and a method using an apparatus capable of applying compressive shear stress.

The toner can be prepared by a one-step external addition method in which all of the external additives are simultaneously added and externally added to the toner base particle, but can also be prepared by a stepwise external addition method of performing the external addition for each external additive.

In order to prevent the temperature rise during external addition, installing a cooling device in a container, and externally adding the external additive stepwise can be performed.

The BETN-BETF can be adjusted to fall within the range of the present invention (for example, 0.54 $m^2/g$ to 1.56 $m^2/g$) by adjusting the temperature of external addition, the number of rotations, time, and the like.

For example, when stirring for a long time (for example, 25 minutes or longer) at 3000 rpm with a Henschel mixer, the numerical "BETN-BETF" is decreased (for example, a value close to 0.54 $m^2/g$). When stirring for a short time (for example, 5 minutes or shorter) under the same conditions, this numerical value becomes larger (for example, a value close to 1.56 $m^2/g$).

5. Others

The electrostatic charge image developing toner of the present invention may be used in any form of a two-component type developer using a toner together with a carrier, or a magnetic or nonmagnetic single component type developer not using a carrier.

In the case of using the two-component type developer, as the carrier, magnetic substances such as iron powder, magnetite powder, and ferrite powder, or known ones such as those obtained by coating the surface thereof with a resin, and a magnetic carrier can be used. As the coating resin of the resin coating carrier, a styrene resin, an acrylic resin, a styrene acrylic copolymer resin, a silicone resin, a modified silicone resin, a fluororesin, or a mixture thereof, which are generally known, can be used.

EXAMPLES

The invention will be described more specifically with reference to Examples, but the invention is by no means restricted to the following Examples so long as it does not exceed the gist thereof. In the following examples, "parts" means "parts by mass" and "%" means "% by mass".

<Examples 1 to 9, and Comparative Examples 1 to 6>

A volume median diameter, a number medium diameter, a particle size distribution ($Dv_{50}/Dn_{50}$), an average circularity, a weight average molecular weight (Mw), an emulsion solid content concentration, and the like were measured as follows. In the present invention, each numerical value is defined as measured as follows.

<Medium Diameter Measurement 1>

A volume median diameter ($Dv_{50}$) of a particle having a volume median diameter ($Dv_{50}$) of less than 1 micron was measured by the method described in the handling manual using Microtrac Nanotrac 150 (hereinafter abbreviated as "Nanotrac") manufactured by Nikkiso Co., Ltd., and the analysis soft Microtrac Particle Analyzer Ver 10.1.2.-019EE manufactured by the same company under the conditions of ion-exchanged water having electric conductivity of 0.5 μS/cm as a solvent, refractive index of solvent: 1.333, measuring time: 120 seconds, number of measuring times: five, and the average value was calculated.

Other setting conditions were refractive index of particles: 1.59, permeability: permeable, shape: spherical shape, and density: 1.04.

<Medium Diameter Measurement 2>

The volume median diameter ($Dv_{50}$) and the number medium diameter ($Dn_{50}$) of the particle having a volume median diameter ($Dv_{50}$) of equal to or more than 1 micron was measured by means of Multisizer III (aperture diameter: 100 μm) (hereinafter abbreviated as "Multisizer") manufactured by Beckman Coulter, Inc., using, as a dispersion medium, Isoton II manufactured by the same company and dispersing the toner particles so that the dispersoid concentration became 0.03% by mass. The particle size distribution is a value obtained by dividing $Dv_{50}$ by $Dn_{50}$.

<Average Circularity>

The average circularity was measured by dispersing dispersoids in a dispersion medium (cell sheath: manufactured by Sysmex Corporation) so that its concentration fell within a range of 5,720 to 7,140 particles/μL by using a flow-type particle image analyzer (FPIA3000, manufactured by Sysmex Corporation) under conditions of HPF analytical amount of 0.35 μL and the number of pieces on HPF detection of 2000 to 2500 in HPF mode.

<Weight Average Molecular Weight (Mw)>

THF soluble components of the primary polymer particle dispersion was measured by gel permeation chromatography (GPC) under the following conditions.

Apparatus: GPC apparatus manufactured by Tosoh Corporation HLC-8320, Column: TOSOH TSKgel Super HM-H (diameter of 6 mm×length of 150 mm×two), Solvent: THF, Column temperature: 40° C., Flow rate: 0.5 mL/min, Sample concentration: 0.1% by mass, Calibration curve: standard polystyrene <Emulsion Solid Content Concentration>

The emulsion solid content concentration was obtained by heating 2 g of sample at 195° C. for 90 minutes using an infrared moisture meter FD-610 manufactured by Kett Electric Laboratory, so as to evaporate moisture.

<Measurement Method by Transmission Electron Microscope, Measurement Method of Shading Difference>

After embedding and curing a toner in an epoxy resin, a shell and a core were discriminated and stained by exposing with gas for five minutes with ruthenium tetroxide. Next, a cross section was taken out with a knife, and an ultrathin piece of the toner having a thickness of 200 nm was prepared using an Ultramicrotome. Further, the ultrathin piece of the toner were observed with an acceleration voltage of 100 kV using a transmission electron microscope (TEM) H7500 (manufactured by Hitachi High-Technologies Corporation.), and the shading difference was confirmed with the naked eye.

Example 1

<Preparation of Wax Dispersion A1: Emulsification Step>

30.00 parts (1440 g) of ester wax 1 as wax (prepared by NOF CORPORATION, Product name: WEP-3, DSC second measurement melting point peak: 71.0° C., DSC second measurement onset temperature: 68.6° C., DSC second measurement inflection point: 69.9° C., Catalog melting point: 73° C., Catalog acid value: 0.1 mgKOH/g, Catalog hydroxyl value: equal to or lower than 3 mgKOH/g), 0.24 parts of decaglycerin decabenate (prepared by Mitsubishi-Chemical Foods Corporation, Product name: B100D, Hydroxyl value: 27, Melting point 70° C.), 1.93 parts of 20% aqueous sodium dodecyl benzene sulfonate solution (hereinafter, abbreviated as "20% DBS aqueous solution"), and 67.83 parts of demineralized water were heated at 90° C., and mixed in a CSTR type stirring layer equipped with a 450 inclined three-stage paddle blade for 20 minutes.

Subsequently, circulating emulsification was started under a pressure condition of 25 MPa using a valve homogenizer (manufactured by Gaulin, 15-M-8 PA type) while heating the dispersion at 90° C., and the particle diameter was measured with a nanotrack, and dispersed until the volume median diameter ($Dv_{50}$) reached 245 nm so as to prepare a wax dispersion A1 (emulsion solid content concentration=31.2%, wax component concentration 30.8%).

<Preparation of Wax Dispersion A2: Emulsification Step>

As raw materials, 22.50 parts of the above-described ester wax 1, 7.50 parts (1080 g) of ester wax 2 (prepared by NOF CORPORATION, Product name: WEP-5, Catalog melting point: 82° C., Catalog acid value: 0.1 mgKOH/g, Catalog hydroxyl value: equal to or lower than 3 mgKOH/g), 0.24 parts of decaglycerin decabenate, 1.93 parts of 20% DBS aqueous solution, and 67.83 parts of demineralized water were used so as to prepare a wax dispersion A2 (emulsion solid content concentration=31.4%) by using the same method used in the case of the wax dispersion A1.

<Preparing of Primary Polymer Particle: Polymerization Step>

10.7 parts (as a wax component) of the wax dispersion A1, 252 parts of demineralized water and 0.02 parts of 0.5% iron sulfate (II) sulfate heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier solution which had previously been stirred with a homogenizer for 30 minutes was added for 240 minutes.

The time at which the mixture of the following monomers and emulsifier aqueous solution was started to added was taken as the polymerization initiation, and the following initiator aqueous solution was added for 480 minutes from 0 minute of the initiation of polymerization. The following iron sulfate aqueous solution was added at 240 minute after the initiation of polymerization. The temperature was raised to 95° C. at 300 minutes after the initiation of polymerization. Heating and stirring was continued until 540 minutes of the initiation of polymerization.

| [Monomers] | |
|---|---|
| Styrene | 70.9 parts |
| Butyl acrylate | 29.1 parts |
| Acrylic acid | 0.85 parts |
| Trichlorobromomethane | 1.0 parts |
| Hexanediol diacrylate | 0.95 parts |
| [Aqueous solution of emulsifier] | |
| 20% DBS aqueous solution | 1.0 parts |
| Demineralized water | 66.9 parts |
| [Initiator aqueous solution] | |
| 8% aqueous hydrogen peroxide solution | 28.0 parts |
| 8% L-(+) ascorbic acid aqueous solution | 28.0 parts |
| [Iron sulfate aqueous solution] | |
| 0.5% iron sulfate (II) sulfate heptahydrate aqueous solution | 0.08 parts |

After 540 minutes from the initiation of polymerization, the temperature was cooled to 30° C., and a milky white primary polymer particle was obtained. The volume median diameter ($Dv_{50}$) measured by using the nanotrack was 239 nm. The weight average molecular weight (Mw) was 67,000. The solid content concentration was 24.1% by mass, and Tg was 38° C.

<Preparing of High Heat-Resistant Resin Fine Particle: Polymerization Step>

50.6 parts (as a wax component) of the wax dispersion A2, 2.96 parts of 20% DBS aqueous solution, and 350 parts of demineralized water, as an emulsifier (DBS SP) for adjusting particle diameter were added to a reactor equipped with a stirring device, a heating and cooling device, a concentrating device, and each raw material and auxiliaries charging device, and a temperature in the reactor was raised to 75° C. under a nitrogen stream while stirring.

In five minutes after adding the following initiator aqueous solution 1, while continuing the stirring, a mixture of the following monomers and emulsifier aqueous solution which had previously been stirred with a homogenizer for 30 minutes was added for 180 minutes.

The time at which the mixture of the following monomers and emulsifier aqueous solution was started to added was taken as the polymerization initiation, and the following initiator aqueous solution 2 was continuously added for 240 minutes from 60 minute of the initiation of polymerization. The following initiator aqueous solution 3 was continuously added for 240 minutes from 120 minutes of the initiation of polymerization. The following iron sulfate aqueous solution was added at 180 minute after the initiation of polymerization. The temperature was raised to 93° C. at 180 minutes after the initiation of polymerization. Heating and stirring was continued until 480 minutes of the initiation of polymerization.

| [Monomers] | |
|---|---|
| Styrene | 97.9 parts |
| Butyl acrylate | 2.1 parts |
| Acrylic acid | 1.5 parts |
| 1-dodecanethiol | 1.0 parts |
| [Aqueous solution of emulsifier] | |
| 20% DBS aqueous solution | 1.0 parts |
| Demineralized water | 66.7 parts |
| [Initiator aqueous solution 1] | |
| 20% ammonium persulfate aqueous solution | 6.0 parts |
| [Initiator aqueous solution 2] | |
| 8% aqueous hydrogen peroxide solution | 14.2 parts |
| [Initiator aqueous solution 3] | |
| 8% L-(+) ascorbic acid aqueous solution | 21.3 parts |
| [Iron sulfate aqueous solution] | |
| 0.5% iron sulfate (II) sulfate heptahydrate aqueous solution | 0.05 parts |

After 480 minutes from the initiation of polymerization, the temperature was cooled to 30° C., and a milky white high heat-resistant resin fine particle was obtained. The volume median diameter ($Dv_{50}$) measured by using the nanotrack was 158 nm. The weight average molecular weight (Mw) was 59,000. The solid content concentration was 20.0%, and Tg was 80° C.

<Preparing of Toner Base Particle Dispersion: Aggregation Step>

The obtained 87.1 parts (solid content) of primary polymer particle, 0.07 parts (solid content) of 20% DBS aqueous solution, 74 parts of deionized water, 0.52 parts (solid content) of 5% iron sulfate (II) sulfate heptahydrate aqueous solution, and 18 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring and mixed homogeneously.

Thereafter, 0.10 parts (solid content) of 0.5% aluminum sulfate aqueous solution was added for 15 minutes, and 41 parts of deionized water was added for 5 minutes. Subsequently, the internal temperature was raised to 40° C., and the temperature was raised stepwise until the volume median diameter became 5.2 μm. This temperature (primary aggregation temperature) was 45° C.

Promptly, lowering the temperature was rapidly lowered by 1° C. from the primary aggregation temperature and simultaneously adding 9.7 parts (solid content) of primary polymer particle. After 180 minutes, 5.6 parts (solid content) of high heat-resistant resin fine particle was added. After 90 minutes, 4.0 parts (solid content) of 20% DBS aqueous solution and 23 parts of deionized water were added, then the temperature was raised up to 65° C. for 50 minutes, and thereafter, the temperature was raised stepwise until the circularity became 0.975.

The temperature (final circulation temperature) when the circularity reached 0.975 was 68° C. Then, the temperature was rapidly cooled to 30° C., and thereby a toner base particle dispersion was obtained.

<Preparing of Toner Base Particle: Washing and Drying Step>

The obtained toner base particle dispersion was extracted and suction filtered with an aspirator using filter paper of 5 type C (No. 5C, manufactured by Toyo Roshi Kaisha, Ltd.) The cake remaining on the filter paper was transferred to a stainless steel container equipped with a stirrer (propeller blade), and ion-exchanged water having an electric conductivity of 1 μS/cm was added and dispersed uniformly, followed by stirring for 30 minutes.

After this step was repeated until the electric conductivity of the filtrate reached 2 μS/cm, the obtained cake was dried in an air dryer set at 40° C. for 48 hours so as to obtain a toner base particle.

<Preparing of Toner: External Addition Step>

With respect to the obtained toner base particle (100 parts), 4 parts of polymer/silica composite particles (ATLAS 100: silica/polymer ratio=70/30, true specific gravity=1.7 g/cm$^3$, manufactured by Cabot, containing octahydropentalene), 0.5 parts of titania and silica composite oxide particle (STX501: prepared by Nippon Aerosil Co., Ltd.), and 0.4 parts of small particle diameter silica (RY200L: prepared by Nippon Aerosil Co., Ltd.) were added, and stirred, mixed, and sieved at 3000 rpm for 15 minutes with a Henschel mixer so as to obtain a toner.

Examples 2 to 9 and Comparative Examples 1 to 4

Toners in Examples 2 to 9 and Comparative Examples 1 to 4 were prepared by using the same method as that used in Example 1 except that in Example 1, an additional amount of styrene (St), an additional amount of butyl acrylate (BA), an additional amount of acrylic acid (AA), and an additional amount as a wax component of the wax dispersion A1 in the preparing step of the primary polymer particle, an additional amount of 20% DBS aqueous solution as an emulsifier (DBS SP) for adjusting particle diameter in the preparing step of the high heat-resistant resin fine particle, and an additional amount as a solid content of the high heat-resistant resin fine particle in the aggregation step were changed as indicated in Table 1.

Comparative Example 5

A toner of Comparative Example 5 was prepared by using the same method as that in Example 1 disclosed in JP-A-2006-145889.

Comparative Example 6

A toner of Comparative Example 6 was prepared by using the same method as that in Example 4 disclosed in JP-A-2014-081614.

The weight average molecular weight of the primary polymer particle, the volume median diameter and the weight average molecular weight of the high heat-resistant resin fine particle, coverage in which the high heat-resistant resin fine particle coats toner base particle (toner base particle is assumed to be 5.6 μm), and a primary aggregation temperature and final circulation temperature in the aggregation step are indicated in Table 1.

Further, the volume median diameter ($Dv_{50}$), the number medium diameter ($Dn_{50}$), the particle size distribution ($Dv_{50}/Dn_{50}$), and the average circularity of the toner to which the toner base particle is externally added are indicated in Table 1.

TABLE 1

| | Composition Form | | | | | | | | |
|---|---|---|---|---|---|---|---|---|---|
| | Polymer primary particle | | | | | High heat-resistant resin fine particle | | | |
| Unit | St additional amount Part | BA additional amount Part | AA additional amount Part | Additional amount of wax dispersion A1 (as wax component) Part | Weight average molecular weight — | Additional amount of 20% DBS_SP Part | AA additional amount Part | Volume median diameter nm | Weight average molecular weight — |
| Example 1 | 70.9 | 29.1 | 0.85 | 10.7 | 67,000 | 2.96 | 1.50 | 158 | 59,000 |
| Example 2 | 70.7 | 29.3 | 0.85 | 7.5 | 86,000 | 2.96 | 1.50 | 158 | 59,000 |
| Example 3 | 69.1 | 30.9 | 0.85 | 10.7 | 117,000 | 2.96 | 1.50 | 158 | 59,000 |
| Example 4 | 72.7 | 27.3 | 0.85 | 10.7 | 89,000 | 2.96 | 1.50 | 158 | 59,000 |
| Example 5 | 70.9 | 29.1 | 0.85 | 10.7 | 67,000 | 0.50 | 1.50 | 215 | 76,000 |
| Example 6 | 70.9 | 29.1 | 0.85 | 10.7 | 67,000 | 3.50 | 1.50 | 112 | 41,000 |
| Example 7 | 70.9 | 29.1 | 0.85 | 10.7 | 67,000 | 4.42 | 1.50 | 83 | 42,000 |
| Example 8 | 70.9 | 29.1 | 0.85 | 10.7 | 67,000 | 2.96 | 1.50 | 158 | 59,000 |
| Example 9 | 70.9 | 29.1 | 0.85 | 10.7 | 67,000 | 2.96 | 1.50 | 158 | 59,000 |
| Comparative Example 1 | 70.9 | 29.1 | 0.85 | 10.7 | 67,000 | 2.96 | 1.50 | 158 | 59,000 |
| Comparative Example 2 | 70.9 | 29.1 | 0.85 | 10.7 | 67,000 | 2.96 | 1.50 | 158 | 59,000 |
| Comparative Example 3 | 70.9 | 29.1 | 0.85 | 10.7 | 67,000 | 4.42 | 1.50 | 83 | 42,000 |
| Comparative Example 4 | 70.9 | 29.1 | 1.50 | 10.7 | 73,000 | 2.96 | 1.50 | 158 | 59,000 |
| Comparative Example 5 | 76.8 | 23.2 | 1.50 | 9.9 | 88,000 | 1.50 | 1.50 | 260 | 74,000 |
| Comparative Example 6 | 76.8 | 23.2 | 1.50 | 11.5 | 79,000 | 0.00 | 1.50 | 275 | 88,000 |

| | Composition Form | | | | | | | |
|---|---|---|---|---|---|---|---|---|
| | Aggregation step | | | | Toner shape | | | |
| Unit | Additional amount of the high heat-resistant resin fine particles Part | Coverage area % | Primary aggregation temperature ° C. | Final circulation temperature ° C. | Volume median diameter ($Dv_{50}$) μm | Number medium diameter ($Dn_{50}$) μm | Particle size distribution ($Dv_{50}/Dn_{50}$) — | Average circularity — |
| Example 1 | 5.6 | 51 | 45 | 68 | 5.6 | 5.1 | 1.08 | 0.976 |
| Example 2 | 5.6 | 51 | 43 | 72 | 5.4 | 4.8 | 1.11 | 0.973 |
| Example 3 | 5.6 | 51 | 41 | 68 | 5.5 | 4.9 | 1.11 | 0.974 |
| Example 4 | 5.6 | 51 | 47 | 73 | 5.4 | 4.9 | 1.11 | 0.974 |
| Example 5 | 7.4 | 51 | 45 | 69 | 5.4 | 5.0 | 1.10 | 0.975 |
| Example 6 | 4.0 | 51 | 45 | 69 | 5.6 | 5.1 | 1.09 | 0.974 |
| Example 7 | 4.3 | 74 | 44 | 69 | 5.4 | 5.0 | 1.09 | 0.974 |
| Example 8 | 3.4 | 30 | 45 | 69 | 5.7 | 5.2 | 1.09 | 0.975 |
| Example 9 | 8.5 | 80 | 45 | 72 | 5.8 | 5.3 | 1.08 | 0.973 |
| Comparative Example 1 | 1.7 | 15 | 44 | 69 | 5.7 | 5.1 | 1.11 | 0.978 |
| Comparative Example 2 | 12.2 | 120 | 45 | 79 | 5.7 | 5.2 | 1.08 | 0.975 |
| Comparative Example 3 | 3.0 | 51 | 45 | 66 | 5.7 | 5.0 | 1.15 | 0.974 |

TABLE 1-continued

| | | | | | | | | |
|---|---|---|---|---|---|---|---|---|
| Comparative Example 4 | 5.6 | 51 | 44 | 84 | 5.3 | 4.9 | 1.09 | 0.973 |
| Comparative Example 5 | 5.0 | 28 | 52 | 92 | 6.8 | 6.2 | 1.10 | 0.960 |
| Comparative Example 6 | 20.0 | 127 | 56 | 95 | 7.0 | 6.4 | 1.09 | 0.972 |

By using the toners obtained in Examples 1 to 9 and Comparative Examples 1 to 6, evaluation and determination were performed by the following method. The measured toner (sample) may be an immediately prepared toner, that is, immediately external-added toner, but even with the toner which is aged or already being in the development layer, measured numerical values hardly change, which is common general technical knowledge. Also, a toner after externally added in an environment of equal to or higher than 50° C. may not obtain an appropriate value of TP1 in some cases.

[Measurement Method of TP2 and TP1 and Definition of TP2/TP1]

TP2/TP1 measured by rheometer was obtained by the following procedure.

Measurement was carried out by the following method using rheometer ARES (measurement control software TA Orchestrator V 7.2.0.2) manufactured by TA Instruments.

<Measurement of 8 mm Cylindrical Pellet>

Approximately 0.3 g of sample was placed in a jig for 8 mm diameter and pressed with a clamping force of 1.25 ton (gauge 25 kg/cm$^2$) for 15 minutes with a press machine (5 ton press PE-5Y, manufactured by Kodaira Seisakusho Co., Ltd.) which was heated to 50° C., and molded into a pellet. In the present invention, this may be abbreviated as a "molded body" in some cases.

Scratches of 12 each in length and width in a lattice pattern, a width of the opening of 50 to 100 μm, and a depth of 1 to 10 μm (average 3 to 5 μm) were formed on surface of 8 mm disposable plate made of aluminum used for measurement.

First temperature rise measurement: a pellet (molded body) was set to a measurement apparatus on which a circular parallel plate having a vertical diameter of 8 mm was mounted, after raising the temperature to 40° C., the upper plate was lowered, the force 'Force' was adjusted to 200 g, and then the measurement was performed under the following conditions.

Jig compliance 'Fixture compliance' 0

Plate inertia 'Tool inertia' 0

Measurement frequency 'Frequency' 6.28 rad/sec

Initial temperature 'Initial Temp.' 40.0° C.

Final temperature 'Final Temp.' 120.0° C.

Heating rate 'Ramp Rate' 4.0° C./min

Retention time after temperature rise 'Soak Time After Ramp' 20 s (second)

Measurement cycle time 'Time Per Measure' 10 s (second)

Distortion 'Strain' 0.025%

Option 'Option'

Retention time after reaching initial temperature and before measurement 'Delay Before Test' non-setting Automatic tension adjustment 'Auto Tension Adjustment'

Automatic tension adjustment 'Auto Tension Adjustment' setting

Automatic tension direction 'Auto Tension Direction' Compression (compression)

Initial force 'Initial Static Force' 204.0 g

Automatic tension sensitivity 'Auto Tension Sensitivity' 2.0 g

Automatic tension switch 'Switch Auto Tension to Programmed Extension'

Sample elastic modulus setting 'When Sample Modulus'<3.00e+05 Pa

Maximum automatic tension speed 'Max Auto Tension Rate' 0.01 mm/s (mm/second)

Automatic distortion adjustment 'Auto Strain Adjustment'

Automatic distortion adjustment 'Auto Strain' setting

Maximum distortion 'Max Applied Strain' 40.0%

Maximum allowed torque 'Max Allowed Torque' 100.0 gf·cm

Minimum allowed torque 'Min Allowed Torque' 0.2 gf·cm

Distortion adjustment 'Strain Adjustment' 20.0%

Setting at measurement end 'End of Test'

Temperature control off 'Turn OFF Temp Controller' No

Temperature setting after measurement end 'Set End of Test Temp' Yes

Temperature after measurement end 'Set End of Test Temp to' 40.0° C.

Motor off 'Turn OFF Motor' No

Hold 'Turn Hold ON' Yes

Second temperature rise measurement: when the temperature lowered to 40° C., measurement was performed at the second temperature rise under the same condition as the first time. However, the settings at the end of measurement are as follows. After ending the first measurement, automatic air-cooling was performed, at the time when the temperature reached 40° C., a pellet (a molded body) was not extracted, and the measurement at the second temperature rise was immediately started.

Setting at measurement end 'End of Test'

Temperature control off 'Turn OFF Temp Controller' No

Temperature setting after measurement end 'Set End of Test Temp' Yes

Temperature after measurement end 'Set End of Test Temp to' 120.0° C.

Motor off 'Turn OFF Motor' No

Hold 'Turn Hold ON' No

The tan δ (=G"/G') is obtained by dividing the loss modulus (G") obtained in the first temperature rise measurement by the storage modulus (G') so as to obtain the maximum value TP1(refer to FIG. 2) of the tan δ appearing in the range of 40° C. to 80° C. in the second measurement.

Similarly, the maximum value TP2(refer to FIG. 2) of the tan δ appearing in the range of 40° C. to 80° C. was obtained, and then TP2 was divided by TP1 so as to obtain TP2/TP1.

The results of TP1, TP2, and "TP2/TP1" for the example and the comparative example are indicated in Table 2.

Further, TP2/TP1 of the toner was determined according to the following criteria. The results are indicated in Table 2.

[Criteria "TP2/TP1" ]

A: 1.79≤TP2/TP1≤2.09

B: 1.63≤TP2/TP1≤2.22 (here, excluding A region)

C: 1.47≤TP2/TP1≤2.35 (here, excluding A region and B region)

D: 1.47>TP2/TP1, or 2.35<TP2/TP1

TP1 and TP2 were measured in the same manner for commercially available "known toner in which a shell may be formed", and are indicated in Table 3 together with TP2/TP1 as a reference example.

[Method of Measuring BETN and BETF and Definition of "BETN-BETF" ]

BETN and BETF were measured and defined as follows.

A release treatment of the external additive as sample preparation was performed by the following procedure.

60 mL of 10 mol/L of aqueous sodium hydroxide solution and 1 mL of neutral surfactant aqueous solution (Contaminon N® prepared by Wako Pure Chemical Industries, Ltd., diluted in three times) were added to 3.5 g of toner in 200 mL glass beaker, 30 mm of rotor was input after the toner floating on the liquid surface was gently stirred with a metal spatula or the like so as to be mixed with the aqueous solution, the mixture was stirred with a magnetic stirrer sufficiently strong enough for the toner to be dispersed in the liquid for 60 minutes, and then suction filtration was carried out with a polytetrafluoroethylene membrane filter having a pore size of 3 μm.

While the aqueous solution remains in a funnel, 30 mL of neutral detergent diluted aqueous solution (for example, Charmy Magica®, prepared by Lion Co., Ltd., aqueous solution diluted in 20 times) is sprinkled for the slurry during the filtration, and then the first filtration was completed while rinsing the slurry with 30 mL of ion-exchanged water.

Filter captured matters were collected in 500 mL of glass beaker, 300 mL of ion-exchanged water was added, 30 mm of rotor was added, the magnetic stirrer was used for 3 minutes with sufficient strength to allow the captured matter to be dispersed in the liquid, and then suction filtration was performed with a bifluorosilute equipped with quantitative filter paper 5A.

After completion of the filtration, 30 mL of neutral detergent dilution aqueous solution which is the same as that in the first filtration was sprinkled to the filter paper captured matter, and then rinsed with 100 mL of ion-exchanged water.

The filter paper captured matter was put into an evaporating dish for each filter paper, was naturally dried at room temperature (20° C. to 30° C.) for 15 hours so as to sufficiently volatilize moisture, and thus obtained powder was referred to as a "toner base particle after releasing the external additive".

The BETN was measured with the toner base particle after releasing the external additive by using a full automatic specific surface area measuring apparatus Macsorb HM model-1208 manufactured by Mountech as the following procedure.

Approximately 0.5 g of sample was placed in a glass cell and the sample was precisely weighed to a digit of 0.1 mg. After the cell was attached to the apparatus and degassing was performed in a nitrogen stream at 40° C. for 20 minutes, nitrogen was adsorbed on the sample in a state where the cell is immersed in liquid nitrogen, then the adsorbed nitrogen was desorbed at room temperature, and a specific surface area was calculated by using a BET method based on calibration using an adsorption/desorption curve and a helium/nitrogen mixed gas so as to set "BETN ($m^2/g$)".

The BETF was obtained by the following procedure in which the measurement was performed with the toner base particle after releasing the external additive by using a flow-type particle image analyzer.

2.0 g of 20% DBS aqueous solution was added to 0.2 g of toner in 100 mL of glass beaker so as to entirely cover the liquid surface, and then the mixture was uniformly kneaded with a spatula so that the powder was not to be dispersed. The mixture was further kneaded with a spatula for three minutes while dispersing with an ultrasonic disperser (manufactured by AS ONE Co., Ltd., Model: ULTRASONIC CLEANER VS-150). Thereafter, 25 g of Isoton II, manufactured by Beckman Coulter, was added as a dispersion medium, and the mixture was stirred for 10 minutes with a stirrer.

The mixture was filtered through a sieve having an opening of 60 μm and dispersed for 5 minutes with an ultrasonic disperser. Filtration performed again by sieving to remove foam. Dilution was performed with Isoton II so that its concentration fell within a range of 5,720 to 7,140 particles/μL by using a flow-type particle image analyzer (FPIA3000, manufactured by Sysmex Corporation) under conditions of HPF analytical amount of 0.35 μL and the number of pieces on HPF detection of 2000 to 2500 in HPF mode.

Regarding all particles of data number (n) of 1≤D≤30 and 0.7≤R≤1.0 under the conditions of Density: 1, Circle-equivalent Diameter: D [μm], Circularity: R, the surface area (A) [$\mu m^2$] and the volume (V) [$\mu m^3$] for each particle were obtained by using the following Expression. An average specific surface area BETF ($m^2/g$) was obtained by dividing an average AAVE of the surface area by an average mass (WAVE) (the specific gravity is 1 in this time, and thus volume=mass (W) is established).

Surface area (A): $[4\pi D\ (D/2)^2]/R$

Volume (V): $[4\pi(D/2)^3]/3$

Average surface area (AAVE): $(\Sigma A)/n$

Mass (W): W=V

Average mass (WAVE): $(\Sigma W)/n$

BETF: AAVE/WAVE ($m^2/g$)

The "BETN-BETF ($m^2/g$)" was obtained by subtracting BETF from BETN, obtained in this way. The "BETN-BETF ($m^2/g$)" is indicated in Table 2.

Further, the "BETN-BETF" of the toner was determined according to the following criteria. The results are indicated in Table 2.

[Criteria of "BETN-BETF" ]

A: 0.99 $m^2/g$≤BETN-BETF≤1.45 $m^2/g$

B: 0.77 $m^2/g$≤BETN-BETF≤1.51 $m^2/g$ (here, excluding A region)

C: 0.54 $m^2/g$≤BETN-BETF≤1.56 $m^2/g$ (here, excluding A region and B region)

D: 0.54 $m^2/g$>BETN-BETF, or 1.56 $m^2/g$<BETN-BETF

[Measurement and Definition of Tg]

Tg measurement by differential scanning calorimeter (DSC) was performed as follows using Q20 manufactured by TA Instruments.

3±1 mg of toner was put into an aluminum pan and precisely weighed to a 0.1 mg digit, an aluminum pan filled with 3 mg of aluminum oxide was used as a reference, and the temperature was raised from 0° C. to 120° C. at a rate of 10° C./min in a nitrogen stream.

After holding at 120° C. for 10 minutes, the temperature was cooled to 0° C. at 10° C./min, kept for five minutes, and then again raised to 120° ° C. at 10° C./min.

The temperature at an intersection of a baseline before the endothermic peak at the second temperature rise and a tangent at the first inflection point appearing at 30° C. to 55° C. after starting of the endothermic peak was set as Tg (glass transition temperature).

The Tg of the toner thus obtained is indicated in Table 2. Further, the Tg of the toner was determined according to the following criteria. The results are indicated in Table 2.

[Criteria of Tg]

A: 39.5° C.≤Tg≤42.1° C.

B: 38.7° C.≤Tg≤43.8° C. (here, excluding A region)

C: 37.9° C.≤Tg≤45.4° C. (here, excluding A region and B region)

D: Tg<37.9° C. or 45.4<Tg

In a case where the sample of the polymerized primary particle and the high heat-resistant resin fine particle was an aqueous dispersion, Tg was measured by the above method after freeze-drying to remove moisture.

[Measuring Method and Definition of Blocking Resistance]

10 g of the toner was put in a cylindrical container having an inner diameter of 3 cm and a height of 6 cm, a load of 20 g was applied thereto, the toner was left for 48 hours in an environment at a temperature of 50° C. and a humidity of 55%, then the toner was removed from the container, and the degree of aggregation was confirmed by applying the load from above.

The collapse loads are indicated in Table 2, the criteria were determined as follows, and the results are indicated in Table 2.

[Criteria of Blocking Resistance]

A: Collapse under load of equal to or less than 150 g

B: Collapse under load of larger than 150 g and equal to or less than 300 g

C: Collapse under load of larger than 300 g and equal to or less than 900 g

D: Collapse under load of larger than 900 g

[Measurement Method of Fixing and Gloss Test]

A recording paper (basis weight 80 g/m$^2$ paper) on which an unfixed toner image was carried was prepared and a test was performed as follows by using a heat roll fixing type fixing machine.

The roller has a diameter is 27 mm, a nip width of 9 mm, and a fixing speed of 229 mm/sec, and is provided with a heater in the upper roller, and the surface of the roller is made of a tetrafluoroethylene-perfluoroalkyl vinyl ether copolymer (PFA), and is not coated with silicone oil.

A total of nine fixing and gloss tests were performed on the surface temperature of the roller three times for each of the three temperature levels of 140° C., 145° C., and 150° C., respectively.

The recording paper on which the unfixed image having an attachment amount of about 0.5 mg/cm$^2$ was transported to a fixing nip portion so as to obtain a fixed image. A mending tape was affixed to the fixed image, and a weight of 2 kg was passed thereon to bring the tape and the fixed image into close contact with each other. The mending tape was peeled off, and the extent to which the fixed image was transferred to the tape was visually determined. If the toner was not transferred to the tape, the fixing evaluation was determined as "B", and if the image was not transferred to the tape, the fixing evaluation was determined as "D". Further, regarding the image having the fixing evaluation was "B", the gross was measured at an angle of 75° using a grossmeter (VG2000) manufactured by NIPPON DENSYOKU INDUSTRIES Co., Ltd.

Table 2 indicates the determination of fixing and a measurement value of gloss.

Further, among the nine measurements, only the gross value for which the fixing determination was "B" was integrated and indicated in Table 2, and the fixing and gloss determination was performed by the following criteria. The determination results are indicated in Table 2.

[Criteria of Fixing and Gross Test: Gross Integrated Value that Became Fixing Determination B]

A: Equal to or larger than 110 points

B: Equal to or larger than 70 points and less than 110 points

C: Equal to or larger than 30 points and less than 70 points

D: Less than 30 points

[Comprehensive Evaluation Determination]

The worse one of the determination result of the blocking resistance and the determination result of the fixing and gloss test determined as described above is taken as "comprehensive evaluation determination" and indicated in Table 2.

In other words, even when the determination result of the blocking resistance was as "A", in a case where the determination result of the fixing and gloss test was "D", the comprehensive evaluation determination was "D".

In a case where the determination result of the blocking resistance was "C" and the determination result of the fixing and gloss test was "A", the comprehensive evaluation determination was "C".

TABLE 2

| | Property evaluation | | | | | | | | | | |
|---|---|---|---|---|---|---|---|---|---|---|---|
| | Viscosity | | | | Surface fine unevenness | | | | Tg | | Total evaluation |
| Unit | TP1 (—) | TP2 (—) | TP2/TP1 (—) | TP2/TP1 Classification (—) | BETN m$^2$/g | BETF m$^2$/g | BETN − BETF m$^2$/g | BETN-BETF Classification (—) | Tg ° C. | Tg Classification (—) | Determination (—) |
| Example 1 | 1.25 | 2.40 | 1.92 | A | 2.02 | 0.99 | 1.03 | A | 41.0 | A | A |
| Example 2 | 1.28 | 2.49 | 1.95 | A | 2.41 | 0.99 | 1.42 | A | 41.1 | A | A |
| Example 3 | 1.16 | 2.39 | 2.06 | A | 2.20 | 1.01 | 1.19 | A | 39.0 | B | B |
| Example 4 | 1.27 | 2.42 | 1.91 | A | 2.18 | 1.02 | 1.16 | A | 42.5 | B | B |
| Example 5 | 1.12 | 2.29 | 2.04 | A | 2.71 | 1.00 | 1.71 | D | 41.3 | A | C |
| Example 6 | 1.53 | 2.56 | 1.67 | B | 1.45 | 0.98 | 0.47 | D | 40.6 | A | C |
| Example 7 | 1.54 | 2.53 | 1.64 | B | 1.41 | 1.02 | 0.40 | D | 40.6 | A | C |
| Example 8 | 1.57 | 2.48 | 1.58 | C | 1.63 | 0.97 | 0.66 | C | 40.3 | A | C |
| Example 9 | 1.06 | 2.37 | 2.24 | C | 2.04 | 0.96 | 1.07 | A | 40.9 | A | C |
| Comparative Example 1 | 1.89 | 2.57 | 1.36 | D | 1.37 | 0.95 | 0.42 | D | 40.4 | A | D |
| Comparative Example 2 | 0.90 | 2.22 | 2.47 | D | 1.76 | 0.97 | 0.79 | B | 42.1 | A | D |

TABLE 2-continued

| | | | | | | | | | | | |
|---|---|---|---|---|---|---|---|---|---|---|---|
| Comparative Example 3 | 1.96 | 2.53 | 1.29 | D | 1.37 | 0.96 | 0.40 | D | 40.8 | A | D |
| Comparative Example 4 | 1.67 | 2.27 | 1.36 | D | 1.46 | 1.00 | 0.46 | D | 40.8 | A | D |
| Comparative Example 5 | 1.57 | 2.19 | 1.39 | D | 1.05 | 0.79 | 0.26 | D | 52.5 | D | D |
| Comparative Example 6 | 1.62 | 2.31 | 1.43 | D | 0.98 | 0.78 | 0.20 | D | 50.4 | D | D |

| | Property evaluation | | | | | | | | | | | | |
|---|---|---|---|---|---|---|---|---|---|---|---|---|---|
| | | | Fixing and gross test | | | | | | | | | | |
| | Blocking resistance | | | Gross integrated value that | Fix at 140° C. Upper stage: fixing | | | Fix at 145° C. Upper stage: fixing | | | Fix at 150° C. Upper stage: fixing | | |
| | Blocking resistance Determination (—) | Collapse load g | Fixing and gross test Determination (—) | became fixing determination B % | determination Lower stage: glass value (%) (—) (%) | | | determination Lower stage: glass value (%) (—) (%) | | | determination Lower stage: glass value (%) (—) (%) | | |
| Unit | | | | | | | | | | | | | |
| Example 1 | A | 60 | A | 126 | D | D | D | B 19 | B 18 | B 20 | B 22 | B 23 | B 24 |
| Example 2 | A | 40 | A | 122 | D | D | B 15 | B 16 | B 17 | B 16 | B 19 | B 19 | B 20 |
| Example 3 | B | 300 | A | 210 | B 18 | B 20 | B 18 | B 24 | B 24 | B 24 | B 27 | B 28 | B 27 |
| Example 4 | A | 40 | B | 108 | D | D | D | B 17 | B 16 | B 17 | B 19 | B 20 | B 19 |
| Example 5 | A | 40 | C | 34 | D | D | D | D | D | D | D | B 16 | B 18 |
| Example 6 | C | 350 | A | 148 | D | B 15 | B 14 | B 19 | B 17 | B 18 | B 21 | B 22 | B 22 |
| Example 7 | C | 900 | A | 143 | B 13 | B 13 | B 13 | B 16 | B 16 | B 16 | B 19 | B 18 | B 19 |
| Example 8 | C | 700 | A | 144 | B 12 | B 13 | B 13 | B 16 | B 16 | B 16 | B 19 | B 19 | B 20 |
| Example 9 | A | 0 | C | 59 | D | D | D | D | D | D | B 19 | B 20 | B 20 |
| Comparative Example 1 | D | 50000 | A | 161 | B 14 | B 14 | B 14 | B 17 | B 19 | B 18 | B 21 | B 22 | B 22 |
| Comparative Example 2 | A | 0 | D | 19 | D | D | D | D | D | D | D | D | B 19 |
| Comparative Example 3 | D | 29000 | A | 173 | B 15 | B 17 | B 15 | B 19 | B 19 | B 20 | B 23 | B 22 | B 23 |
| Comparative Example 4 | D | 1000 | A | 150 | B 15 | B 13 | B 14 | B 16 | B 15 | B 17 | B 21 | B 19 | B 20 |
| Comparative Example 5 | A | 60 | D | 21 | D | D | D | D | D | D | B 7 | B 7 | B 7 |
| Comparative Example 6 | A | 70 | D | 0 | D | D | D | D | D | D | D | D | D |

TABLE 3

| Manufacturer | Toner cartridge type | Color | TP1 | TP2 | TP2/TP1 |
|---|---|---|---|---|---|
| Fuji Xerox Co., Ltd | CT201399 | Cy toner | 1.64 | 1.52 | 0.93 |
| | CT200565 | Cy toner | 2.23 | 2.41 | 1.08 |
| | CT200248 | Cy toner | 2.07 | 2.07 | 1.00 |
| Konica Minolta Co., Ltd. | TN-619C | Cy toner | 1.99 | 2.03 | 1.02 |
| | TN-512C | Cy toner | 1.60 | 1.52 | 0.95 |
| Ricoh Company, Ltd | 600284 | Cy toner | 0.89 | 0.91 | 1.02 |
| | 841666 | Cy toner | 0.94 | 0.94 | 1.00 |
| | 845127 | Cy toner | 1.25 | 1.39 | 1.11 |
| Hewlett-Packard Company | CF361A | Cy toner | 1.62 | 1.83 | 1.13 |
| | CE250A | Cy toner | 2.19 | 2.29 | 1.05 |
| Samsung Electronics | CLP-C660A | Cy toner | 1.89 | 2.20 | 1.16 |
| Brother Industries Ltd. | TN315C | Cy toner | 2.37 | 2.37 | 1.00 |

<Results>

As apparent from Table 2, in the toners of Examples 1 to 9, the comprehensive evaluation determination was "A", "B", or "C", and both of the blocking resistance and the fixing and gross test result were excellent (both of the fixability at a low temperature and the high glossiness was realized); whereas in the toners of Comparative Examples 1 to 6, any one of the blocking resistance and the fixing and gross test result was deteriorated.

Examples 11 to 18 and Comparative Examples 11 and 12

A particle diameter, an average circularity, a weight average molecular weight (Mw), and an emulsion solid content concentration of each particle of less than 1 micron and equal to or greater than 1 micron or more were measured by using the same method as described above.

Example 11

<Preparation of Wax Dispersion A1>

30.00 parts (1440 g) of ester wax 1 as wax (prepared by NOF CORPORATION, Product name: WEP-3, DSC second measurement melting point peak: 71.0° C., DSC second measurement onset temperature: 68.6° C., DSC second measurement inflection point: 69.9° C., Catalog melting point: 73° C., Catalog acid value: 0.1 mgKOH/g, Catalog hydroxyl value: equal to or lower than 3 mgKOH/g), 0.24 parts of decaglycerin decabenate (prepared by Mitsubishi-Chemical Foods Corporation, Product name: B100D, Hydroxyl value: 27, Melting point 70° C.), 1.93 parts of 20% aqueous sodium dodecyl benzene sulfonate solution (hereinafter, abbreviated as "20% DBS aqueous solution"), and 67.83 parts of demineralized water were heated at 90° C., and mixed in a CSTR type stirring layer equipped with a 450 inclined three-stage paddle blade for 20 minutes.

Subsequently, circulating emulsification was started under a pressure condition of 25 MPa using a valve homogenizer (manufactured by Gaulin, 15-M-8 PA type) while heating the dispersion at 90° C., and the particle diameter was measured with a nanotrack, and dispersed until the volume median diameter ($Dv_{50}$) reached 245 nm so as to prepare a wax dispersion A1 (emulsion solid content concentration=31.2%, wax component concentration 30.8%).

<Preparation of Wax Dispersion A2>

A wax dispersion A2 (emulsion solid content concentration=31.1%) was prepared by using the same method used in the case of the wax dispersion A1 except that 22.50 parts of the above-described ester wax 1, 7.50 parts (1080 g) of ester wax 2 (prepared by NOF CORPORATION, Product name: WEP-5, Catalog melting point: 82° C., Catalog acid value: 0.1 mgKOH/g, Catalog hydroxyl value: equal to or lower than 3 mgKOH/g), 0.24 parts of decaglycerin decabenate, 1.93 parts of 20% DBS aqueous solution, and 67.83 parts of demineralized water were used.

<Preparation of Primary Polymer Particle Dispersion B1>

34.7 parts of the wax dispersion A1, 252 parts of demineralized water and 0.02 parts of 0.5% iron sulfate (II) sulfate heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier solution minutes was added for 240 minutes.

The time at which the mixture of the following monomers and emulsifier aqueous solution was started to added was taken as the polymerization initiation, and the following initiator aqueous solution was added for 480 minutes from 0 minute of the initiation of polymerization. The following iron sulfate aqueous solution was added at 240 minute after the initiation of polymerization. The temperature was raised to 95° C. at 300 minutes after the initiation of polymerization. Heating and stirring was continued until 540 minutes of the initiation of polymerization.

| [Monomers] | |
|---|---|
| Styrene | 70.9 parts |
| Butyl acrylate | 29.1 parts |
| Acrylic acid | 0.85 parts |
| Trichlorobromomethane | 1.0 parts |
| Hexanediol diacrylate | 0.95 parts |
| [Aqueous solution of emulsifier] | |
| 20% DBS aqueous solution | 1.0 parts |
| Demineralized water | 66.9 parts |
| [Initiator aqueous solution] | |
| 8% aqueous hydrogen peroxide solution | 28.0 parts |
| 8% L-(+) ascorbic acid aqueous solution | 28.0 parts |
| [Iron sulfate aqueous solution] | |
| 0.5% iron sulfate (II) sulfate heptahydrate aqueous solution | 0.08 parts |

After polymerization reaction, cooling was performed, and a milky white primary polymer particle dispersion B1 was obtained. The volume median diameter measured by using the nanotrack was 239 nm. The weight average molecular weight (Mw) was 67,000.

<Preparing of High Heat-Resistant Resin Fine Particle Dispersion B2>

50.7 parts of wax dispersion A2, 3.50 parts of 20% DBS aqueous solution, and 349 parts of demineralized water were added to a reactor equipped with a stirring device, a heating and cooling device, a concentrating device, and each raw material and auxiliaries charging device, and a temperature in the reactor was raised to 75° C. under a nitrogen stream while stirring.

After five minutes after adding the following initiator aqueous solution 1, while continuing the stirring, a mixture of the following monomers and emulsifier solution minutes was added for 180 minutes. The time at which the mixture of the following monomers and emulsifier aqueous solution was started to added was taken as the polymerization initiation, and the following iron sulfate aqueous solution at 180 minute of the initiation of polymerization. The temperature was raised to 93° C. at 180 minutes after the initiation of polymerization. The following initiator aqueous solution 2 was continuously added for 60 minutes from 240 minutes of the initiation of polymerization. The following initiator aqueous solution 3 was continuously added for 120 minutes from 240 minutes of the initiation of polymerization. Heating and stirring was continued until 480 minutes of the initiation of polymerization.

| [Monomers] | |
|---|---|
| Styrene | 97.9 parts |
| Butyl acrylate | 2.1 parts |
| Acrylic acid | 1.5 parts |
| 1-dodecanethiol | 1.0 parts |
| [Aqueous solution of emulsifier] | |
| 20% DBS aqueous solution | 1.0 parts |
| Demineralized water | 66.7 parts |
| [Initiator aqueous solution 1] | |
| 20% ammonium persulfate aqueous solution | 6.0 parts |
| [Initiator aqueous solution 2] | |
| 8% aqueous hydrogen peroxide solution | 14.2 parts |
| [Initiator aqueous solution 3] | |
| 8% L-(+) ascorbic acid aqueous solution | 21.3 parts |
| [Iron sulfate aqueous solution] | |
| 0.5% iron sulfate (II) sulfate heptahydrate aqueous solution | 0.05 parts |

After polymerization reaction, cooling was performed, and a milky white high heat-resistant resin fine particle dispersion B2 was obtained. The volume median diameter ($Dv_{50}$) measured by using the nanotrack was 112 nm. The weight average molecular weight (Mw) was 41,000.

<Preparation of Toner Base Particle C1>

89 parts (solid content) of primary polymer particle dispersion B1, 0.27 parts (solid content) of 20% DBS aqueous solution, 33 parts of deionized water, 0.52 parts (solid content) of 5% iron sulfate (II) sulfate heptahydrate aqueous solution, and 18 parts of cyan colorant EP-700 (prepared by Dainichiseika Color & Chemicals Mfg. Co., Ltd.) were sequentially added to a reactor equipped with a stirring device, a heating and cooling device, and each raw material and auxiliaries charging device while stirring 41 parts of deionized water.

The internal temperature was raised to 45° C. for 260 minutes. Here, the volume median diameter ($Dv_{50}$) was measured using Multisizer, and it was 5.2 μm. 9.8 parts (solid content) of primary polymer particle dispersion B1 was added.

After 30 minutes, 4.0 parts (solid content) high heat-resistant resin fine particle dispersion B2 was added. After 90 minutes, 4.1 parts (solid content) of 20% DBS aqueous solution and 23 parts of deionized water were added, and then the temperature was raised up to 69° C. for 60 minutes and was kept for 45 minutes. Then it was cooled to 30° C.

The obtained dispersion was extracted and suction filtered with an aspirator using filter paper of 5 type C (No. 5C, manufactured by Toyo Roshi Kaisha, Ltd.) The cake remaining on the filter paper was transferred to a stainless steel container equipped with a stirrer (propeller blade), and ion-exchanged water having an electric conductivity of 1 μS/cm was added and dispersed uniformly, followed by stirring for 30 minutes. After this step was repeated until the electric conductivity of the filtrate reached 2 μS/cm, the obtained cake was dried in an air dryer set at 40° C. for 48 hours so as to obtain a toner base particle C1.

<Preparing of Toner D1>

With respect to the toner base particle C1 (100 parts), 4 parts of polymer/silica composite particles (ATLAS 100: silica/polymer ratio=70/30, true specific gravity=1.7 g/cm$^3$, manufactured by Cabot, containing octahydropentalene), 0.5 parts of titania and silica composite oxide particle (STX501: prepared by Nippon Aerosil Co., Ltd.), and 0.4 parts of small particle diameter silica (RY200L: prepared by Nippon Aerosil Co., Ltd.) were added, and stirred, mixed, and sieved at 3000 rpm for 15 minutes with a Henschel mixer so as to obtain a toner D1.

Examples 12 to 18 and Comparative Examples 11 and 12

A toner was prepared by using the same method as that used in Example 11 except that in Example 11, at the time of preparing the high heat-resistant resin fine particle, the number of parts of the 20% DBS aqueous solution charged into the reactor, the particle diameter of the obtained high heat-resistant resin fine particle, and the coverage were changed to the compositions as indicated in Table 4. Various physical properties of the obtained toner are indicated in Table 4.

By using the toners obtained in Examples 11 to 18 and Comparative Examples 11 and 12, evaluation was performed by the following method.

[Measuring Method and Definition of Blocking Resistance]

The measuring method and definition of the blocking resistance are the same as the measuring method and definition described above.

[Criteria of Blocking Resistance]

The criteria of the blocking resistance is the same as the criteria as described above.

[Method of Measuring Fixability]

A recording paper (basis weight 80 g/m$^2$ paper) on which an unfixed toner image was carried was prepared and a test was performed as follows by using a heat roll fixing type fixing machine.

The roller has a diameter is 27 mm, a nip width of 9 mm, and a fixing speed of 229 mm/sec, and is provided with a heater in the upper roller, and the surface of the roller is made of a tetrafluoroethylene-perfluoroalkyl vinyl ether copolymer (PFA), and is not coated with silicone oil.

The surface temperature of the roller was raised from 135° C. in 5° C. increments, and the recording paper on which the unfixed toner image having an attachment amount of about 0.5 mg/cm$^2$ was transported to a fixing nip portion so as to obtain a fixed image.

A mending tape was affixed to the fixed image, and a weight of 2 kg was passed thereon to bring the tape and the fixed image into close contact with each other. The mending tape was peeled off, and the extent to which the fixed image transferred to the tape was visually determined. The following determination was performed based on the average value of three tests.

[Criteria of Fixability]

A: Fix at equal to or higher than 145° C.

B: Fix at higher than 145° C. and equal to or lower than 150° C.

D: Not fixed at 150° C.

TABLE 4

| | High heat-resistant resin fine particle | | | | Toner | | | | | | |
|---|---|---|---|---|---|---|---|---|---|---|---|
| | | | | | | | $[T_{2nd}]$ − | | TP2/TP1 | Toner evaluation | |
| No. | Number of parts of 20% DBS | Volume median diameter (nm) | Weight average molecular weight (Mw) | Coverage (%) | Volume median diameter ($Dv_{50}$) (μm) | Average circularity | $[T_{1st}]$ (° C.) | TP1 $[\tan\delta_{1st}]$ | $[\tan\delta_{2nd}]/[\tan\delta_{1st}]$ | Blocking resistance | Fixibility |
| Example 11 | 3.50 | 112 | 41000 | 51 | 5.6 | 0.974 | 2.3 | 1.53 | 1.67 | C | A |
| Example 12 | 3.09 | 166 | 50000 | 51 | 5.5 | 0.978 | 3.0 | 1.23 | 1.94 | A | B |
| Example 13 | 2.70 | 184 | 55000 | 51 | 5.5 | 0.976 | 3.9 | 1.20 | 2.03 | A | B |
| Example 14 | 4.40 | 83 | 42000 | 97 | 5.4 | 0.974 | 1.1 | 1.39 | 1.75 | B | A |
| Example 15 | 4.40 | 83 | 42000 | 74 | 5.4 | 0.974 | 1.5 | 1.54 | 1.64 | C | A |
| Example 16 | 3.50 | 112 | 41000 | 72 | 5.5 | 0.977 | 2.6 | 1.31 | 1.81 | A | A |
| Example 17 | 2.70 | 184 | 55000 | 44 | 5.4 | 0.975 | 2.5 | 1.31 | 1.82 | A | A |
| Example 18 | 0.50 | 215 | 76000 | 37 | 5.4 | 0.977 | 1.4 | 1.17 | 2.06 | A | B |
| Comparative Example 11 | 2.96 | 158 | 59000 | 120 | 5.7 | 0.975 | 5.3 | 0.90 | 2.47 | A | D |
| Comparative Example 12 | 4.40 | 83 | 42000 | 51 | 5.7 | 0.974 | 0.8 | 1.96 | 1.29 | D | A |

<Results>

As apparent from Table 4, in the toner of Examples 11 to 18, both of the fixability and the blocking resistance can be realized; whereas in the toner of Comparative Examples 11 and 12, both of the fixability and the blocking resistance cannot be realized, and any one of the fixability and the blocking resistance was deteriorated.

Examples 21 to 24 and Reference Examples 21 and 22

A particle diameter, an average circularity, a weight average molecular weight (Mw), and an emulsion solid content concentration of each particle of less than 1 micron and equal to or greater than 1 micron or more were measured by using the same method as described above.

Example 21

<Preparation of Wax Dispersion A1>

30.00 parts (1440 g) of ester wax 1 as wax (prepared by NOF CORPORATION, Product name: WEP-3, DSC second measurement melting point peak: 71.0° C., DSC second measurement onset temperature: 68.6° C., DSC second measurement inflection point: 69.9° C., Catalog melting point: 73° C., Catalog acid value: 0.1 mgKOH/g, Catalog hydroxyl value: equal to or lower than 3 mgKOH/g), 0.24 parts of decaglycerin decabenate (prepared by Mitsubishi-Chemical Foods Corporation, Product name: B100D, Hydroxyl value: 27, Melting point 70° C.), 1.93 parts of 20% aqueous sodium dodecyl benzene sulfonate solution (hereinafter, abbreviated as "20% DBS aqueous solution"), and 67.83 parts of demineralized water were heated at 90° C., and mixed in a CSTR type stirring layer equipped with a 450 inclined three-stage paddle blade for 20 minutes.

Subsequently, circulating emulsification was started under a pressure condition of 25 MPa using a valve homogenizer (manufactured by Gaulin, 15-M-8 PA type) while heating the dispersion at 90° C., and the particle diameter was measured with a nanotrack, and dispersed until the volume median diameter ($Dv_{50}$) reached 245 nm so as to prepare a wax dispersion A1 (emulsion solid content concentration=31.2%, wax component concentration 30.8%).

<Preparation of Wax Dispersion A2>

A wax dispersion A2 (emulsion solid content concentration=31.4%) was prepared by using the same method used in the case of the wax dispersion A1 except that 22.50 parts of the above-described ester wax 1, 7.50 parts (1080 g) of ester wax 2 (prepared by NOF CORPORATION, Product name: WEP-5, Catalog melting point: 82° C., Catalog acid value: 0.1 mgKOH/g, Catalog hydroxyl value: equal to or lower than 3 mgKOH/g), 0.24 parts of decaglycerin decabenate, 1.93 parts of 20% DBS aqueous solution, and 67.83 parts of demineralized water were used.

<Preparation of Primary Polymer Particle Dispersion B1>

34.7 parts of the wax dispersion A1, 252 parts of demineralized water and 0.02 parts of 0.5% iron sulfate (II) sulfate heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier solution minutes was added for 240 minutes.

The time at which the mixture of the following monomers and emulsifier aqueous solution was started to added was taken as the polymerization initiation, and the following initiator aqueous solution was added for 480 minutes from 0 minute of the initiation of polymerization. The following iron sulfate aqueous solution was added at 240 minute after the initiation of polymerization. The temperature was raised to 95° C. at 300 minutes after the initiation of polymerization. Heating and stirring was continued until 540 minutes of the initiation of polymerization.

| [Monomers] | |
|---|---|
| Styrene | 70.9 parts |
| Butyl acrylate | 29.1 parts |
| Acrylic acid | 0.85 parts |
| Trichlorobromomethane | 1.0 parts |
| Hexanediol diacrylate | 0.95 parts |
| [Aqueous solution of emulsifier] | |
| 20% DBS aqueous solution | 1.0 parts |
| Demineralized water | 66.9 parts |
| [Initiator aqueous solution] | |
| 8% aqueous hydrogen peroxide solution | 28.0 parts |
| 8% L-(+) ascorbic acid aqueous solution | 28.0 parts |
| [Iron sulfate aqueous solution] | |
| 0.5% iron sulfate (II) sulfate heptahydrate aqueous solution | 0.08 parts |

After polymerization reaction, cooling was performed, and a milky white primary polymer particle dispersion B1 was obtained. The volume median diameter measured by using the nanotrack was 239 nm. The weight average molecular weight (Mw) was 67,000.

<Preparing of High Heat-Resistant Resin Fine Particle Dispersion B3>

50.6 parts of wax dispersion A2, 2.96 parts of 20% DBS aqueous solution, and 350 parts of demineralized water were added to a reactor equipped with a stirring device, a heating and cooling device, a concentrating device, and each raw material and auxiliaries charging device, and a temperature in the reactor was raised to 75° C. under a nitrogen stream while stirring.

After five minutes after adding the following initiator aqueous solution 1, while continuing the stirring, a mixture of the following monomers and emulsifier solution minutes was added for 180 minutes. The time at which the mixture of the following monomers and emulsifier aqueous solution was started to added was taken as the polymerization initiation, and the following iron sulfate aqueous solution at 180 minute of the initiation of polymerization. The temperature was raised to 93° C. at 180 minutes after the initiation of polymerization. The following initiator aqueous solution 2 was continuously added for 60 minutes from 240 minutes of the initiation of polymerization. The following initiator aqueous solution 3 was continuously added for 120 minutes from 240 minutes of the initiation of polymerization. Heating and stirring was continued until 480 minutes of the initiation of polymerization.

| [Monomers] | |
|---|---|
| Styrene | 97.9 parts |
| Butyl acrylate | 2.1 parts |
| Acrylic acid | 1.5 parts |
| 1-dodecanethiol | 1.0 parts |
| [Aqueous solution of emulsifier] | |
| 20% DBS aqueous solution | 1.0 parts |
| Demineralized water | 66.7 parts |
| [Initiator aqueous solution 1] | |
| 20% ammonium persulfate aqueous solution | 6.0 parts |
| [Initiator aqueous solution 2] | |
| 8% aqueous hydrogen peroxide solution | 14.2 parts |
| [Initiator aqueous solution 3] | |
| 8% L-(+) ascorbic acid aqueous solution | 21.3 parts |
| [Iron sulfate aqueous solution] | |
| 0.5% iron sulfate (II) sulfate heptahydrate aqueous solution | 0.05 parts |

After polymerization reaction, cooling was performed, and a milky white high heat-resistant resin fine particle dispersion B3 was obtained. The volume median diameter ($Dv_{50}$) measured by using the nanotrack was 158 nm. The weight average molecular weight (Mw) was 59,000.

<Preparing of Toner Base Particle C2>

87 parts (solid content) of primary polymer particle dispersion B1, 0.07 parts (solid content) of 20% DBS aqueous solution, 74 parts of deionized water, 0.52 parts of 5% iron sulfate (II) sulfate heptahydrate aqueous solution, and 18 parts of cyan colorant EP-700 (prepared by Dainichiseika Color & Chemicals Mfg. Co., Ltd.) were sequentially added while stirring to a reactor equipped with a stirring device, a heating and cooling device, and each raw material and auxiliaries charging device, and uniformly mixed, and then 0.10 parts (solid content) of 0.5% aluminum sulfate aqueous solution was added for 15 minutes, and 41 parts of deionized water was added for five minutes.

Further, the internal temperature was raised to 44° C. for 210 minutes. Here, the volume median diameter ($Dv_{50}$) was measured using Multisizer, and it was 5.2 μm. 9.7 parts (solid content) of primary polymer particle dispersion B1 was added.

After 180 minutes, 5.6 parts (solid content) high heat-resistant resin fine particle dispersion B3 was added. After 90 minutes, 4.0 parts (solid content) of 20% DBS aqueous solution and 23 parts of deionized water were added, and then the temperature was raised up to 70° C. for 60 minutes, was kept for 75 minutes, and then cooled to 30° C.

The obtained dispersion was extracted and suction filtered with an aspirator using filter paper of 5 type C (No. 5C, manufactured by Toyo Roshi Kaisha, Ltd.) The cake remaining on the filter paper was transferred to a stainless steel container equipped with a stirrer (propeller blade), and ion-exchanged water having an electric conductivity of 1 μS/cm was added and dispersed uniformly, followed by stirring for 30 minutes. After this step was repeated until the electric conductivity of the filtrate reached 2 μS/cm, the obtained cake was dried in an air dryer set at 40° C. for 48 hours so as to obtain a toner base particle C2.

<Preparing of Toner D2>

With respect to the toner base particle C2 (100 parts), 4 parts of polymer/silica composite particles (ATLAS 100: silica/polymer ratio=70/30, true specific gravity=1.7 g/cm$^3$, manufactured by Cabot, containing octahydropentalene), 0.5 parts of titania and silica composite oxide particle (STX501: prepared by Nippon Aerosil Co., Ltd.), and 0.4 parts of small particle diameter silica (RY200L: prepared by Nippon Aerosil Co., Ltd.) were added, and stirred, mixed, and sieved at 3000 rpm for 15 minutes with a Henschel mixer so as to obtain a toner D2.

Examples 22 to 24 and Reference Examples 21 and 22

Toners D3 to D7 were prepared by using the same method as that in Example 21 except that in Example 21, the styrene/butyl acrylate ratio was changed to the composition as indicated in Table 5.

Various physical properties of the obtained toner are indicated in Table 5.

By using the toners D2 to D7 obtained in Examples 21 to 24 and Comparative Examples 21 and 22, evaluation was performed by the following method, and determination was performed based on the following criteria.

[Measuring Method and Definition of Blocking Resistance]

The measuring method and definition of the blocking resistance are the same as the measuring method and definition described above.

[Criteria of Blocking Resistance]

A: Collapse under load of equal to or less than 150 g

B: Collapse under load of larger than 150 g and equal to or less than 300 g

C: Collapse under load of larger than 300 g

[Method of Measuring Fixability]

The method of measuring the fixability is the same as the above-described method.

[Criteria of Fixability]

A: Fix at lower than 150° C.

B: Fix at 150° C.

C: Fix at higher than 150° C.

TABLE 5

| | Polymer primary particle | | Toner | | | |
|---|---|---|---|---|---|---|
| No. | Styrene/butyl acrylate ratio | Weight average molecular weight (Mw) | Toner number | Volume median diameter ($Dv_{50}$) (μm) | Average circularity | Glass transition temperature (Tg) (° C.) |
| Example 21 | 70.9/29.1 | 67000 | D2 | 5.6 | 0.976 | 41.0 |
| Example 22 | 69.1/30.9 | 117000 | D3 | 5.5 | 0.974 | 39.0 |
| Example 23 | 72.7/27.3 | 89000 | D4 | 5.4 | 0.974 | 42.5 |
| Example 24 | 74.5/25.5 | 73000 | D5 | 5.4 | 0.974 | 44.2 |
| Reference Example 21 | 67.3/32.7 | 83000 | D6 | 5.6 | 0.971 | 37.7 |
| Reference Example 22 | 78.1/21.9 | 68000 | D7 | 5.8 | 0.973 | 48.6 |

| | Toner | | | Evaluation result | |
|---|---|---|---|---|---|
| No. | BETN − BETF ($m^2$/g) [specific surface area BET] − [specific surface area FPIA] ($m^2$/g) | G' at tanδ maximum value temperature [$T_{1st}$] in first measurement (Pa) | TP2/TP1 [$\tan\delta_{2nd}$]/[$\tan\delta_{1st}$] | Blocking resistance | Fixibility |
| Example 21 | 1.028 | $1.39 \times 10^7$ | 1.92 | A | A |
| Example 22 | 1.193 | $1.01 \times 10^7$ | 2.06 | B | A |
| Example 23 | 1.159 | $2.70 \times 10^7$ | 1.91 | A | A |

TABLE 5-continued

| | | | | | |
|---|---|---|---|---|---|
| Example 24 | 1.127 | $2.10 \times 10^7$ | 1.86 | A | A |
| Reference Example 21 | 1.137 | $1.03 \times 10^7$ | 2.12 | C | A |
| Reference Example 22 | 0.505 | $7.83 \times 10^6$ | 1.81 | A | C |

<Results>

As apparent from Table 5, in toners D2 to D5 of Examples 21 to 24, both of the blocking resistance and the fixability were very excellent.

Examples 31 to 41

A particle diameter, an average circularity, a weight average molecular weight (Mw), and an emulsion solid content concentration of each particle of less than 1 micron and equal to or greater than 1 micron or more were measured by using the same method as described above.

Example 31

<Preparation of Wax Dispersion A1>

30.00 parts (1440 g) of ester wax 1 as wax (prepared by NOF CORPORATION, Product name: WEP-3, DSC second measurement melting point peak: 71.0° C., DSC second measurement onset temperature: 68.6° C., DSC second measurement inflection point: 69.9° C., Catalog melting point: 73° C., Catalog acid value: 0.1 mgKOH/g, Catalog hydroxyl value: equal to or lower than 3 mgKOH/g), 0.24 parts of decaglycerin decabenate (prepared by Mitsubishi-Chemical Foods Corporation, Product name: B100D, Hydroxyl value: 27, Melting point 70° C.), 1.93 parts of 20% aqueous sodium dodecyl benzene sulfonate solution (hereinafter, abbreviated as "20% DBS aqueous solution"), and 67.83 parts of demineralized water were heated at 90° C., and mixed in a CSTR type stirring layer equipped with a 450 inclined three-stage paddle blade for 20 minutes.

Subsequently, circulating emulsification was started under a pressure condition of 25 MPa using a valve homogenizer (manufactured by Gaulin, 15-M-8 PA type) while heating the dispersion at 90° C., and the particle diameter was measured with a nanotrack, and dispersed until the volume median diameter ($Dv_{50}$) reached 245 nm so as to prepare a wax dispersion A1 (emulsion solid content concentration=31.2%, wax component concentration 30.8%).

<Preparation of Wax Dispersion A2>

A wax dispersion A2 (emulsion solid content concentration=31.4%) was prepared by using the same method used in the case of the wax dispersion A1 except that 22.50 parts of the above-described ester wax 1, 7.50 parts (1080 g) of ester wax 2 (prepared by NOF CORPORATION, Product name: WEP-5, Catalog melting point: 82° C., Catalog acid value: 0.1 mgKOH/g, Catalog hydroxyl value: equal to or lower than 3 mgKOH/g), 0.24 parts of decaglycerin decabenate, 1.93 parts of 20% DBS aqueous solution, and 67.83 parts of demineralized water were used.

<Preparation of Primary Polymer Particle Dispersion B1>

34.7 parts of the wax dispersion A1, 252 parts of demineralized water and 0.02 parts of 0.5% iron sulfate (II) sulfate heptahydrate aqueous solution were added to a reactor equipped with a stirring device, a heating and cooling device, a concentrating device, and each raw material and auxiliaries charging device, and a temperature in the reactor was raised to 90° C. under a nitrogen stream while stirring.

Thereafter, while continuing the stirring, a mixture of the following monomers and emulsifier solution minutes was added for 240 minutes.

The time at which the mixture of the following monomers and emulsifier aqueous solution was started to added was taken as the polymerization initiation, and the following initiator aqueous solution was added for 480 minutes from 0 minute of the initiation of polymerization. The following iron sulfate aqueous solution was added at 240 minute after the initiation of polymerization. The temperature was raised to 95° C. at 300 minutes after the initiation of polymerization. Heating and stirring was continued until 540 minutes of the initiation of polymerization.

| [Monomers] | |
|---|---|
| Styrene | 70.9 parts |
| Butyl acrylate | 29.1 parts |
| Acrylic acid | 0.85 parts |
| Trichlorobromomethane | 1.0 parts |
| Hexanediol diacrylate | 0.95 parts |
| [Aqueous solution of emulsifier] | |
| 20% DBS aqueous solution | 1.0 parts |
| Demineralized water | 66.9 parts |
| [Initiator aqueous solution] | |
| 8% aqueous hydrogen peroxide solution | 28.0 parts |
| 8% L-(+) ascorbic acid aqueous solution | 28.0 parts |
| [Iron sulfate aqueous solution] | |
| 0.5% iron sulfate (II) sulfate heptahydrate aqueous solution | 0.08 parts |

After polymerization reaction, cooling was performed, and a milky white primary polymer particle dispersion B1 was obtained. The volume median diameter measured by using the nanotrack was 239 nm. The weight average molecular weight (Mw) was 67,000.

<Preparing of High Heat-Resistant Resin Fine Particle Dispersion B3>

50.6 parts of wax dispersion A2, 2.96 parts of 20% DBS aqueous solution, and 350 parts of demineralized water were added to a reactor equipped with a stirring device, a heating and cooling device, a concentrating device, and each raw material and auxiliaries charging device, and a temperature in the reactor was raised to 75° C. under a nitrogen stream while stirring.

After five minutes after adding the following initiator aqueous solution 1, while continuing the stirring, a mixture of the following monomers and emulsifier solution minutes was added for 180 minutes. The time at which the mixture of the following monomers and emulsifier aqueous solution was started to added was taken as the polymerization initiation, and the following iron sulfate aqueous solution at 180 minute of the initiation of polymerization. The temperature was raised to 93° C. at 180 minutes after the initiation of polymerization. The following initiator aqueous solution 2 was continuously added for 60 minutes from 240 minutes of the initiation of polymerization. The following initiator aqueous solution 3 was continuously added for 120 minutes from 240 minutes of the initiation of polymerization. Heating and stirring was continued until 480 minutes of the initiation of polymerization.

| [Monomers] | |
|---|---|
| Styrene | 97.9 parts |
| Butyl acrylate | 2.1 parts |
| Acrylic acid | 1.5 parts |
| 1-dodecanethiol | 1.0 parts |
| [Aqueous solution of emulsifier] | |
| 20% DBS aqueous solution | 1.0 parts |
| Demineralized water | 66.7 parts |
| [Initiator aqueous solution 1] | |
| 20% ammonium persulfate aqueous solution | 6.0 parts |
| [Initiator aqueous solution 2] | |
| 8% aqueous hydrogen peroxide solution | 14.2 parts |
| [Initiator aqueous solution 3] | |
| 8% L-(+) ascorbic acid aqueous solution | 21.3 parts |
| [Iron sulfate aqueous solution] | |
| 0.5% iron sulfate (II) sulfate heptahydrate aqueous solution | 0.05 parts |

After polymerization reaction, cooling was performed, and a milky white high heat-resistant resin fine particle dispersion B3 was obtained. The volume median diameter ($Dv_{50}$) measured by using the nanotrack was 158 nm. The weight average molecular weight (Mw) was 59,000.

<Preparing of Toner Base Particle C2>

87 parts (solid content) of primary polymer particle dispersion B1, 0.07 parts (solid content) of 20% DBS aqueous solution, 74 parts of deionized water, 0.52 parts of 5% iron sulfate (II) sulfate heptahydrate aqueous solution, and 18 parts of cyan colorant EP-700 (prepared by Dainichiseika Color & Chemicals Mfg. Co., Ltd.) were sequentially added while stirring to a reactor equipped with a stirring device, a heating and cooling device, and each raw material and auxiliaries charging device, and uniformly mixed, and then 0.10 parts (solid content) of 0.5% aluminum sulfate aqueous solution was added for 15 minutes, and 41 parts of deionized water was added for five minutes.

Further, the internal temperature was raised to 44° C. for 210 minutes. Here, the volume median diameter ($Dv_{50}$) was measured using Multisizer, and it was 5.2 μm. 9.7 parts (solid content) of primary polymer particle dispersion B1 was added.

After 180 minutes, 5.6 parts (solid content) high heat-resistant resin fine particle dispersion B3 was added. After 90 minutes, 4.0 parts (solid content) of 20% DBS aqueous solution and 23 parts of deionized water were added, and then the temperature was raised up to 70° C. for 60 minutes, was kept for 75 minutes, and then cooled to 30° C.

The obtained dispersion was extracted and suction filtered with an aspirator using filter paper of 5 type C (No. 5C, manufactured by Toyo Roshi Kaisha, Ltd.) The cake remaining on the filter paper was transferred to a stainless steel container equipped with a stirrer (propeller blade), and ion-exchanged water having an electric conductivity of 1 μS/cm was added and dispersed uniformly, followed by stirring for 30 minutes. After this step was repeated until the electric conductivity of the filtrate reached 2 μS/cm, the obtained cake was dried in an air dryer set at 40° C. for 48 hours so as to obtain a toner base particle C2.

<Preparing of Toner D8>

With respect to the toner base particle C1 (100 parts), 4 parts of polymer/silica composite particles (ATLAS 100: silica/polymer ratio=70/30, true specific gravity=1.7 g/cm$^3$, manufactured by Cabot, containing octahydropentalene), 0.5 parts of titania and silica composite oxide particle (STX501: prepared by Nippon Aerosil Co., Ltd.), and 0.4 parts of small particle diameter silica (RY200L: prepared by Nippon Aerosil Co., Ltd.) were added, and stirred, mixed, and sieved at 3000 rpm for 15 minutes with a Henschel mixer so as to obtain a toner D8.

Examples 32 to 41

Toners D9 to D18 were prepared corresponding to Example 32 to 41 by using the same method as that in Example 31 except that in Example 31, the styrene/butyl acrylate ratio, the resin/wax ratio, the wax type, and the wax ratio were changed to the composition as indicated in Table 6.

The physical properties of the wax are as follows.

WEP2: prepared by NOF CORPORATION, Catalog melting point: 60° C., DSC second measurement melting point peak: 59.1° C., DSC second measurement onset temperature: 57.4° C., DSC second measurement inflection point: 58.4° C., Catalog acid value: 0.1 mgKOH/g, and Catalog hydroxyl value: equal to or lower than 3 mgKOH/g)

WEP6: prepared by NOF CORPORATION, Catalog melting point: 77° C., Catalog acid value: 0.1 mgKOH/g, and Catalog hydroxyl value: equal to or lower than 3 mgKOH/g WE11: prepared by NOF CORPORATION, melting point: 68° C., DSC second measurement melting point peak: 66.5° C., DSC second measurement onset temperature: 64.8° C., DSC second measurement inflection point: 65.6° C.)

Various physical properties of the obtained toner are indicated in Table 6.

By using the toners D8 to D18 obtained in Examples 31 to 41, evaluation was performed by the following method, and determination was performed based on the following criteria.

[Measuring Method and Definition of Blocking Resistance]

The measuring method and definition of the blocking resistance are the same as the measuring method and definition described above.

[Criteria of Blocking Resistance]

A: Collapse under load of equal to or less than 150 g

B: Collapse under load of larger than 150 g and equal to or less than 900 g

C: Collapse under load of larger than 900 g and equal to or less than 1500 g

D: Collapse under load of larger than 1500 g

[Method of Measuring Fixability]

The method of measuring the fixability is the same as the above-described method.

[Criteria of Fixability]

A: Fix at equal to or higher than 145° C.

C: Fix at higher than 145° C. and equal to or lower than 150° C.

D: Not fixed at 150° C.

TABLE 6

| No. | Polymer primary particle: Styrene/butyl acrylate ratio | Resin/wax ratio | Wax types | Wax ratio | Weight average molecular weight (Mw) | Toner: Toner number | Volume median diameter ($Dv_{50}$) (μm) | Average circularity |
|---|---|---|---|---|---|---|---|---|
| Example 31 | 70.9/29.1 | 100/10.5 | WEP3 | | 76000 | D8 | 5.6 | 0.976 |
| Example 32 | 70.9/29.1 | 100/10.5 | WEP2 | | 75000 | D9 | 5.5 | 0.973 |
| Example 33 | 70.9/29.1 | 100/10.5 | WE11 | | 78000 | D10 | 5.4 | 0.974 |
| Example 34 | 70.9/29.1 | 100/10.5 | WEP2/WEP3 | 1/1 | 76000 | D11 | 5.5 | 0.974 |
| Example 35 | 70.9/29.1 | 100/10.5 | WE11/WEP3 | 1/1 | 83000 | D12 | 5.5 | 0.972 |
| Example 36 | 70.9/29.1 | 100/10.5 | WEP6 | | 67000 | D13 | 5.5 | 0.971 |
| Example 37 | 70.8/29.2 | 100/10.5 | WE11 | | 80000 | D14 | 5.3 | 0.973 |
| Example 38 | 76.1/23.9 | 100/10.5 | WEP2/WEP3 | 1/1 | 80000 | D15 | 5.5 | 0.975 |
| Example 39 | 73.0/27.0 | 100/10.5 | WE11/WEP3 | 1/1 | 79000 | D16 | 5.6 | 0.972 |
| Example 40 | 68.4/31.6 | 100/10.5 | WEP6 | | 84000 | D17 | 5.6 | 0.975 |
| Example 41 | 70.7/29.3 | 100/7.4 | WEP3 | | 86000 | D18 | 5.4 | 0.973 |

| No. | Toner: [G'1st]/[G'2nd] MAX | [Endothermic maximum peak 2nd] (° C.) | TP2/TP1 [tanδ2nd]/[tanδ1st] | [Maximum exothermic peak temperature Td] (° C.) | Evaluation/Determination: Blocking resistance | Fixibility |
|---|---|---|---|---|---|---|
| Example 31 | 3.12 | 70.9 | 1.92 | 62.8 | A | A |
| Example 32 | 1.51 | 59.1 | 1.84 | 45.6 | C | A |
| Example 33 | 3.02 | 66.5 | 1.83 | 60.7 | B | A |
| Example 34 | 2.06 | 66.8 | 1.86 | 55.2 | B | A |
| Example 35 | 2.87 | 68.4 | 1.97 | 63.5 | A | A |
| Example 36 | 8.32 | 75.8 | 2.26 | 44.4 | A | C |
| Example 37 | 2.31 | 66.7 | 1.82 | 60.1 | A | A |
| Example 38 | 1.45 | 66.7 | 1.67 | 55.0 | A | A |
| Example 39 | 2.79 | 68.4 | 1.82 | 63.3 | A | A |
| Example 40 | 4.69 | 70.9 | 2.05 | 48.1 | C | A |
| Example 41 | 3.63 | 70.9 | 1.95 | 57.9 | A | A |

<Results>

As apparent from Table 6, in toners D8 to D18 of Examples 31 to 41, the comparability between the blocking resistance and the fixability can be achieved.

While the present invention has been described in detail and with reference to specific embodiments, it will be apparent to those skilled in the art that various changes and modifications can be made without departing from the spirit and scope of the present invention. The present application is based on Japanese Patent Application No. 2015-256204 filed on Dec. 28, 2015, Japanese Patent Application No. 2015-256205 filed on Dec. 28, 2015, Japanese Patent Application No. 2015-256206 filed on Dec. 28, 2015, and Japanese Patent Application No. 2015-256207 filed on Dec. 28, 2015, and the contents are incorporated herein by reference.

INDUSTRIAL APPLICABILITY

The electrostatic charge image developing toner having a parameter of the present invention has excellent blocking resistance, and can achieve both of the fixability at a low temperature and the high glossiness, and thus is widely used in not only the field of image formation for visualizing electrostatic images such as printers, copying machines, and facsimile machines, but also the professional field where high glossiness and high glossiness are required and images such as photographs and graphics need to be beautifully output.

In addition, the electrostatic charge image developing toner of the present invention having the measurement value is capable of realizing both of the fixability at a low temperature and the blocking resistance, and thus is widely used in not only the field of image formation for visualizing electrostatic images such as printers, copying machines, and facsimile machines.

REFERENCE SIGNS LIST

1 Structure formed of high heat-resistant resin fine particle and external additive (discontinuous portions may be employed)

2 Core component (components constituting central portion of toner)

3 Tan δ curve in first measurement

4 Tan δ curve in second measurement

11 Core component

12 High heat-resistant resin fine particle

41 Graph of $[G'_{1st}]$

42 Graph of $[G'_{2nd}]$

43 Graph of $[G'_{1st}]/[G'_{2nd}]$

43' $[G'_{1st}]/[G'_{2nd}]$ MAX

48 [maximum exothermic peak temperature Td]

A Toner surface convex portion containing a number of thin high heat-resistant resin fine particle component B Toner surface concave portion containing small thin high heat-resistant resin fine particle component

The invention claimed is:

1. An electrostatic charge image developing toner having a ratio of TP2/TP1 of 1.47 to 2.35, wherein a first measurement value of a tan δ maximal value measured in 40° C. to 80° C. by a rheometer is set as the TP1, and a second measurement value of a tan δ maximal value measured in 40° C. to 80° C. by the rheometer is set as the TP2, and wherein when a BET specific surface area after the electrostatic change image developing toner is subjected to an external additive releasing treatment is set as BETN, and a specific surface area measured by a flow particle analyzer after the electrostatic charge image developing toner is subjected to an external additive releasing treatment is set as BETF, the BETN-BETF which is a difference therebetween is 0.54 $m^2/g$ to 1.56 $m^2/g$.

2. The electrostatic charge image developing toner according to claim 1, comprising:

a toner base particle containing at least a binder resin and a colorant; and an external additive.

3. The electrostatic charge image developing toner according to claim 2, wherein the toner base particle includes: a core component containing at least the binder resin and the colorant; and a resin fine particle component that exists surrounding the core component, wherein there is no shading difference between the core component and the resin fine particle component when measurement is performed by a scanning electron microscope; and wherein the resin fine particle is at least one selected from the group consisting of a polystyrene resin, a poly (meth) acrylic resin, a polyolefin resin, an epoxy resin and a polyester resin, where the volume median diameter ($Dv_{50}$) of resin fine particle is equal to or greater than 50 nm and equal to or less than 250 nm.

4. The electrostatic charge image developing toner according to claim 1, which has an average circularity of 0.95 to 0.99.

5. The electrostatic charge image developing toner according to claim 1, which has a volume average particle diameter of 5 to 8 μm.

6. The electrostatic charge image developing toner according to claim 1, which further comprises wax.

7. The electrostatic charge image developing toner according to claim 1, wherein the TP2/TP1 is 1.63 to 2.35.

8. The electrostatic charge image developing toner according to claim 1, wherein the TP2/TP1 is 1.63 to 2.22.

9. The electrostatic charge image developing toner according to claim 1, wherein the TP2/TP1 is 1.79 to 2.22.

10. The electrostatic charge image developing toner according to claim 1, wherein the TP2/TP1 is 1.79 to 2.09.

11. The electrostatic charge image developing toner according to claim 1, wherein the BETN-BETF is 0.77 $m^2/g$ to 1.56 $m^2/g$.

12. The electrostatic charge image developing toner according to claim 1, wherein the BETN-BETF is 0.99 $m^2/g$ to 1.45 $m^2/g$.

13. The electrostatic charge image developing toner according to claim 1, which has a glass transition temperature (Tg) measured by a differential scanning calorimeter (DSC) of 37.9° C. to 45.4° C.

14. The electrostatic charge image developing toner according to claim 1, wherein when a temperature in 40°C. to 80°C. at which the tan δ becomes maximum in a first temperature rise measurement by the rheometer is set as $[T_{1st}]$, and a temperature in 40°C. to 80°C. at which the tan δ becomes maximum in a second temperature rise measurement by the rheometer is set as $[T_{2nd}]$, the $[T_{2nd}]$-$[T_{1st}]$ which is a difference therebetween is 1.0° C. to 4.5° C., the TP1 is 1.15 to 1.80, and the TP2/TP1 is 1.50 to 2.20.

15. The electrostatic charge image developing toner according to claim 1, wherein the glass transition temperature (Tg) of the electrostatic charge image developing toner measured by the differential scanning calorimeter (DSC) is 38.5°C. to 45.5°C., and wherein when a BET specific surface area after the electrostatic charge image developing toner is subjected to an external additive releasing treatment is set as BETN, and a specific surface area measured by a flow particle analyzer after the electrostatic charge image developing toner is subjected to an external additive releasing treatment is set as BETF, BETN-BETF which is a difference therebetween is 0.60 $m^2/g$ to 1.56 $m^2/g$.

16. The electrostatic charge image developing toner according to claim 15, wherein a storage modulus (G') at a tan δ maximum value temperature ($[T_{1st}]$) in a first measurement measured in 40° C. to 80° C. by the rheometer is $1.10\times10^7$ Pa to $2.95\times10^7$ Pa.

17. The electrostatic charge image developing toner according to claim 1, wherein when a first measurement value of a storage modulus (G') measured by the rheometer is set as $[G'_{1st}]$, and a second measurement value thereof is set as $[G'_{2nd}]$, a maximum value $[G'_{1st}]/[G'_{2nd}]$ MAX of $[G'_{1st}]/[G'_{2nd}]$ in 63.0° C. to 80.0° C. is 1.40 to 10.0.

18. The electrostatic charge image developing toner according to claim 17, wherein when a maximum exothermic peak temperature measured by a differential scanning calorimeter (DSC), at the time of temperature drop is set as [maximum exothermic peak temperature Td], the [maximum exothermic peak temperature Td] is 50° C. to 75° C.

* * * * *